US007504200B2

(12) United States Patent
Goto et al.

(10) Patent No.: US 7,504,200 B2
(45) Date of Patent: Mar. 17, 2009

(54) PHOTOTHERMOGRAPHIC MATERIAL

(75) Inventors: Narito Goto, Kanagawa (JP); Kiyokazu Morita, Tokyo (JP); Keiko Itaya, Tokyo (JP)

(73) Assignee: Konica Minolta Medical & Graphic, Inc., Tokyo (JP)

( * ) Notice: Subject to any disclaimer, the term of this patent is extended or adjusted under 35 U.S.C. 154(b) by 0 days.

(21) Appl. No.: 12/019,131

(22) Filed: Jan. 24, 2008

(65) Prior Publication Data

US 2008/0187875 A1 Aug. 7, 2008

(51) Int. Cl.
*G03C 1/00* (2006.01)
*G03C 1/005* (2006.01)
*G03C 1/494* (2006.01)

(52) U.S. Cl. ..... 430/617; 430/618; 430/619; 430/620; 430/631

(58) Field of Classification Search ..... 430/617–620, 430/631

See application file for complete search history.

(56) References Cited

U.S. PATENT DOCUMENTS

2005/0118543 A1* 6/2005 Ezure ..... 430/619

FOREIGN PATENT DOCUMENTS

| | | |
|---|---|---|
| EP | 1607797 | 12/2005 |
| JP | 2001005138 | 1/2001 |
| JP | 2003015259 | 1/2003 |
| JP | 2004317778 | 11/2004 |

* cited by examiner

*Primary Examiner*—Geraldina Visconti
(74) *Attorney, Agent, or Firm*—Lucas & Mercanti, LLP

(57) ABSTRACT

A photothermographic material is disclosed, comprising on one side of a support a light-sensitive layer comprising a light sensitive silver halide, light-insensitive silver salts of aliphatic carboyxlic acids, a reducing agent and a binder resin and a light-insensitive layer and on the other side of the support a light-insensitive layer, wherein the light-insensitive layer on the light-sensitive layer side and the light-insensitive layer on the other side of the support comprises a silicon-containing polymer lubricant and a fluorine-containing compound represented by formula (SF):

$$[Rf\text{-}(L_1)_{m1}\text{-}]_p\text{-}(L_2)_{n1}\text{-}(A)_q \qquad \text{Formula (SF).}$$

11 Claims, 2 Drawing Sheets

PHOTOTHERMOGRAPHIC MATERIAL

This application claims priority from Japanese Patent Application No. JP2007-023895 filed on Feb. 2, 2007, which is incorporated hereinto by reference.

FIELD OF THE INVENTION

The present invention relates to a photothermographic material and in particular to a photothermographic material comprising on one side of a support a light-sensitive layer comprising a light-sensitive silver halide, a light-insensitive aliphatic carboxylic acid silver salt, a reducing agent and a binder and on both sides of the support light-insensitive layers.

FIELD OF THE INVENTION

In the fields of medical diagnosis and graphic arts, there have been concerns in processing of photographic film with respect to effluent produced from wet-processing of image forming materials, and recently, reduction of the processing effluent has been strongly demanded in terms of environmental protection and space saving. Accordingly, thermally developable photothermographic materials which can form images only upon heating were put into practical use and have rapidly spread in the foregoing fields.

Photothermographic materials are usually processed by a thermal-developing apparatus (also called a thermal processor) which stably heats the photothermographic material to form images. Along with this recent rapid spread, a large number of thermal-developing apparatuses have become available on the market. Further, a compact laser imager and shortening of processing time have been desired.

To improve transportability of photothermographic materials, there is known the use of lubricants to control a friction coefficient, as described in PP-A Nos. 2003-015259 and 2006-003702 (hereinafter, the term JP-A refers to Japanese Patent Application Publication).

However, rapid processing by using a compact laser imager produced problems such as occurrence of abrasion marks caused during thermal development or staining inside a development apparatus, which were not improved by conventional techniques

SUMMARY OF THE INVENTION

The present invention has come into being in view of the foregoing and it is an object of the invention to provide a photothermographic material preventing abrasion marks caused during thermal development and staining in the interior of a thermal development apparatus.

Thus, as a result of extensive study by the inventors, it was discovered that the combined use of a silicon-containing polymer lubricant and a fluorine-containing compound described below resulted in markedly effects of improving occurrence of abrasion marks during thermal development and staining in a thermal development apparatus.

One aspect of the invention is directed to a photothermographic material comprising on one side of a support a light-sensitive layer comprising a light-sensitive silver halide, a light-insensitive silver salt of aliphatic carboxylic acid, a reducing agent and a binder resin and a light-insensitive layer and, on the other side of the support opposite the light-sensitive layer a light-insensitive layer, wherein the light-insensitive layer on the light-sensitive layer side or the light-insensitive layer on the other side comprises a silicon-containing polymer lubricant and a fluorine-containing compound represented by formula (SF):

$$[Rf\text{-}(L_1)_{m1}\text{-}]_p\text{-}(L_2)_{n1}\text{-}(A)_q \qquad \text{Formula (SF)}$$

wherein Rf is a substituent having 2 to 16 carbon atoms and 13 or less fluorine atoms; $L_1$ is a linkage group having no fluorine atom; $L_2$ is a (p+q)-valent linkage group having no fluorine atom; A is an anion or its salt; m1 and n1 are each an integer of 0 or 1, p and q are each an integer of 1 to 3, provided that when q is 1, m1 and n1 are not 0 at the same time.

DETAILED DESCRIPTION OF THE INVENTION

Figure 1:
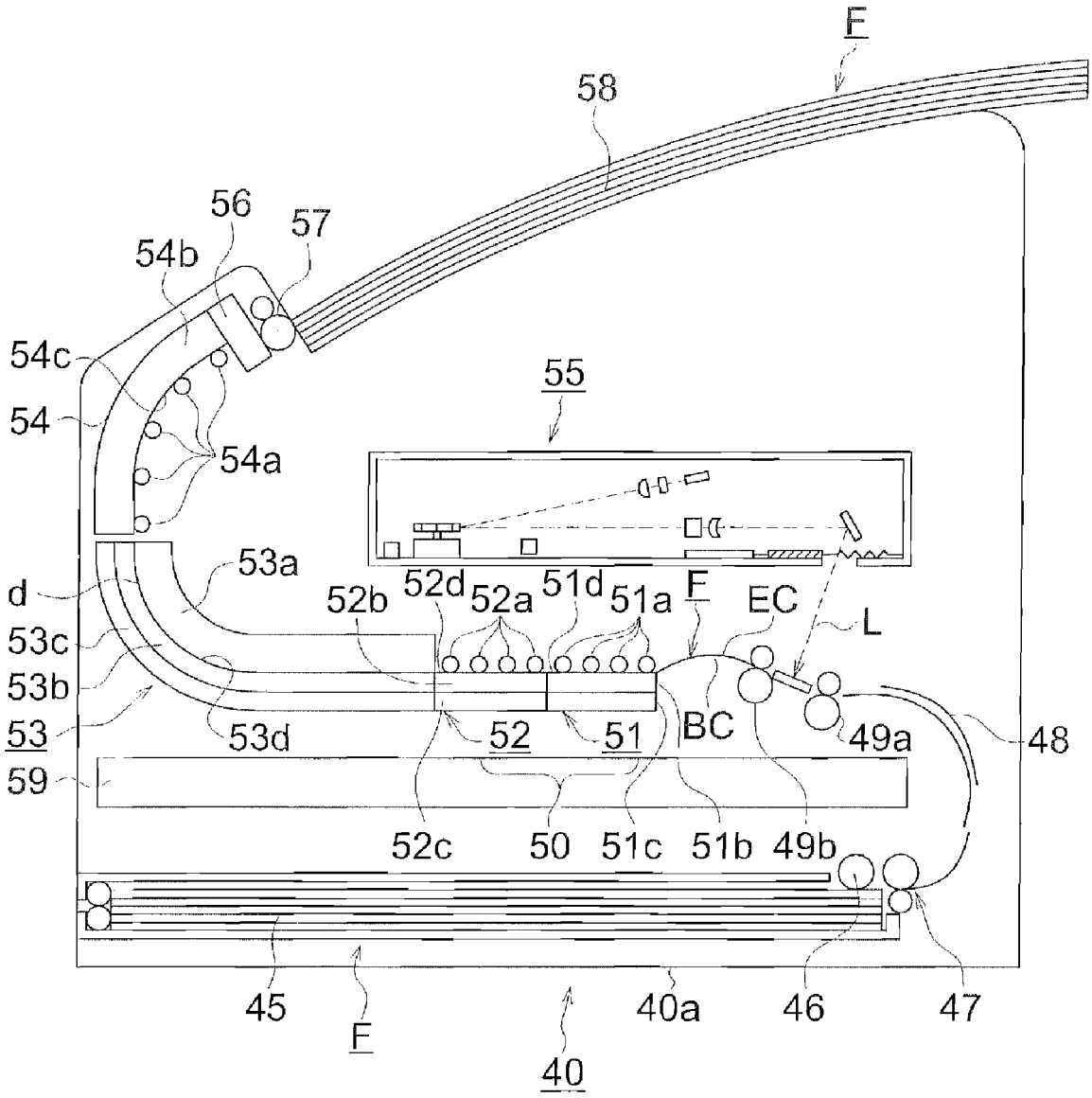
FIG. 1 is a side-view illustrating the main part of one of thermal development apparatuses relating to the invention.

There will be preferred embodiments of the invention but the invention is by no means limited to these. First, constituting elements of the invention will be sequentially described.

Lubricant

The silicon-containing polymer lubricant usable in the invention preferably has a mass average molecular weight (Mw) of 1,000 to 20,000, more preferably 2,000 to 10,000, and still more preferably 3,000 to 7,000. A silicon-containing acrylic polymer is preferred as a type of polymer.

As a preferred silicon-containing acrylic polymer is cited a comb-shaped polymer which is synthesized of a silicon-containing (macro-)monomer and an acrylic monomer, and having a backbone of an acryl polymer and a side chain constituted of silicon. Examples of an acrylic monomer include methyl methacrylate (MMA), styrene (St), acrylonitrile (AN), methacrylic acid (MA), 2-hydroxyethyl methacrylate (HEMA), butyl methacrylate (BMA) and ethyl methacrylate (EMA). There are also commercially available silicon-containing acrylic polymers, including, for example, US-270, US-350, US-352, US-380, US-413 and US-450, produced by TOAGOSEI Co., Ltd.; ACTFLOW UTMM-LS2, ACTFLOW IBMGV-LS2 and ACTFLOW IBMGV-LS4, produced by Soken Chemical & Engineering Co., Ltd.; and DAIAROMER SP-712 and DAIAROMER SP-2105, produced by Dainichiseika Color & Chemicals Inc. These are a polymeric surfactants having a relatively large molecular weight, which tend to be immobile in a coated film and can maintain a stable lubricant property and electrostatic charging property over a long period of time, and being preferred to achieve advantageous effects of the invention.

In addition to the foregoing silicon containing polymer lubricant, the photothermographic material of the invention preferably contains organic solid lubricant particles having an average size of 1 to 30 μm. The melting point of the organic solid lubricant particles is preferably from 110 to 200° C. Such organic solid lubricant particles preferably are those formed of a compound lowering a surface energy, such as particles obtained by pulverizing polyethylene, polypropylene or polytetrafluoroethylene.

In the following are shown examples of organic solid lubricant particles formed of polyethylene or polypropylene but are not limited to these:

PW-1: polyethylene (low polymerization degree, m.p.: 113, average particle size: 3.6 μm)

PW-2: polypropylene/polyethylene (m.p.: 142° C., average particle size: 9.6 μm)

PW-3: low density polyethylene (m.p.: 113° C., average particle size: 7.6 μm)

PW-4: high density polyethylene (m.p.: 126° C. Average particle size: 10.3 μm)

PW-5: polypropylene (m.p.: 145° C., average particle size: 8.8 μm)

In the photothermographic material of the invention, the organic solid lubricant is preferably a compound represented by the following formula (1). The organic solid lubricant particles preferably exhibit not more than 0.5% by mass of solubility in an organic solvent used for a coating solution for a constituting layer and 1 to 30 μm of an average particle size.

$$(R^1—X^1)_p\text{-}L\text{-}(X^2—R^2)_q \qquad \text{formula (1)}$$

wherein p and g are each an integer of 0 to 6 and; $R^1$ and $R^2$ are each an alkyl group, an alkenyl group, an aralkyl or an aryl group, each of which may be substituted and has 6 to 60 carbon atoms, provided that when p or q is 2 or more, plural $R^1$s or $R^2$s may be the same or different; $X^1$ and $X^2$ are each nitrogen-containing divalent linkage group; L is a (p+q)-valent group.

The total number of carbon atoms of the compound of formula (1) is not specifically limited but is preferably not less than 20 and more preferably not less than 30. $R^1$ and $R^2$ are each a substituted or unsubstituted alkyl, alkenyl, aralkyl or aryl group, and examples of a substituent include a halogen atom a hydroxyl group, a cyano group, an alkoxy group, an aryloxy group, an alkylthio group, an alkoxycarbonyl group, an aryloxycarbonyl group, an amino group, an acylamino group, a sulfonylamino group, a ureido group, a carbamoyl group, a sulfamoyl group, an acyl group, a sulfonyl group, a sulfinyl group, an aryl group and an alkyl group. These substituents may further be substituted, by a substituent. Preferred examples of such a substituent a halogen atom, a hydroxyl group, an alkoxy group, an alkylthio group, an alkoxycarbonyl group, an acylamino group, a sulfonylamino group, an acyl group and an alkyl group. A halogen atom is preferably a fluorine atom or a chlorine atom.

The alkyl component of the foregoing alkoxy group, alkylthio group or alkoxycarbonyl group is the same as an alkyl group of $R^2$ described below.

The amino group of an acylamino group or a sulfonylamino group may be a substituted amino group, in which a substituent is preferably an alkyl group. A group attached to a carbonyl group of the acylamino or acyl group or attached to a sulfonyl group of the sulfonylamino group is an alkyl group or an aryl group, and preferably is an alkyl group described above.

$R^1$ and $R^2$ are each an alkyl, alkenyl, aralkyl or aryl group having 6 to 60 carbon atoms, preferably 6 to 40 carbon atoms and more preferably 10 to 30 carbon atoms. These alkyl, alkenyl, aralkyl and aryl groups may be straight-chained, branched, cyclic or a mixture thereof. Preferred examples of $R^1$ and $R^2$ include octyl, t-octyl, dodecyl, tetradecyl, hexadecyl, 2-hexyldecyl, octadecyl, $C_nH_{2n+1}$ (in which n is an integer of 20 to 60), eicocyl, docosanyl, mericynyl, octenyl, myristoyl, oleyl, elcyl, phenyl, naphthyl, benzyl, nonylphenyl, dipentylphenyl, and cyclohexyl, each of which may be substituted.

$X^1$ and $X^2$ are each a nitrogen-containing divalent linkage group, and preferably —CON($R^3$)—, —N($R^4$)CON($R^5$)—, or —N($R^6$)COO— in which $R^3$, $R^4$, $R^5$ and $R^6$ are each the same as defined in $R^1$.

L is a (p+q)-valent group and preferably a (p+q)-valent hydrocarbon group derived from a substituted or unsubstituted alkyl, alkenyl, aralkyl or aryl group. The number of carbon atoms of the hydrocarbon group is not specifically limited, but preferably is 1 to 60, more preferably 1 to 40, and still more preferably 10 to 40. In the (p+q)-valent hydrocarbon group, "(p+q)-valent" means that (p+q) hydrogen atoms included in the hydrocarbon are removed, and p X1(s) and q $X_2$(s) are attached thereto, p and q are each an integer of 0 to 6 and $1 \leqq p+q \leqq 6$, preferably $1 \leqq p+q \leqq 4$, and p and q preferably are each 1.

Compounds represented by formula (1) may be a synthetic product or a natural product. A synthetic compound made of natural higher fatty acid or alcohol includes straight-chained and branched ones, forming a mixture thereof, and such a mixture may be used. A synthetic product is preferred in terms of quality stability of the composition.

Specific examples of an organic solid lubricant are shown below but are not limited to these. In the following the values in the parentheses indicate melting point (° C.)/average particle size (μm).

OW-1: laurylic acid amide (87° C./4.5 μm)
OW-2: Palmitic acid amide (100° C./5.8 μm)
OW-3: stearic acid amide (101° C./5.5 μm)
OW-4: behenic acid amide (98° C./6.7 μm)
OW-5: hydroxystearic acid amide (107° C./6.7 μm)
OW-6: oleic acid amide (75° C./3.4 μm)
OW-7: erucic acid amide (81° C./4.3 μm)
OW-8: ricinolic acid amide (62° C./5.2 μm)
OW-9: N-lauryllauric acid amide (77° C./4.4 μm)
OW-10: N-palmitylpalmitic acid amide (91° C./4.5 μm)
OW-11: N-stearylstearic acid amide (95° C./5.5 μm)
OW-12: N-oleyloleic acid amide (35° C./5.3 μm)
OW-13: N-stearyloleic acid amide (67° C./5.4 μm)
OW-14: N-oleylstearic acid amide (74° C./4.5 μm)
OW-15: N-stearylerucic acid, amide (69° C./4.7 μm)
OW-16: N-oleylpalmitic acid amide (68° C./5.0 μm)
OW-17: N-stearyl-12-hydroxystearic acid (102° C./7.3 μm)
OW-18: N-oleyl-12-hydroxystearic acid amide (90° C./7.8 μm)
OW-19: methylolstearic acid amide (110° C./5.6 μm)
OW-20: methylolbehenic acid amide (110° C./5.6 μm)
OW-21: methylene-bis-stearic acid amide (142° C./6.7 μm)
OW-22: methylene-bis-lauric acid amide (131° C./5.7 μm)
OW-23: methylene-bis-hydroxystearic acid amide (143° C./5.5 μm)
OW-24: ethylene-bis-capric acid amide (165° C./5.8 μm)
OW-25: ethylene-bis-caprylic acid amide (161° C./6.7 μm)
OW-26: ethylene-bis-lauric acid amide (157° C./6.5 μm)
OW-27: ethylene-bis-stearic acid amide (145° C./7.8 μm)
OW-28: ethylene-bis-isostearic acid amide (106° C./4.6 μm)
OW-29: ethylene-bis-hydroxystearic acid amide (145° C./6.9 μm)
OW-30: ethylene-bis-behenic acid amide (142° C./6.6 μm)
OW-31: hexamethylene-bis-stearic acid amide (140° C./7.6 μm)
OW-32: hexamethylene-bis-stearic acid amide (142° C./6.7 μm)
OW-33: hexamethylene-bis-hydroxystearic acid amide (135° C./8.1 μm)
OW-34: butylene-bis-hydroxystearic acid amide (140° C./7.8 μm)
OW-35: N,N'-distearyl-adipic acid amide (141° C./8.5 μm)

OW-36: N,N'-distearylsebacic acid amide (136° C./7.8 μm)
OW-37: methylene-bis-oleic acid amide (116° C./6.7 μm)
OW-38: ethylene-bis-oleic acid amide (119° C./6.7 μm)
OW-39: ethylene-bis-erucic acid amide (120° C./7.8 μm)
OW-40: hexamethylene-bis-oleic acid amide (110° C./7.5 μm)
OW-41: N,N'-dioleyladipic acid amide (118° C./5.6 μm)
OW-42: N,N'-dioleylsebacic acid amide (113° C./6.7 μm)
OW-43: m-xylylene-stearic acid amide (123° C./7.8 μm)
OW-44: N,N'-distearylisophthalic acid amide (125° C./8.7 μm)
OW-45: ethanolamine distearate (82° C./4.3 μm)
OW-46: N-butyl-N'-stearylurea (94° C./4.6 μm)
OW-47: N-phenyl-N'-stearylurea (99° C./5.6 μm)
OW-48: N-stearyl-N'-stearylurea (109° C./6.7 μm)
OW-49: xylylene-bis-stearylurea (166° C./6.0 μm)
OW-50: toluylene-bis-stearylurea (172° C./7.8 μm)
OW-51: hexamethylene-bis-stearylurea (173° C./6.5 μm)
OW-52: diphenylmethane-bis-stearylurea (206° C./7.6 μm)

The average particle size of a lubricant can be determined in such a manner that a lubricant dispersion is diluted and is dispersed on a grid and photographed at a 5000-fold magnification using a transmission electron microscope (e.g., 2000FX, produced by Nippon Denshi Co., Ltd.); the obtained negative image is read-in as a digital image by a scanner and at least 300 particles are measured for the respective particle size (circular equivalent diameter) and an average particle size is determined, based on arithmetic average using an appropriate image processing software.

In addition to the foregoing organic solid lubricant, for example, commonly known lubricants, for examples described in JP-A No. 11-84573, paragraphs 0061-0064 are also usable in combination with the foregoing silicon-containing polymer lubricant.

A lubricant or a fatty acid ester of a polyvalent alcohol having a molecular weight of 550 or more is preferably used as a lubricant. The use of a polyvalent alcohol having a molecular weight of 550 or more is preferred. The molecular weight of 700 or more is more preferred and the molecular weight of 800 or more is still more preferred. The upper limit of a molecular weight is not specifically limited if the targeted object of the invention is achieved but is usually not more than 10,000, preferably not more than 7,000 and more preferably not more than 5,000. These lubricants include a paraffin, a liquid paraffin and a fatty acid ester, and of these, a fatty acid ester is preferred and a fatty acid ester of a polyvalent alcohol is more preferred.

Such a fatty acid ester of a polyvalent alcohol may be wholly esterified or a part of hydroxy groups may remain. A fatty acid ester having at least two ester groups in the molecule is preferred and one having at least three ester groups is more preferred. Specifically, compounds described in Tables 1, 2 and 3 of JP-A No. 2004-334077 are cited.

The silicon-containing polymer lubricant, the organic solid lubricant of the invention and other lubricants are preferably incorporated in the outermost layer of the light-sensitive layer side or a back coat layer (hereinafter, also denoted as a BC layer). The lubricant of the invention is incorporated into the outermost layer of the light-sensitive layer side, preferably at an amount of from 0.1 to 20%, more preferably from 0.2 to 10% and still more preferably from 0.5 to 5% by mass, based on the binder used in the outermost layer (including a curing agent when the curing agent is incorporated).

The lubricant is also incorporated into the BC layer preferably at an amount of from 0.1 to 20%, more preferably from 0.2 to 10% and still more preferably from 0.5 to 5% by mass, based on the binder used in the outermost layer (including a curing agent when the curing agent is incorporated).

The BC layer means a layer provided on the opposite side of the support to the light-sensitive layer, and a subbing layer of the BC layer side and a BC layer-protective layer are also included in the BC layer. The lubricant is incorporated preferably to the BC layer-protective layer.

Fluorine-containing Surfactant

In the invention, is preferably used a fluorine-containing compound represented by the following formula (SF) is preferably used to prevent abrasion marks or staining of film, caused in a laser imager (thermal development apparatus):

$$[R_f\text{-}(L^1)_{m1}\text{-}]_p\text{-}(L^2)_{n1}\text{-}(A)_q \qquad \text{formula (SF)}$$

wherein $R_f$ represents a fluorine-containing substituent having 2 to 16 carbon atoms and 13 or less fluorine atoms, $L^1$ represents a bivalent linkage group containing no fluorine, $L^2$ represents a (p+q)-valent linkage group containing no fluorine, A represents an anion or its salt, m1 and n1 are each an integer of 0 or 1, p is an integer of 1 to 3, q is an integer of 1 to 3, provided that when q is 1, m1 and n1 are not zero at the same time.

In the formula (SF), examples of Rf of a fluorine-containing substituent include a fluoroalkyl group having 2 to 16 carbon atoms (e.g., trifluoromethyl, trifluoroethyl, perfluoroethyl, perfluorobutyl, perfluorooctyl, perfluorododecyl), and a fluoroalkenyl group (e.g., perfluoropropenyl, perfluorobutenyl, perfluorononenyl, perfluorododecenyl). $R_f$ preferably has 2 to 8 carbon atoms, and more preferably 2 to 6 carbon atoms. $R_f$ preferably contains 2 to 12 fluorine atoms, and more preferably 3 to 12 fluorine atoms.

In the foregoing formula, $L^1$ represents a bivalent, fluorine-free linkage group. Examples of divalent linking groups containing no fluorine atom include an alkylene group (e.g., a methylene group, an ethylene group, and a butylene group), an alkyleneoxy group (such as a methyleneoxy group, an ethyleneoxy group, or a butyleneoxy group), an oxyalkylene group (e.g., an oxymethylene group, an oxyethylene group, and an oxybutylene group), an oxyalkyleneoxy group (e.g., an oxymethyleneoxy group, an oxyethyleneoxy group, and an oxyethyleneoxyethyleneoxy group), a phenylene group, and an oxyphenylene group, a phenyloxy group, and an oxyphenyloxy group, or a group formed by combining these groups.

In the foregoing formula, A represents an anion group or a salt group thereof. Examples include a carboxylic acid group or salt groups thereof (sodium salts, potassium salts and lithium salts), a sulfonic acid group or salt groups thereof (sodium salts, potassium salts and lithium salts), a sulfuric acid half ester group or salt group thereof (sodium salts, potassium salts and lithium salts) and a phosphoric acid group and salt groups thereof (sodium salts, potassium salts and lithium salts).

In the foregoing formula, $L^2$ represents a fluorine-free linkage group having a valence of (p+q). Examples thereof include trivalent or tetravalent linking groups having no fluorine atom, which are groups of atoms comprised of a nitrogen atom as the center; n is an integer of 0 or 1, and preferably 1.

The fluorinated surfactants represented by the foregoing formula (SF) are prepared as follows. Alkyl compounds having 2 to 12 carbon atoms into which fluorine atoms are introduced (e.g., compounds having a trifluoromethyl group, a pentafluoroethyl group, a perfluorobutyl group, a perfluorooctyl group) and alkenyl compounds (e.g., a perfluorohexenyl group, a perfluorononenyl group) undergo addition reaction or condensation reaction with each of the tri- to hexa-valent alkanol compounds into which fluorine atom(s) are not introduced, aromatic compounds having 3 or 4 hydroxyl groups or hetero compounds. Anion group (A) is further introduced into the resulting compounds (including alkanol compounds which have been partially subjected to introduction of Rf) employing, for example, sulfuric acid esterification.

Examples of the aforesaid tri- to hexa-valent alkanol compounds include glycerin, pentaerythritol, 2-methyl-2-hydroxymethyl-1,3-propanediol, 2,4-dihydroxy 3-hydroxymethylpentane, 1,2,6-hexanrtriol, 1,1,1-tris(hydroxymethyl) propane, 2,2-bis(butanol), aliphatic triol, tetramethylolmethane, D-sorbitol, xylitol, and D-mannitol, The aforesaid aromatic compounds, having 3-4 hydroxyl groups and hetero compounds, include, for example, 1,3,5-trihydroxybenzene and 2,4,6-trihydroxypyridine.

The fluorine-containing substituent is preferably a fluoroalkyl group. Such a fluoroalkyl group contains preferably not more than 13 fluorine atoms, more preferably 3 to 12 fluorine atoms, and still more preferably 5 to 9 fluorine atoms. The fluoroalkyl group has preferably 2 or more carbon atoms, more preferably 4 to 16 carbon atoms, and still more preferably 6 to 10 carbon atoms.

Specific examples of compounds of formula (SF) are shown below.

SF-1

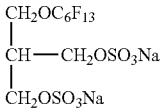

SF-2

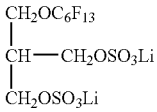

SF-3

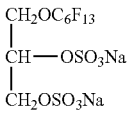

SF-4

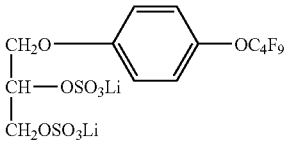

SF-5

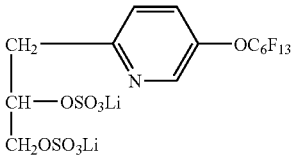

SF-6

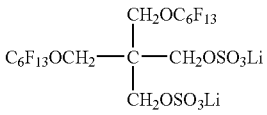

SF-7

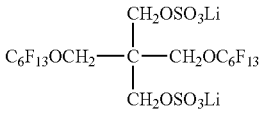

-continued

SF-8

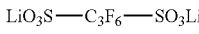

SF-9

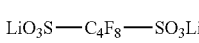

SF-10

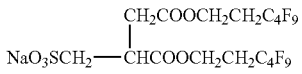

SF-11

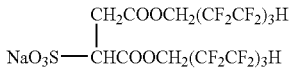

SF-12

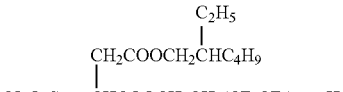

SF-13

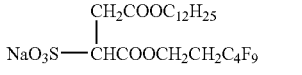

SF-14

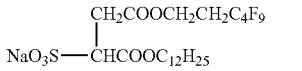

Fluorinated surfactants usable in the invention, other than the foregoing ones include compounds described in JP-A No. 2004-117505, paragraph [0035] and compounds described in JP-A Nos. 2000-214554, 2003-156819, 2003-177494, 2003-114504, 2003-270754 and 2003-270760.

The combined use of the foregoing anionic surfactants of formula (SF) and conventionally known nonionic fluorinated surfactants in the photothermographic material is preferred in terms of enhanced static property and coatability.

It is possible to add fluorinated surfactants to liquid coating compositions, employing any conventional addition methods known in the art. Thus, they are dissolved in solvents such as alcohols including methanol or ethanol, ketones such as methyl ethyl ketone or acetone, and polar solvents such as dimethylformamide, and then added Further, they may be dispersed into water or organic solvents in the form of minute particles at a maximum size of 1 μm, employing a sand mill, a jet mill, or an ultrasonic homogenizer and then added. Many techniques are disclosed for minute particle dispersion, and it is possible to perform dispersion based on any of these. It is preferable that the aforesaid fluorinated surfactants are added to the protective layer which is the outermost layer.

The added amount of the aforesaid fluorinated surfactants is preferably $1\times10^{-8}$ to $1\times10^{-1}$ mol per $m^2$, more preferably $1\times10^{-5}$ to $1\times10^{-2}$ mol per $m^2$. When the added amount is less than the lower limit, it is not possible to achieve desired charging characteristics, while if it exceeds the upper limit, storage stability degrades due to an increase in humidity dependence.

Matting Agent

In the invention, the outermost layer preferably contains a matting agent. It is preferred to use organic or inorganic powdery material in a light-insensitive layer provided on the light-sensitive layer or a light-insensitive layer of the opposite side of the support to the light-sensitive layer.

Powdery material can suitably be chosen from inorganic or organic powdery materials. Inorganic powdery materials exhibiting a Mohs hardness of 5 or more are preferred. Examples of inorganic powdery material include titanium oxide, boron nitride, $SnO_2$, $SiO_2$, $Cr_2O_3$, $\alpha$-$Al_2O_3$, $\alpha$-$Fe_2O_3$, $\alpha$-FeOOH, SiC, cerium oxide, corundum, artificial diamond, garnet, mica, silicate, silicon nitride and silicon carbide. Example of organic powdery material include polymethyl methacrylate (preferably, three-dimensionally cured polymethyl methacrylate), polystyrene, and Teflon (trade name).

A layer (BC layer) on the opposite side of the support to the light-sensitive layer preferably contains an organic powder as a matting agent, more preferably organic polymer particles and still more preferably a three-dimensionally cured polymethyl methacrylate. The glass transition point (Tg) of the three dimensionally cured polymethyl methacrylate is preferably from 130 to 150° C. to prevent staining in the interior of a thermal development apparatus.

The outermost layer of the light-sensitive layer side of the support preferably contains inorganic powders as a matting agent. Inorganic powders such as $SiO_2$, titanium oxide, barium sulfate, $\alpha$-$Al_2O_3$, $\alpha$-$Fe_2O_3$, $\alpha$-FeOOH, $Cr_2O_3$ and mica are preferred, $SiO_2$ and $\alpha$-$Al_2O_3$ are more preferred and. $SiO_2$ is specifically preferred.

Of the foregoing powdery materials, those which have been, subjected to a surface treatment, are preferred. The surface treatment layer is formed in the following manner. An inorganic raw material is subjected to dry-system pulverization, then water and a dispersing agent are added thereto and further subjected wet-system pulverization, and after subjected to centrifugal separation, coarse classification is conducted. Thereafter, the thus prepare particulate slurry is transferred to the surface treatment bath where surface coating of a metal hydroxide is performed. Thus, a prescribed amount of an aqueous solution of a salt of Al, Si, Ti, Zr, Sb, Sn, Zn or the like is added thereto and an acid or alkali is further added for neutralization to coat the inorganic powdery particulate surface with a hydrous oxide. Water-soluble salts as by-products are removed by decantation, filtration or washing. The slurry is adjusted to a specific pH value, filtered and washed with pure water. The thus washed cake is dried by a spray drier or a hand drier. Finally, the dried material is pulverized to obtain a product. Besides of the foregoing aqueous system, vapor of $AlCl_3$ or $SiCl_4$ may be introduced to non-magnetic inorganic powder, followed by introduction of water vapor to perform Al- or Si- surface treatment. Other surface treatment methods are referred to "Characterization of Powder Surfaces", Academic Press.

In the invention, it is preferred to perform a surface treatment using a silicon (Si) compound or Aluminum (Al) compound. The use of the thus surface-treated powder results in superior dispersion when preparing the dispersion of a matting agent. In that case, the Si content is preferably 0.1% to 10% by mass, more preferably 0.1% to 5% by mass and still more preferably 0.1% to 2% by mass; the Al content is preferably 0.1% to 10% by mass, more preferably 0.1% to 5% by mass and still more preferably 0.1% to 2% by mass. The weight ratio of Si to Al is preferably to be Si<Al. The surface treatment can also be performed by the method described in JP-A No. 2-83219. With respect to the average particle size of a powdery material, that of spherical particle powder is its average diameter, that of a needle-form particle powder is the average major axis length and that of tabular particle powder is the average value of maximum diagonal lines on the tabular plane, which can readily be determined by electron microscopic observation.

The average particle size of an organic or inorganic powder which is contained in the outermost layer of the light-sensitive layer side and used as a matting agent is usually in the range of from 0.5 to 8.0 μm, preferably 1.0 to 6.0 μm and more preferably from 2.0 to 5.0 μm.

A layer (also denoted as a BC layer) on the opposite side of the support to the light-sensitive layer preferably contains at least two kinds of matting agents differing in particle size, one of which is a larger matting agent having an average particle size of 12 to 30 μm, and preferably has an average particle size of 12 to 30 μm and accounts for 0.1 to 2.5% by mass of total matting agent contained in the BC layer. This larger matting agent preferably has an average particle size of 15 to 30 μm and more preferably 17 to 25 μm. The amount of a larger matting agent having an average particle size of 12 to 30 μm preferably accounts for 0.2 to 2.0% by mass of the total matting agent of the BC layer, and more preferably 0.3 to 1.5% by mass. A larger matting agent having an average particle size of 12 to 30 μm and contained in an amount of 0.1 to 2.5% by mass prevents staining in the interior of a thermal development apparatus and occurrence of abrasion marks of the film. The average particle size of a smaller matting agent contained in the BC layer, other than the larger matting agent is preferably from 4 to 11 μm, more preferably 5 to 10 μm, and still more preferably 7 to 10 μm. A coefficient of variation of particle size distribution is preferably not more than 50%, more preferably not more than 40% and still more preferably from 1 to 30%. The coefficient of variation of particle size distribution is a value defined below:

$$\{(\text{standard deviation of particle size})/(\text{average particle size})\}\times 100$$

A matting agent is contained preferably in the outermost layer of the light-sensitive layer side and the BC layer side.

When a matting agent is contained in the outermost layer of the light-sensitive layer side, the content of the matting agent is usually from 1.0 to 20% by mass of the hinder content of the layer containing the matting agent (a cross-linking agent being included in the binder content), preferably from 2.0 to 15% by mass and more preferably from 3.0 to 10% by mass.

When a matting agent is contained in the outermost layer of the opposite side to light-sensitive layer, the content of the matting agent is usually from 0.2 to 10% by mass of the binder content of the layer containing the matting agent (a cross-linking agent being included in the binder content), preferably from 0.4 to 7% by mass and more preferably from 0.6 to 5% by mass.

An inorganic or organic powder may be incorporated in such a manner that it is preliminarily dispersed in a coating solution and coated. Alternatively, after coating a coating solution, an inorganic or organic powder is sprayed thereto before completion of drying. Plural kinds of powders may employ both methods in combination.

Surface Layer

In the invention, the surface roughness of the surface layer is controlled preferably within a range. In the photothermographic material, the ten-point mean roughness (Rz), the maximum roughness (Rt) and the center-line mean roughness (Ra) are defined in JIS Surface Roughness (B0601). The JIS B 0601 also corresponds to ISO 468-1982, ISO 3274-1975, ISO 4287/1-1984, ISO 4287/2-1984 and ISO 4288-1985. The ten-point mean roughness is the value of difference, being expressed in micrometer (μm), between the mean value of altitudes of peaks from the heist to the 5th, measured in the direction of vertical magnification from a straight line that is parallel to the mean line and that does not intersect the profile, and the mean value of altitudes of valleys from the deepest to the 5th, within a sample portion, the length of which corresponds to the reference length, from the profile. The maximum roughness (Rt) of the surface is determined as follows. Thus, when a length corresponding to the reference length (L) in the direction of a mean line is sampled from a roughness profile, the maximum roughness (Rt) is a value, expressed in micrometer (μm) measuring the space between a peak line and a valley line in the direction of vertical magnification of the profile. The center-line mean roughness (Ra), when the roughness curve is expressed by y=f(x), is a value, expressed in micrometer (μm), that is obtained from the following formula, extracting a part of reference length L in the direction of its center-line from the roughness curve, and taking the center-line of this extracted part as the X-axis and the direction vertical magnification as the Y-axis:

$$Ra = \frac{1}{L}\int_0^L |f(x)|\,dx$$

The measurement of Rz, Rt and Ra were made under an environment of 25° C. and 65% RH after allowed to stand under the same environment so that samples are not overlapped. The expression "samples are not overlapped" means a method of winding with raising the film edge portion, overlapping with inserting paper between films or a method in which a frame is prepared with thick paper and its four corners are fixed. Measurement apparatuses usable in the invention include, for example, RST PLUS non-contact three-dimensional micro-surface-form measurement system (WYKO Co.).

The Rz, Rt and Ra values can be adjusted so as to fall within the intended range by combination of the following technical means:

(1) the kind, average particle size, amount and a surface treatment method of a matting agent (inorganic or organic powder) contained in the layer of the light-sensitive layer side and in the layer of the opposite side, (2) dispersing conditions of the matting agent (e.g., the kind of a dispersing machine, dispersing time, the kind or the average particle size of beads used in the dispersion, the kind and amount of a dispersing agent, the kind of a polar group of a binder and its content), (3) drying conditions in the coating stage (e.g., coating speed, distance from the coating side to the hot air nozzle, drying air volume) and residual solvent quantity, (4) the kind of a filter used for filtration of coating solutions and filtration time, and (5) when subjected to a calendering treatment after coating, its conditions (e.g., a calendering temperature of 40 to 80° C., a pressure of 50 to 300 kg/cm, a line-speed of 20 to 100 m and the nip number of 2 to 6).

In the invention, the value of Rz(E)/Rz(B) is preferably not less than 0.1 and not more than 0.7, more preferably not less than 0.2 and not more than 0.6, and still more preferably not less than 0.3 and not more than 0.55, in which "(E)" represents the outermost surface of the light-sensitive layer side and "(B)" represents the outermost surface of the BC layer side opposite light-sensitive layer. The foregoing range results in enhanced transportability of the photothermographic material and improvement of unevenness of density occurred in thermal development.

The value of Ra(E)/Ra(B) is preferably 0.6 to 1.5, more preferably 0.6 to 1.3, and still more preferably 0.7 to 1.1, thereby resulting in minimized fogging during aging, enhanced film tacking characteristics and minimized unevenness in density, caused in thermal development.

The photothermographic material of the invention preferably has layers containing plural kinds of matting agents on both sides of the support. When matting agent(s) are contained in the outermost layer of the light-sensitive layer side and the average particle size of a matting agent exhibiting the maximum average particle size is designated as Le (μm), and matting agents are also contained in the outermost surface layer of the opposite side to the light-sensitive layer and the average particle size of a matting agent exhibiting the maximum average particle size is designated as Lb (μm), the ratio of Lb/Le is 2.0 to 10, and more preferably 3.0 to 4.5, thereby resulting in an improvement in unevenness of density. Further, the value of Rz(E)/Ra(E) of the light-sensitive layer side is preferably 12 to 60, and more preferably 14 to 50, thereby resulting in improvements in unevenness of density and storage stability. The value of Rz(B)/Ra(B) is preferably 25 to 65, and more preferably 30 to 60, thereby resulting in improvements in unevenness of density and storage stability.

The foregoing surface roughness was evaluated in the following manner.

Using a noncontact three-dimensional surface analyzer (ST/PLUS, produced by WYKO Co.), a raw material sample which has not been subjected to thermal development, was measured as follows:

1) objective lens: ×10, intermediate lens: ×10
2) measurement range: 463.4 μm×623.9 μm
3) pixel size: 368×238
4) filter: cylinder correction and inclination correction
5) smoothing: medium smoothing
6) scanning speed: Low.

The foregoing Ra, Rz and Rt are defined in JIS Surface Roughness (B0601). A sample of 10 cm×10 cm was divided to 100 squares at intervals of 1 cm, the center of the respective square regions was measured and an average value was calculated from 100 measurements.

In the invention, a photographic characteristic curve refers to a D-logE curve representing the relationship obtained by plotting the optical density, that is, diffuse density (D) as an ordinate against the common logarithm of the exposure (logE) as abscissa. A gamma (γ) value is a slope of a tangent line at the optical density of 1.2 on the characteristic curve (which is also represented by tan θ where 0 is an angle between the tangent line and the abscissa).

The gamma (γ) value at an optical density of 1.2 on the characteristic curve is preferably from 2.0 to 6.0 and more preferably from 3.5 to 5.5. When the gamma value at an optical density of 1.2 falls within the range of 2.0 to 6.0, development uniformity is maintained even when thermally developed with transporting at a relatively high speed and enhanced diagnostic recognition can be achieved even at a low silver amount.

Adjustment of a gamma (γ) value to 2.0 to 6.0 can be readily achieved by the appropriate combination of the following techniques.

1) The kind and the amount of a developer is varied.

2) The kind and the amount of a silver saving agent is varied.

3) The kind and the amount of a silver halide is varied.

4) The kind and the amount of a spectral-sensitizing dye adsorbed onto silver halide is varied.

5) The method of chemical sensitization of silver halide and the ripening extent thereof are varied.

The dry thickness of the light-sensitive layer is preferably from 9.0 to 15.0 μm, more preferably from 9.5 to 14.0 μm, and still more preferably from 10.0 to 13.0 μm.

The total thickness of a light-sensitive layer and a light-insensitive layer provided on one side of the support of a photothermographic material is preferably from 12.0 to 19.0 μm, and more preferably from 14.0 to 18.0 μm. To achieve enhanced image density uniformity and sharpness, the maximum value of a thermally developed image density is preferably from 4.0 to 5.0, more preferably from 4.0 to 4.8 and still more preferably from 4.2 to 4.6.

An organic silver salt usable in the invention is a light-insensitive organic silver salt capable of functioning as a source for supplying silver ions necessary to form an image in the light-sensitive layer of a photothermographic material.

Organic silver salts usable in the invention which are relatively stable to light, function as a silver ion supplying source and contribute to formation of silver images when heated at a temperature of 80° C. or more in the presence of silver halide grains (photocatalyst) having latent images formed upon exposure a photocatalyst on the grain surface and a reducing agent. There have been known silver salts of organic compounds having various chemical structure. Such light-insensitive organic silver salts are described in JP-A No. 10-62899, paragraph [0048]-[0049]; European Patent Application Publication (hereinafter, denoted simply as EP-A) No. 803,764A1, page 18, line 24 to page 24, line 37; EP-A No. 962,812A1; JP-A Nos. 11-349591, 2000-7683, 2000-72711, 2002-23301, 2002-23303, 2002-49119, 2002-196446; EP-A Nos. 1246001A1 and, 1258775A1; JP-A Nos. 2003-140290, 2003-195445, 2003-295378, 2003-295379, 2003-295380 and 2003-295381.

Silver salts of aliphatic carboxylic acids, specifically long chain aliphatic carboxylic acids having 10 to 30 carbon atoms, preferably 15 to 28 carbon atoms are preferably used alone or in combination with the foregoing organic silver salts. The molecular weight of such an aliphatic carboxylic acid is preferably from 200 to 400, and more preferably 250 to 400. Preferred aliphatic carboxylic acid (or fatty acid) silver salts include, for example, silver behenate, silver arachidate, silver stearate, silver oleate, silver laurate, silver caprate, silver myristate, silver palmitate and their mixtures. Of the foregoing aliphatic carboxylic acid silver salts, a fatty acid silver salt having a silver behenate content of 50 mol % or more (preferably 70 to 99.9 mol %, more preferably 80 to 99.9 mol %, and. still more preferably 90 to 99.9 mol %) is preferably used. There is also preferred the use of an aliphatic carboxylic acid silver salt having an erucic acid silver salt content of not more than 2 mol % (preferably not more than 1 mol % and more preferably not more than 0.1 mol %).

Prior to preparation of an aliphatic carboxylic acid silver salt, it is necessary to prepare an alkali metal salt of an aliphatic carboxylic acid. Alkali metal salts usable in the invention include, for example, sodium hydroxide, potassium hydroxide and lithium hydroxide. Of these, the use of potassium hydroxide is preferred. The combined use of sodium hydroxide and potassium hydroxide is also preferred. The molar ratio of the combined use is preferably within the range of 10:90 to 75:25. The use within the foregoing range can suitably control the viscosity of a reaction mixture when forming an alkali metal salt of an aliphatic carboxylic acid through the reaction with an aliphatic carboxylic acid.

When preparing an aliphatic carboxylic acid silver salt in the presence of silver halide grains having an average grain size of 0.050 μm or less, a higher content of potassium of alkali metal salts is preferred in terms of prevention of dissolution of silver halide grains and Ostwald ripening. A high potassium content results in reduced sizes of aliphatic acid silver salt particles. The proportion of a potassium salt of total alkali metal salts is preferably 50 to 100 mol % of the whole alkali metal salts. The alkali metal salt concentration is preferably from 0.1 to 0.3 mol/1000 ml.

To obtain a sufficient image density after thermal development, the average sphere-equivalent diameter of aliphatic carboxylic acid silver salts used in the invention is preferably from 0.05 to 0.50 μm, more preferably 0.10 to 0.45 μm, and still more preferably 0.15 to 0.40 μm. The sphere-equivalent diameter refers to a diameter of a sphere having a volume equivalent to the volume of a particle of the aliphatic carboxylic acid silver salts. A coated sample is observed by a transmission electron microscope and a particle volume is determined from the projection area and thickness of an observed particle. When the particle volume is converted to a sphere having the same volume as the particle, the particle size is represented by a diameter of the sphere. The average sphere-equivalent diameter of aliphatic carboxylic acid silver salts can readily be controlled, for example, by increasing the proportion of a potassium salt in preparation of aliphatic carboxylic acid silver salts or by adjusting a zirconia bead size, a circumferential speed of a mill or a dispersing time in the process of dispersing a light-sensitive emulsion.

Other than the foregoing organic silver salts are also usable core/shell organic silver salts described in JP-A No. 2002-23303; silver salts of polyvalent carboxylic acids, as described in EP 1246001 and JP-A No. 2004-061948; and polymeric silver salts, as described in JP-A Nos. 2000-292881 and 2003-295378 to 2003-295381.

The shape of aliphatic carboxylic acid silver salts usable in the invention is not specifically limited and organic silver salts in any form, such as needle form, bar form, tabular form or scale form, are usable. Aliphatic carboxylic acid silver salts in a scale-form are preferred in the invention. There are also preferably used organic silver salts in the form of a short needle exhibiting a ratio of major axis to minor axis of 5 or less, a rectangular parallelepiped or a cube, or potato-form irregular grains. These aliphatic carboxylic acid silver salt particles result in reduced fogging during thermal development, as compared to grains in the form of a long-needle exhibiting a ratio of major axis to minor axis of 5 or more. In the invention, an aliphatic carboxylic acid silver salt in a scale form is defined as follows. The aliphatic carboxylic acid silver salt is electron-microscopically observed and the form of organic silver salt grains is approximated by a rectangular parallelepiped. When edges of the rectangular parallelepiped are designated as "a", "b," and "c" in the order from the shortest edge (in which c may be equal to b), values of shorter edges a and b are calculated to determine "x" defined as below:

$$x=b/a$$

Values of x are determined for approximately 200 grains and the average value thereof (denoted as x(av.)) is calculated. Thus, grains satisfying the requirement of $x(av.)\geqq 1.5$ are defined to be a scale form. Preferably, $30\geqq x(av.)\geqq 1.5$, and more preferably, $20\geqq x(av.)\geqq 2.0$. In this connection, the needle form satisfies $1\leqq x(av.)\leqq 1.5$.

In the foregoing grain in a scale form, "a" is regarded as a thickness of a tabular grain having a major face comprised of edges of "b" and "c". The average value of "a" is preferably from 0.01 to 0.23 μm, more preferably 0.1 to 0.20 μm. The average value of c/b is preferably from 1 to 6, more preferably 1.05 to 4, still more preferably 1.1 to 3, and further still more preferably 1.1 to 2.

The grain size distribution of an aliphatic carboxylic acid silver salt is preferably monodisperse. The expression, being monodisperse means that the percentage of a standard deviation of minor or major axis lengths, divided by an average value of the minor or major axis, is preferably less than 100%, more preferably not more than 80%, and still more preferably not more than 50%. The shape of aliphatic carboxylic acid silver salts can be determined through transmission electron-microscopic images of an aliphatic carboxylic acid silver salt dispersion. Alternatively, the standard deviation of volume-weighted grain size, divided by the average volume-weighted grain size (that is a coefficient of variation) is preferably less than 100%, more preferably not more than 80%, and still more preferably not more than 50%. The measurement thereof is carried out, for example, as follows. To an aliphatic carboxylic acid silver salt dispersed in a liquid, laser light is irradiated and an auto-correction function vs. time change of fluctuation of scattered light to determine the grain size (volume-weighted average grain size).

Conventionally known methods are applicable to manufacturing or dispersing organic silver salts of the invention, for example, a silver ion-containing solution being allowed to react with a solution or suspension of an aliphatic carboxylic acid alkali metal salt. Such a silver ion-containing solution is preferably an aqueous silver nitrate solution and a solution (or suspension) of an aliphatic carboxylic acid alkali metal salt is preferably an aqueous solution or suspension thereof. Both solutions are mixed preferably by double-jet addition using a transfer means (e.g., pump) with controlling the flow rate of the respective solutions. The solutions may be added onto the surface or into the interior of the mother liquid. In the invention, however, mixing via a transfer means is preferred. Mixing in a transfer means signifies line mixing (or line blending). Thus, a silver ion containing solution and a solution or suspension of an aliphatic carboxylic acid alkali metal salt are mixed before being introduced into a batch for stocking a reaction mixture containing products. Any stirring means of the mixing section may be applicable, for example, mechanical stirring such as a homomixer, static mixer or a turbulent-flow mixing, but it is preferred not to use mechanical stirring. In the foregoing mixing in a transfer means, there may be mixed a third liquid, such as water or a reaction mixture stocked in the batch, in addition to a silver ion containing solution and a solution or suspension of an aliphatic carboxylic acid alkali metal salt. There are also referred JP-A No. 10-62899, EP 803,763A1, EP 962,812A1, JP-A Nos. 2001-167022, 2000-7683, 2000-72711, 2001-163889, 2001-163890, 2001-163827, 2001-33907, 2001-188313, 2001-83652, 2002-64422002-31870, 2003-280135 and 2005-157190.

Dispersing aliphatic carboxylic acid silver salts concurrently in the presence of a light-sensitive silver salt, such as silver halide grains results in increased fogging and decreased sensitivity, and it is therefore preferred that the dispersion contains substantially no light-sensitive silver salt. Thus, the content of an aqueous dispersion of light-sensitive silver salt is preferably not more than 1 mol %, based on organic silver salt of the dispersion, more preferably not more than 0.1 mol %, and no addition of light-sensitive silver salt is more preferred.

The photothermographic material of the invention can be prepared by mixing an aqueous dispersion of aliphatic carboxylic acid silver salts with an aqueous dispersion of light-sensitive silver salt. The ratio of light-sensitive silver salt to aliphatic carboxylic acid silver salt can be optionally chosen but preferably from 1 to 30 mol %, more preferably 2 to 20 mol %, and still more preferably 3 to 15 mol %. To control photographic characteristics, it is preferred to mix an aqueous dispersion of at least two kinds of organic silver salts with an aqueous dispersion of at least two kinds of light-sensitive silver salts.

Organic silver salts or aliphatic carboxylic acid silver salts are usable in an intended amount but preferably 0.1 to 5 g/m$^2$, based on silver amount, more preferably 0.3 to 3 g/m$^2$, and still more preferably 0.5 to 2 g/m$^2$.

Light-sensitive silver halide grains (hereinafter, also denoted simply as silver halide grains) used in the invention are those which are capable of absorbing light as an inherent property of silver halide crystal or capable of absorbing visible or infrared light by artificial physico-chemical methods, and which are treated or prepared so as to cause a physico-chemical change in the interior and/or on the surface of the silver halide crystal upon absorbing light within the region of ultraviolet to infrared.

The silver halide grains used in the invention can be prepared according to conventionally known methods. Any one of acidic precipitation, neutral precipitation and ammoniacal precipitation is applicable and the reaction mode of aqueous soluble silver salt and halide salt includes single jet addition, double jet addition and a combination thereof. Specifically, preparation of silver halide grains with controlling the grain formation condition, so-called controlled double-jet precipitation is preferred.

The grain forming process is usually classified into two stages of formation of silver halide seed crystal grains (nucleation) and grain growth. These stages may continuously be conducted, or the nucleation (seed grain formation) and grain growth may be separately performed. The controlled double-jet precipitation, in which grain formation is undergone with controlling grain forming conditions such as pAg and pH, is preferred to control the grain form or grain size. In cases when nucleation and grain growth are separately conducted, for example, a soluble silver salt and a soluble halide salt are homogeneously and promptly mixed in an aqueous gelatin solution to form nucleus grains (seed grains), thereafter, grain growth is performed by supplying soluble silver and halide salts, while being controlled at a pAg and pH to prepare silver halide grains. After completion of grain formation, soluble salts are removed in the desalting stage, using commonly known desalting methods such as the noodle method, flocculation method, ultrafiltration method and electrodialysis method.

Silver halide grains are preferably monodisperse grains with respect to grain size. The monodisperse grains as described herein refer to grains having a coefficient of variation of grain size obtained by the formula described below of not more than 30%; more preferably not more than 20%, and still more preferably not more than 15%:

Coefficient of variation of grain size (%)=standard deviation of grain diameter/average grain diameter×100

The grain form can be of almost any one, including cubic, octahedral or tetradecahedral grains, tabular grains, spherical grains, bar-like grains, and potato-shaped grains. Of these, cubic grains, octahedral grains, tetradecahedral grains and tabular grains are specifically preferred.

The aspect ratio of tabular grains is preferably 1.5 to 100, and more preferably 2 to 50. These grains are described in U.S. Pat. No. 5,264,337, 5,314,798 and 5,320,958 and desired tabular grains can be readily obtained. Silver halide grains having rounded corners are also preferably employed.

Crystal habit of the outer surface of the silver halide grains is not specifically limited, but in cases when using a spectral sensitizing dye exhibiting crystal habit (face) selectivity in the adsorption reaction of the sensitizing dye onto the silver halide grain surface, it is preferred to use silver halide grains having a relatively high proportion of the crystal habit meeting the selectivity. In cases when using a sensitizing dye selectively adsorbing onto the crystal face of a Miller index of [100], for example, a high ratio accounted for by a Miller index [100] face is preferred. This ratio is preferably at least 50%; is more preferably at least 70%, and is most preferably at least 80%. The ratio accounted for by the Miller index [100] face can be obtained based on T. Tani, J. Imaging Sci., 29, 165 (1985) in which adsorption dependency of a [111] face or a [100] face is utilized.

It is preferred to use low molecular gelatin having an average molecular weight of not more than 50,000 in the preparation of silver halide grains used in the invention, specifically, in the stage of nucleation. Thus, the low molecular gelatin has an average molecular eight of not more than 50,000, preferably 2,000 to 40,000, and more preferably 5,000 to 25,000. The average molecular weight can be determined by means of gel permeation chromatography. The low molecular weight gelatin can be obtained by adding an enzyme to conventionally used gelatin having a molecular weight of ca. 100,000 to perform enzymatic degradation, by adding acid or alkali with heating to perform hydrolysis, by heating under atmospheric pressure or under high pressure to perform thermal degradation, or by exposure to ultrasonic.

The concentration of dispersion medium used in the nucleation stage is preferably not more than 5% by mass, and more preferably 0.05 to 3.0% by mass.

In the preparation of silver halide grains, it is preferred to use a compound, represented by the following formula, specifically in the nucleation stage:

$$YO(CH_2CH_2O)_m(CH(CH_3)CH_2O)_p(CH_2CH_2O)_nY$$

where Y is a hydrogen atom, —$SO_3M$ or —CO—B—COOM, in which M is a hydrogen atom, alkali metal atom, ammonium group or ammonium group substituted, by an alkyl group having carbon atoms of not more than 5, and B is a chained or cyclic group forming an organic dibasic acid; m and n each are 0 to 50; and p is 1 to 100. Polyethylene oxide compounds represented by foregoing formula have been employed as a defoaming agent to inhibit marked foaming occurred when stirring or moving emulsion raw materials, specifically in the stage of preparing an aqueous gelatin solution, adding a water-soluble silver and halide salts to the aqueous gelatin solution or coating an emulsion on a support during the Process of preparing silver halide photographic light sensitive materials. A technique of using these compounds as a defoaming agent is described in JP-A No. 44-9497. The polyethylene oxide compound represented by the foregoing formula also functions as a defoaming agent during nucleation. The compound represented by the foregoing formula is used preferably in an amount of not more than 1%, and more preferably 0.01 to 0.1% by mass, based on silver.

The compound is to be present at the stage of nucleation, and may be added to a dispersing medium prior to or during nucleation. Alternatively, the compound may be added to an aqueous silver salt solution or halide solution used for nucleation. It is preferred to add it to a halide solution or both silver salt and halide solutions in an amount of 0.01 to 2.0% by mass. It is also preferred to make the compound represented by formula [5] present over a period of at least 50% (more preferably, at least 70%) of the nucleation stage.

The temperature during the stage of nucleation is preferably 5 to 60° C., and more preferably 15 to 50° C. Even when nucleation is conducted at a constant temperature, in a temperature-increasing pattern (e.g., in such a manner that nucleation starts at 25° C. and the temperature is gradually increased to reach 40° C. at the time of completion of nucleation) or its reverse pattern, it is preferred to control the temperature within the range described above.

Silver salt and halide salt solutions used for nucleation are preferably in a concentration of not more than 3.5 mol/l, and more preferably 0.01 to 2.5 mol/l. The flow rate of aqueous silver salt solution is preferably $1.5\times10^{-3}$ to $3.0\times10^{-1}$ mol/min per liter of the solution, and more preferably $3.0\times10^{-3}$ to $8.0\times10^{-2}$ mol/min. per liter of the solution. The pH during nucleation is within a range of 1.7 to 10, and since the pH at the alkaline side broadens the grain size distribution, the pH is preferably 2 to 6. The pBr during nucleation is 0.05 to 3.0, preferably 1.0 to 2.5, and more preferably 1.5 to 2.0. The average grain size of silver halide of the invention is preferably 10 to 50 nm, more preferably 10 to 40 nm, and still more preferably 10 to 35 nm. An average grain size falling within the foregoing range can prevent lowering of the image density or deterioration of storage stability under light exposure (aging stability when images obtained in thermal development is used for diagnosis under room light or aged under ambient light).

In the invention, the grain size refers to an edge length of the grain in the case of regular grains such as cubic or octahedral grains. In the case of tabular grains, the grain size refers to a diameter of a circle equivalent to the projected area of the major face. In the case of irregular grains, such as spherical grains or bar-like grains, the diameter of a sphere having the same volume as the grain is defined as the grain size. Measurement is made using an electron microscope and grain size values of at least 300 grains are average and defined as an average grain size.

The combined use of silver halide grains having an average grain size of 55 to 100 nm and silver halide grains having an average grain size of 10 to 50 nm not only can control the gradation of image density but also can enhance the image density or improve (or reduce) lowering in image density during storage. The ratio (by weight) of silver halide grains having an average grain size of 10 to 50 nm to silver halide grains having an average grain size of 55 to 100 nm is preferably from 95:5 to 50:50, and more preferably from 90:10 to 60:40.

When two silver halide emulsions differing in average grain size are used in combination, these emulsions may be blended and incorporated to the light-sensitive layer. To make adjustment of gradation, the light-sensitive layer divided to at least two layers and two silver halide emulsions differing in average grain size are contained in the respective layers.

Iodide containing silver halide grains are preferably used as silver halide grains used in the invention. With respect to halide composition, silver halide grains of the invention preferably have an iodide content of 5 to 10 mol % (more preferably 40 to 100 mol %, still more preferably 70 to 100 mol %). In the foregoing iodide content range, the halide composition within the grain may be homogeneous, or stepwise or continuously varied. Silver halide grains of a core/shell structure, exhibiting a higher iodide content in the interior and/or on, the surface are preferably used. The structure is preferably 2-fold to 5-fold structure and core/shell grains having the 2-fold to 4-fold structure are more preferred.

Introduction of silver iodide into silver halide can be achieved by addition of an aqueous alkali iodide solution in the course of grain formation, addition of fine grains such as particulate silver iodide, particulate silver iodobromide, particulate silver iodochloride or silver iodochlorobromide, or addition of an iodide ion-releasing agent as described in JP-A Nos. 5-323487 and 6-11780. The silver halide usable in the invention preferably exhibits a direct transition absorption attributed to the silver iodide crystal structure within the wavelength region of 350 to 440 nm. The direct transition absorption of silver halide can be readily distinguished by observation of an exciton absorption in the range of 400 to 430 nm, due to the direct transition.

Light-sensitive silver halide grains usable in the invention are preferably those which are capable of being converted from a surface image forming type to an internal image forming type upon thermal development, resulting in reduced surface sensitivity, as described in JP-A Nos. 2003-270755 and 2005-106927. Thus, the silver halide grains form latent images capable of acting as a catalyst in development (or reduction reaction of silver ions by a reducing agent) upon exposure to light prior to thermal development on the silver halide grain surface, and upon exposure after completion of thermal development, images are formed preferentially in the interior of the grains (i.e., internal latent image formation), thereby suppressing formation of latent images on the grain surface.

Similarly to the conventional surface latent image forming type silver halide grains, the foregoing thermally surface to internal latent image-convertible silver halide grains are used preferably in an amount of 0.001 to 0.7 mol per mol of aliphatic carboxylic acid silver salt, and more preferably 0.03 to 0.5 mol.

It is preferred to prevent aggregation of silver halide grains in the course of manufacturing photothermographic material to allow silver halide grains to be homogeneously dispersed and control developed silver in a desired form, thereby achieving improvements of photographic performance and image tone.

Gelatin in which a hydrophilic group such as amino or carboxyl group is chemically modified in accordance with the condition for use is preferred to achieve prevention of aggregation or homogeneous dispersion. Modification of an amino group of gelatin to enhance hydrophobicity include, for example, phenylcarbamoyl-modification, phthalation, succinic acid-modification, acetylation, benzoyl-modification and nitrophenyl-modification, but is not limited to these. The substitution factor is preferably at least 95%, and more preferably at least 99%. Hydrophobic modification of a carboxyl group may be combined and examples thereof include methyl-esterification and amide-formation. The substitution factor of a carboxyl group is preferably 50% to 90% and more preferably 70% to 90%. The hydrophobic modification means that substitution of an amino and/or carboxyl group with a hydrophobic group enhances hydrophobicity.

It is preferred to use a polymer soluble in water and an organic solvent in place of or together with gelatin to prepare a silver halide emulsion relating to the invention. For instance, it is specifically preferred in the case when a silver halide emulsion is dispersed in an organic solvent to be coated. Examples of such an organic solvent include alcoholic type, ester type and ketone type compounds. Of these are specifically preferred ketone type organic solvents such as acetone, methyl ethyl ketone and diethyl ketone.

A polymer soluble in water and an organic solvent may be a natural polymer, or a synthetic polymer or copolymer. For instance, gelatins or rubbers which are modified so as to be compatible with the invention, are usable in the invention. It is also feasible to introduce a functional group into polymer as below for prevention of aggregation or homogeneous dispersion. Examples of the foregoing polymers include those described in JP-A No. 2005-316054, paragraph 0018.

The polymer relating to the invention may be one which is soluble in both water and an organic solvent but also one which becomes soluble or insoluble in water or an organic solvent by controlling a pH or temperature. A cloud point phenomenon is well known in surfactants. A polymer which becomes hydrophobic or organic solvent-soluble when heated and hydrophilic or water-soluble when cooled, is also usable in the invention. Even if not completely dissolved, it may be homogeneously emulsified to form micelles.

An appropriate combination of hydrophilic monomers and hydrophobic monomers can yield a desired polymer to be used in the invention.

The polymer soluble in water and an organic solvent, of which solution conditions may be adjusted, preferably exhibits a solubility in water of at least 1% by weight (at 25° C.) and a solubility in methyl ethyl ketone of at least 5% by weight (at 25° C.). A block polymer, graft polymer or comb-type polymer is suitable as a polymer soluble in water and an organic solvent, in terms of solubility, rather than a straight chain polymer, and a comb-type polymer is preferable. The isoelectric point of the polymer is preferably a pH of 6 or less.

A comb-type polymer can be manufactured by various methods but preferably by using a monomer capable of introducing a side chain having a molecular weight of 200 or more, and more preferably using ethylenically unsaturated monomers containing a polyoxyalkylene group, such as ethylene oxide or propylene oxide. Such an ethylenically unsaturated monomer containing a polyoxyalkylene group is preferably one having a polyoxyalkylene group, as described in JP-A No. 2005-316054, paragraphs 0022-0024. Commercially available monomers include those described in JP-A No. 2005-316054, paragraph 0025.

There are usable, as a polymer relating to the invention, a graft polymer using a so-called macromer, described in "Shin-Kobunshi Jikkengaku 2, Kobunshi no Gosei•Hannou" edited by Kobushigakkai (Kyoritsu Shupan, 1995) and also detailed in Y. Yamashita "Macromonomer no Kagaku to Kogyo" (IPC) The effective range of molecular weight of a macromer is 10,000 to 100,000, preferably 10,000 to 50,000, and more preferably 10,000 to 20,000. A molecular weight of less than 10,000 cannot achieve cannot achieve effects, and a molecular weight of less than 10,000 cannot achieve advantageous effects of the invention. A molecular weight of more than 100,000 deteriorates polymerizability with a co-polymerizing with a copolymerizable monomer. Specific examples thereof include AA-6, AS6S and AN-6S.

An ethylenically unsaturated monomer containing a polyoxyalkylene group may be used alone or in combination thereof.

Examples of another monomer to be reacted with the monomer described above include acrylic acid esters, methacrylic acid esters, acrylamides, methacrylamides, allyl esters, allyloxyethanols, vinyl ethers, vinyl esters, itaconic acid dialkyl esters, fumaric acid dialkyl esters and monalkylesters, and itaconic acid, acrylonitrile, methacrylonitrile, maleilonitrile, and styrene. Specific examples include compounds described in JP-A No. 2005-316054, paragraphs 0029-0030. Polymerization initiators, polymerization inhibitors, isoelectric points of polymers, the kind of solvents used in polymerization and the molecular weight of polymers are described in JP-A No. 2005-316054, paragraphs 0031-0039.

Specific examples of amphiphilic polymers, as described above are shown below but are not limited to these.

DP-1
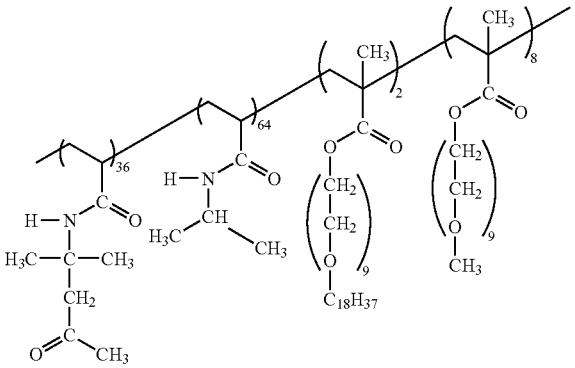
DP-2
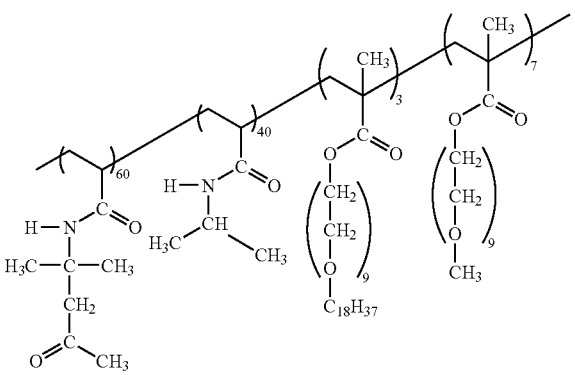
DP-3
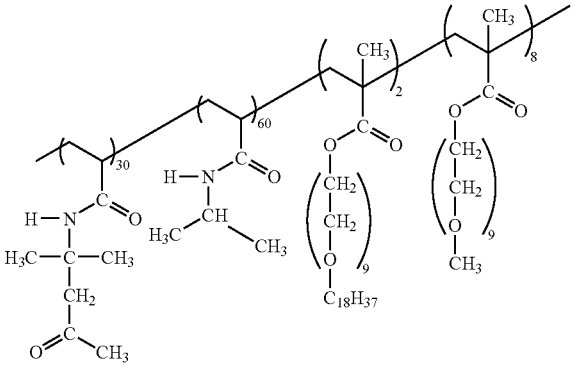
DP-4
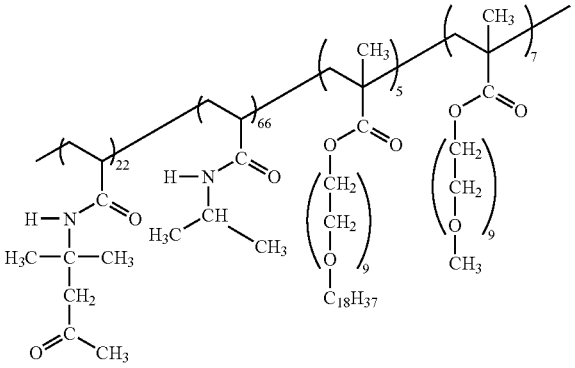
-continued
DP-5
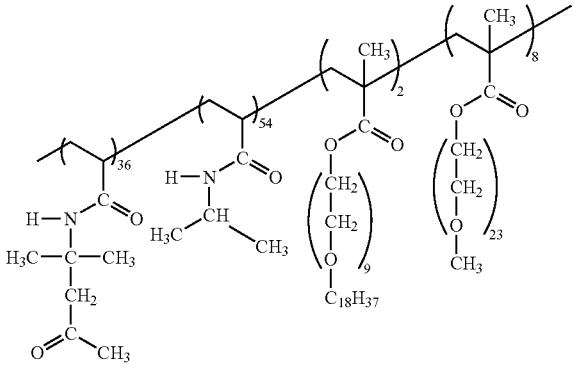
DP-6
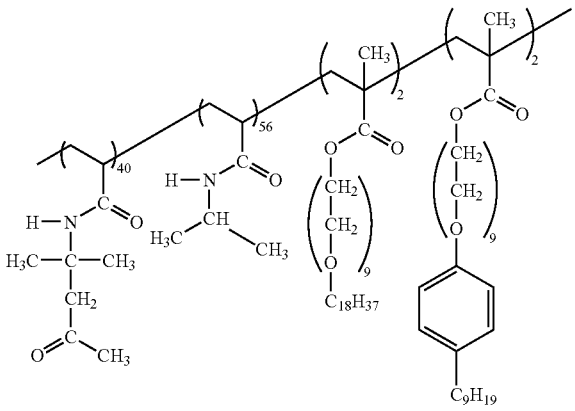
DP-7
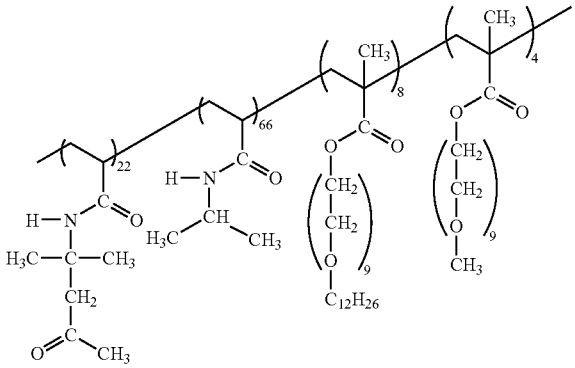
DP-8
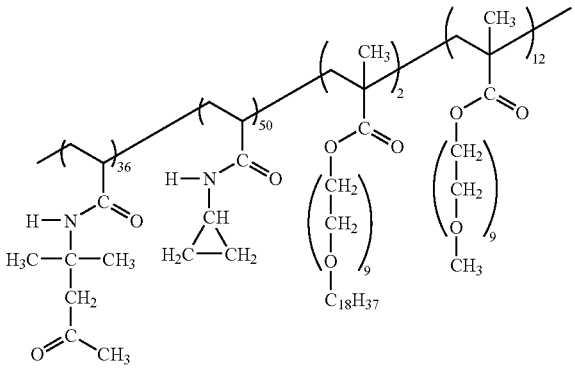

-continued

DP-9

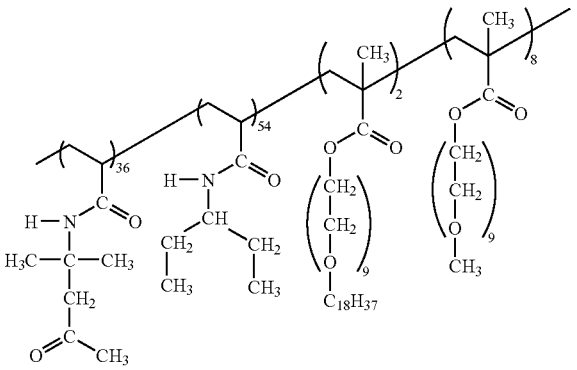

DP-10

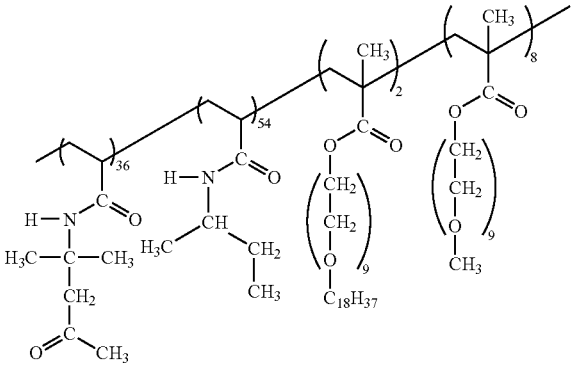

Silver halide grains used in the invention can be subjected to chemical sensitization. In accordance with methods described in JP-A Nos. 2001-249428 and 2001-249426, for example, a chemical sensitization center (chemical sensitization speck) can be formed using compounds capable of releasing chalcogen such as sulfur or noble metal compounds capable of releasing a noble metal ion such as a gold ion. In the invention, it is preferred to conduct chemical sensitization with an organic sensitizer containing a chalcogen atom, as described below. Such a chalcogen atom-containing organic sensitizer is preferably a compound containing a group capable of being adsorbed onto silver halide and a labile chalcogen atom site. These organic sensitizers include, for example, those having various structures, as described in JP-A Nos. 60-150046, 4-109240 and 11-218874. Of these is preferred at least a compound having a structure in which a chalcogen atom is attached to a carbon or phosphorus atom through a double-bond. Specifically, heterocycle-containing thiourea derivatives and triphenylphosphine sulfide derivatives are preferred.

A variety of techniques for chemical sensitization employed in silver halide photographic material for use in wet processing are applicable to conduct chemical sensitization, as described, for example, in T. H. James, The Theory of the Photographic Process, 4th Ed. (Macmillan Publishing Co., Ltd., 1977 and Nippon Shashin Gakai Ed., "Shashin Kogaku no Kiso (Gin-ene Shashin)" (Corona Co., Ltd., 1998). The amount of a chalcogen compound added as an organic sensitizer is variable, depending on the chalcogen compound to be used, silver halide grains and a reaction environment when subjected to chemical sensitization and is preferably $10^{-8}$ to $10^{-2}$ mol, and more preferably $10^{-7}$ to $10^{-3}$ mol per mol of silver halide. In the invention, the chemical sensitization environment is not specifically limited but it is preferred to conduct chemical sensitization in the presence of a compound capable of eliminating a silver chalcogenide or silver specks formed on the silver halide grain or reducing the size thereof, or specifically in the presence of an oxidizing agent capable of oxidizing the silver specks, using a chalcogen atom-containing organic sensitizer. To conduct chemical sensitization under preferred conditions, the pAg is preferably 6 to 11, and more preferably 7 to 10, the pH is preferably 4 to 10 and more preferably 5 to 8, and the temperature is preferably not more than 30° C.

Chemical sensitization using the foregoing organic sensitizer is also preferably conducted in the presence of a spectral sensitizing dye or a heteroatom-containing compound capable of being adsorbed onto silver halide grains. Thus, chemical sensitization in the presence of such a silver halide-adsorptive compound results in prevention of dispersion of chemical sensitization center specks, thereby achieving enhanced sensitivity and minimized fogging. Although there will be described spectral sensitizing dyes used in the invention, preferred examples of the silver halide-adsorptive, heteroatom-containing compound include nitrogen containing heterocyclic compounds described in JP-A No. 3-24537. In the heteroatom-containing compound, examples of the heterocyclic ring include a pyrazolo ring, pyrimidine ring, 1,2,4-triazole ring, 1,2,3-triazole ring, 1,3,4-thiazole ring, 1,2,3-thiadiazole ring, 1,2,4-thiadiazole ring, 1,2,5-thiadiazole ring, 1,2,3,4-tetrazole ring, pyridazine ring, 1,2,3-triazine ring, and a condensed ring of two or three of these rings, such as triazolotriazole ring, diazaindene ring, triazaindene ring and pentazaindene ring. Condensed heterocyclic ring comprised of a monocyclic hetero-ring and an aromatic ring include, for example, a phthalazine ring, benzimidazole ring indazole ring, and benzthiazole ring. Of these, an azaindene ring is preferred and hydroxy-substituted azaindene compounds, such as hydroxytriazaindene, tetrahydroxyazaindene and hydroxypentazaindene compound are more preferred. The heterocyclic ring may be substituted by substituent groups other than hydroxy group. Examples of the substituent group include an alkyl group, substituted alkyl group, alkylthio group, amino group, hydroxyamino group, alkylamino group, dialkylamino group, arylamino group, carboxy group, alkoxycarbonyl group, halogen atom and cyano group. The amount of the heterocyclic ring containing compound to be added, which is broadly variable with the size or composition of silver halide grains, is within the range of $10_{-6}$ to 1 mol, and preferably $10_{-4}$ to $10_{-1}$ mol per mol silver halide.

As described earlier, silver halide grains can be subjected to noble metal sensitization using compounds capable of releasing noble metal ions such as a gold ion. Examples of usable gold sensitizers include chloroaurates and organic gold compounds. In addition to the foregoing sensitization, reduction sensitization can also be employed and exemplary compounds for reduction sensitization include ascorbic acid, thiourea dioxide, stannous chloride, hydrazine derivatives, borane compounds, silane compounds and polyamine compounds. Reduction sensitization can also be conducted by ripening the emulsion while maintaining the pH at not less than 7 or the pAg at not more than 8.3. Silver halide to be subjected to chemical sensitization may be one which has been prepared in the presence of an organic silver salt, one which has been formed under the condition in the absence of the organic silver salt, or a mixture thereof.

When the surface of silver halide grains is subjected to chemical sensitization, it is preferred that the effect of the chemical sensitization substantially disappears after subjecting to thermal development. An effect of chemical sensitization substantially disappearing means that the sensitivity of the photothermographic material, obtained by the foregoing chemical sensitization is reduced, after thermal development, to not more than 1.1 times that of the case of not having been subjected to chemical sensitization. To allow the effect of chemical sensitization to disappear, it is preferred to allow an oxidizing agent such as a halogen radical-releasing compound which is capable of decomposing a chemical sensitization center (or chemical sensitization nucleus) through an oxidation reaction to be contained in an optimum amount in the light-sensitive layer and/or the light-insensitive layer. The content of an oxidizing agent is adjusted in light of oxidizing strength of an oxidizing agent and chemical sensitization effects.

Spectral Sensitization

The light-sensitive silver halide usable in the invention is preferably spectrally sensitized by adsorption of spectral sensitizing dyes. Examples of the spectral sensitizing dye include cyanine, merocyanine, complex cyanine, complex merocyanine, holo-polar cyanine, styryl, hemicyanine, oxonol and hemioxonol dyes, as described in JP-A Nos. 63-159841, 60-140335, 63-231437, 63-259651, 63-304242, 63-15245; U.S. Pat. Nos. 4,639,414, 4,740,455, 4,741,966, 4,751,175 and 4,835,096. Usable sensitizing dyes are also described in Research Disclosure (hereinafter, also denoted as RD) 17643, page 23, sect. IV-A (December, 1978), and ibid 18431, page 437, sect. X (August, 1978). It is preferred to use sensitizing dyes exhibiting spectral sensitivity suitable for spectral characteristics of light sources of various laser imagers or scanners. Examples thereof include compounds described in JP-A Nos. 9-34078, 9-54409 and 9-80679.

Useful cyanine dyes include, for example, cyanine dyes containing a basic nucleus, such as thiazoline, oxazoline, pyrroline, pyridine, oxazole, thiazole, selenazole and imidazole nuclei. Useful merocyanine dyes preferably contain, in addition to the foregoing nucleus, an acidic nucleus such as thiohydantoin, rhodanine, oxazolidine-dione, thiazoline-dione, barbituric acid, thiazolinone, malononitrile and pyrazolone nuclei. In the invention, there are also preferably used sensitizing dyes having spectral sensitivity within the infrared region. Examples of the preferred infrared sensitizing dye include those described in U.S. Pat. Nos. 4,536,478, 4,515,888 and 4,959,294.

A photothermographic material used in the invention preferably contains at least one of sensitizing dyes represented by formula (1) and sensitizing dyes represented by formula (2), as disclosed in U.S. Patent Application publication No. 20040224266, and more preferably at least one of sensitizing dyes represented by formula (5) and sensitizing dyes represented by formula (6). The combined use of sensitizing dyes represented by formula (5) and sensitizing dyes represented by formula (6) results in improved dependency on the wavelength of exposing light at the time of exposure.

The infrared sensitizing dyes and spectral sensitizing dyes described above can be readily synthesized according to the methods described in F. M. Hammer, The Chemistry of Heterocyclic Compounds vol. 18, "The Cyanine Dyes and Related Compounds" (A. Weissberger ed. Interscience Corp., New York, 1964).

The infrared sensitizing dyes can be added at any time after preparation of silver halide. For example, the dye can be added to a light sensitive emulsion containing silver halide grains/organic silver salt grains in the form of by dissolution in a solvent or in the form of a fine particle dispersion, so-called solid particle dispersion. Similarly to the heteroatom containing compound having adsorptivity to silver halide, after adding the dye prior to chemical sensitization and allowing it to be adsorbed onto silver halide grains, chemical sensitization is conducted, thereby preventing dispersion of chemical sensitization center specks and achieving enhanced sensitivity and minimized fogging.

These sensitizing dyes may be used alone or in combination thereof. The combined use of sensitizing dyes is often employed for the purpose of supersensitization, expansion or adjustment of the light-sensitive wavelength region. A supersensitizing compound, such as a dye which does not exhibit spectral sensitization or substance which does not substantially absorb visible light may be incorporated, in combination with a sensitizing dye, into the emulsion containing silver halide grains and organic silver salt grains used in photothermographic imaging materials of the invention.

Useful sensitizing dyes, dye combinations exhibiting super-sensitization and materials exhibiting supersensitization are described in RD17643 (published in December, 1978), IV-J at page 23, JP-B 9-25500 and 43-4933 (herein, the term, JP-B means published Japanese Patent) and JP-A 59-19032, 59-192242 and 5-341432. In the invention, an aromatic heterocyclic mercapto compound represented by the following formula (6) is preferred as a supersensitizer:

Ar—SM wherein M is a hydrogen atom or an alkali metal atom; Ar is an aromatic ring or condensed aromatic ring containing a nitrogen atom, oxygen atom, sulfur atom, selenium atom or tellurium atom. Such aromatic heterocyclic rings are preferably benzimidazole, naphthoimidazole, benzthiazole, naphthothiazole, benzoxazole, naphthooxazole, benzoselenazole, benzotellurazole, imidazole, oxazole, pyrazole, triazole, triazines, pyrimidine, pyridazine, pyrazine, pyridine, purine, and quinoline. Other aromatic heterocyclic rings may also be included.

A disulfide compound which is capable of forming a mercapto compound when incorporated into a dispersion of an organic silver salt and/or a silver halide grain emulsion is also included in the invention In particular, a preferred example thereof is a disulfide compound represented by the following formula Ar—S—S—Ar wherein Ar is the same as defined in the mercapto compound represented by the formula described earlier.

The aromatic heterocyclic rings described above may be substituted with a halogen atom (e.g., Cl, Br, I), a hydroxy group, an amino group, a carboxy group, an alkyl group (having one or more carbon atoms, and preferably 1 to 4 carbon atoms) or an alkoxy group (having one or more carbon atoms, and preferably 1 to 4 carbon atoms). In addition to the foregoing supersensitizers, there are usable heteroatom-containing macrocyclic compounds described in JP-A No. 2001-330918, as a supersensitizer. The supersensitizer is incorporated into a light-sensitive layer containing organic silver salt and silver halide grains, preferably in an amount of 0.001 to 1.0 mol, and more preferably 0.01 to 0.5 mol per mol of silver.

It is preferred that a sensitizing dye is allowed to adsorb onto the surface of light-sensitive silver halide grains to achieve spectral sensitization and the spectral sensitization effect substantially disappears after being subjected to thermal development. The effect of spectral sensitization substantially disappearing means that the sensitivity of the photothermographic material which has been spectrally sensitized with a sensitizing dye and optionally a supersensitizer, is reduced, after thermal development, to not more than 1.1 times that of the photothermographic material which has not been spectrally sensitized.

To allow the effect of spectral sensitization to disappear, it is preferred to use a spectral sensitizing dye easily releasable from silver halide grains and/or to allow an oxidizing agent such as a halogen radical-releasing compound which is capable of decomposing a spectral sensitizing dye through an oxidation reaction to be contained in an optimum amount in the light-sensitive layer and/or the light-insensitive layer. The content of an oxidizing agent is adjusted in light of oxidizing strength of the oxidizing agent and its spectral sensitization effects.

Reducing Agent

Reducing agents used in the invention are those which can reduce silver ions in the light-sensitive layer, are also called a developer or a developing agent.

A reducing agent usable in the invention is preferably a compound represented by the following formula (RD1) or its combined use with other reducing agents of different chemical formulas:

formula (RD1)

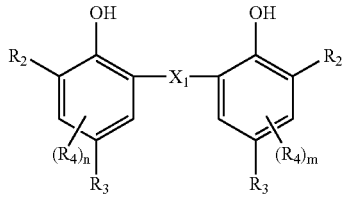

wherein $X_1$ is a chalcogen atom or $CHR_1$ in which $R_1$ is a hydrogen atom, a halogen atom, an alkyl group, an alkenyl group, an aryl group or a heterocyclic group; $R_2$ is an alkyl group, provided that both $R_2$s may be the same or different and at least one of them is a secondary or tertiary alkyl group; $R_3$ is a hydrogen atom or a group capable of being substituted on a benzene ring; $R_4$ is a group capable of being substituted on a benzene ring; m and n are each an integer of 0 to 2.

In the invention, to control thermal development characteristics, the compound of formula (RD1) can also be used in combination with a compound represented by the following formula (RD2):

formula (RD2)

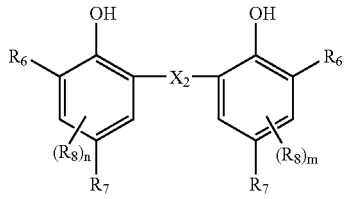

wherein $X_2$ represents a chalcogen atom or $CHR_5$ in which $R_5$ is a hydrogen atom, a halogen atom, an alkyl group, an alkenyl group, an aryl group or a heterocyclic group; both $R_6$s are alkyl groups, which may be the same or different, provided that $R_6$ is not a secondary or tertiary alkyl group; $R_7$ is a hydrogen atom or a group capable of being substituted on a benzene ring; $R_8$ is a group capable of being substituted on a benzene ring; m and n are each an integer of 0 to 2.

The mass ratio of [compound of formula (RD1)]:[compound of formula (RD2)] is preferably from 5:95 to 45:55, and more preferably from 10:90 to 40:60.

In the foregoing formula (RD1), $X_1$ represents a chalcogen atom or $CHR_1$. Specifically, the chalcogen atom is a sulfur atom, a selenium atom, or a tellurium atom. Of these, a sulfur atom is preferred; $R_1$ in $CHR_1$ represents a hydrogen atom, a halogen atom, an alkyl group, an alkenyl group, an alkynyl group, an aryl group or a heterocyclic group. Halogen atoms include, for example, a fluorine atom, a chlorine atom, and a bromine atom. Alkyl groups are an alkyl group having 1-20 carbon atoms and specific examples thereof include a methyl group, an ethyl group, a propyl group, a butyl group, a hexyl group, a heptyl group and a cycloalkyl group. Examples of alkenyl groups are, a vinyl group, an allyl group, a butenyl group, a hexenyl group, a hexadienyl group, an ethenyl-2-propenyl group, a 3-butenyl group, a 1-methyl-3-propenyl group, a 3-pentenyl group, a 1-methyl-3-butenyl group and a cyclohexenyl group. Examples of aryl groups are, a phenyl group and a naphthyl group. Examples of heterocyclic groups are, a thienyl group, a furyl group, an imidazolyl group, a pyrazolyl group and a pyrrolyl group.

These groups may have a substituent. Listed as the substituents are a halogen atom (for example, a fluorine atom, a chlorine atom, or a bromine atom), a cycloalkyl group (for example, a cyclohexyl group or a cyclobutyl group), a cycloalkenyl group (for example, a 1-cycloalkenyl group or a 2-cycloalkenyl group), an alkoxy group (for example, a methoxy group, an ethoxy group, or a propoxy group), an alkylcarbonyloxy group (for example, an acetyl group), an alkylthio group (for example, a methylthio group or a trifluoromethylthio group), a carboxyl group, an alkylcarbonylamino group (for example, an acetylamino group), a ureido group (for example, a methylaminocarbonylamino group), an alkylsulfonylamino group (for example, a methanesulfonylamino group), an alkylsulfornyl group (for example, a methanesulfonyl group and a trifluoromethanesulfonyl group), a carbamoyl group (for example, a carbamoyl group, an N,N-dimethylcarbamoyl group, or an N-morpholinocarbonyl group), a sulfamoyl group (for example, a sulfamoyl group, an N,N-dimethylsulfamoyl group, or a morpholinosulfamoyl group), a trifluoromethyl group, a hydroxyl group, a nitro group, a cyano group, an alkylsulfonamide group (for example, a methanesulfonamide group or a butanesulfonamide group), all alkylamino group (for example, an amino group, an N,N-dimethylamino group, or an N,N-diethylamino group), a sulfo group, a phosphono group, a sulfite group, a sulfino group, an alkylsulfonylaminocarbonyl group (for example, a methanesulfonylaminocarbonyl group or an ethanesulfonylaminocarbonyl group), an alkylcarbonylaminosulfonyl group (for example, an acetamidosulfonyl group or a methoxyacetamidosulfonyl group), an alkynylaminocarbonyl group (for example, an acetamidocarbonyl group or a methoxyacetamidocarbonyl group), and an alkylsulfinylaminocarbonyl group (for example, a methanesulfinylaminocarbonyl group or an ethanesulfinylaminocarbonyl group). Further, when at least two substituents are present, they may be the same or different. Most preferred substituent is an alkyl group.

In the formula (RD1), both $R_2$s are alkyl groups, which may be the same or different and at least one of the alkyl groups is a secondary or tertiary alkyl group. The alkyl groups are preferably those having 1 to 20 carbon atoms, which may be substituted or unsubstituted. Specific examples thereof include methyl, ethyl, i-propyl., butyl, i-butyl, t-butyl, t-pentyl, t-octyl, cyclohexyl, 1-methylcyclohexyl, or 1-methylcyclopropyl.

The alkyl groups each may be substituted. Substituents of the alkyl groups are not particularly limited and include, for example, an aryl group, a hydroxyl group, an alkoxy group, an aryloxy group, an alkylthio group, an arylthio group, an acylamino group, a sulfonamide group, a sulfonyl group, a phosphoryl group, an acyl group, a carbamoyl group, an ester group, and a halogen atom. In addition, $(R_4)_n$ and $(R_4)_m$ may form a saturated ring. Both $R_2$s are preferably a secondary or tertiary alkyl group and preferably has 2-20 carbon atoms, more preferably a tertiary alkyl group, still more preferably a t-butyl group, a t-amyl group, a t-pentyl group, or a 1-methylcyclohexyl group, and further still more preferably a t-butyl group or t-amyl.

$R_3$ represents a hydrogen atom or a group capable of being substituted to a benzene ring. Listed as groups capable of being substituted to a benzene ring are, for example, a halogen atom such as fluorine, chlorine, or bromine, an alkyl group, an aryl group, a cycloalkyl group, an alkenyl group, a cycloalkenyl group, an alkynyl group, an amino group, an acyl group, an acyloxy group, an acylamino group, a sulfonylamino group, a sulfamoyl group, a carbamoyl group, an alkylthio group, a sulfonyl group, an alkylsulfonyl group, a sulfonyl group, a cyano group, and a heterocyclic group $R_3$ is preferably methyl, ethyl, i-propyl, t-butyl, cyclohexyl, 1-methylcyclohexyl, or 2-hydroxyethyl. Of these, 2-hydroxyethyl is more preferred.

The foregoing groups may be substituted and examples of substituent are those as cited in the foregoing $R_1$.

In the formula (RD1), both $R_3$s are allyl groups, which may be the same or different, and at least one of the alkyl groups is an alkyl group having 1 to 20 carbon atoms and containing a hydroxyl group as a substituent or an alkyl group having 1 to 20 carbon atoms and containing, as a substituent, a group capable of forming a hydroxyl group upon deprotection, and preferably an alkyl group having 3 to 10 carbon atoms and containing a hydroxyl group or an alkyl group having 3 to 10 carbon atoms and containing a group capable of forming a hydroxyl group upon deprotection. An alkyl group having carbon atoms falling within the foregoing range can obtain an image exhibiting an average gradation of 1.8-6.0, which is suitable for diagnosis. $R_3$ is more preferably an alkyl group having 3 to 5 carbon atoms and containing a hydroxyl group. Specific examples of $R_3$ include 3-hydroxypropyl, 4-hydroxybutyl and 5-hydroxypentyl. These groups may be substituted and examples of a substituent are the same as cited in $R_1$.

The group capable of forming a hydroxyl group upon deprotection is a group which is a so-called protected hydroxyl group and is capable of being easily cleaved (or performing deprotection) by the action of acids and/or heat to form a hydroxyl group. Hereinafter, the group capable of forming a hydroxyl group upon deprotection is also called a precursor group of a hydroxyl group. Specific examples thereof include an ether group (e.g., methoxy, tert-butoxy, allyloxy, benzoyloxy, triphenylmethoxy, trimethylsilyloxy), a hemiacetal group (e.g., tetrahydropyranyloxy), an ester group (e.g., acetyloxy, benzoyloxy, p-nitrobenzoyloxy, formyloxy, trifluoroacetyloxy, pivaloyloxy), a carbonate group (e.g., ethoxycarbonyloxy, phenoxycarbonyloxy, tert-butyloxycarbonyloxy), a sulfonate group (e.g., p-toluenesulfonyloxy, benzenesulfonyloxy), a carbamoyloxy group (e.g., phenylcarbamoyloxy), a thiocarbonyloxy group (e.g., benzylthiocarbonyloxy), a nitric acid ester group, and a sulphenato group (e.g., 2,4-dinitrobenzenesulphenyloxy).

Specifically preferably, $R_3$ is a primary alkyl group of 3 to 5 carbon atoms which contains a hydroxyl group or its precursor group, for example, 3-hydroxypropyl. A specifically preferred combination of $R_2$ and $R_3$ is that $R_2$ is a tertiary alkyl group (for example, t-butyl, t-amyl, t-pentyl, 1-methylcyclohexyl) and $R_3$ is a primary alkyl group of 3 to 10 carbon atoms, containing a hydroxyl group or its precursor group (for example, 3-hydroxypropyl, 4-hydroxybutyl). Plural $R_2$s or $R_3$s may be the same or different.

$R_4$ represents a group capable of being substituted on a benzene ring. Specific examples include an alkyl group having 1 to 25 carbon atoms (e.g., methyl, ethyl, propyl, i-propyl, t-butyl, pentyl, hexyl, or cyclohexyl), a halogenated alkyl group (e.g., trifluoromethyl or perfluorooctyl), a cycloalkyl group (e.g., cyclohexyl or cyclopentyl); an alkynyl group (e.g., propargyl), a glycidyl group, an acrylate group, a methacrylate group, an aryl group (e.g., phenyl), a heterocyclic group (e.g., pyridyl, thiazolyl, oxazolyl, imidazolyl, furyl, pyrrolyl, pyradinyl, pyrimidyl, pyridadinyl, selenazolyl, piperidinyl, sulforanyl, piperidinyl, pyrazolyl, or tetrazolyl), a halogen atom (e.g., chlorine, bromine, iodine or fluorine), an alkoxy group (e.g., methoxy, ethoxy, propyloxy, pentyloxy, cyclopentyloxy, hexyloxy, or cyclohexyloxy), an aryloxy group (e.g., phenoxy), an alkoxycarbonyl group (e.g., methyloxycarbonyl, ethyloxycarbonyl, or butyloxycarbonyl), an aryloxycarbonyl group (e.g., phenyloxycarbonlyl), a sulfonamido group (e.g., methanesulfonamido, ethanesulfonamido, butanesulfonamido, hexanesulfonamido, cycloheoxabesulfonamido, benzenesulfonamido), sulfamoyl group (e.g., aminosulfonyl, methyaminosulfonyl, dimethylaminosulfonyl, butylaminosulfonyl, hexylaminosulfonyl, cyclohexylaminosufonyl, phenylaminosulfonyl, or 2-pyridylaminosulfonyl), a urethane group (e.g., methyluroeido, ethylureido, pentylureido, cyclopentylureido, phenylureido, or 2-pyridylureido), an acyl group (e.g., acetyl, propionyl, butanoyl, hexanoyl, cyclohexanoyl, benzoyl, or pyridinoyl), a carbamoyl group (e.g., aminocarbonyl, methylaminocarbonyl, dimethylaminocarbonyl, propylaminocarbonyl, a pentylaminocarbonyl group, cyclohexylaminocarbonyl, phenylaminocarbonyl, or 2-pyridylaminocarbonyl), an amido group (e.g., acetamido, propionamido, butaneamido, hexaneamido, or benzamido), a sulfonyl group (e.g., methylsulfonyl, ethylsulfonyl, butylsulfonyl, cyclohexylsulfonyl, phenylsulfonyl, or 2-pyridylsulfonyl), an amino group (e.g., amino, ethylamino, dimethylamino, butylamino, cyclopentylamino, anilino, or 2-pyridylamino), a cyano group, a nitro group, a sulfo group, a carboxyl group, a hydroxyl group, and an oxamoyl group. Further, these groups may further be substituted with these groups. Each of n and m represents an integer of from 0 to 2. However, the most preferred case is that both n and m are 0. Further, $R_4$ may form a saturated ring together with $R_2$ and $R_3$. $R_4$ is preferably a hydrogen atom, a halogen atom, or an alkyl group, and is more preferably a hydrogen atom. Plural $R_4$s may be the same or different.

In formula (RD2), $R_5$ is the same group as defined in, $R_1$ and $R_8$ is the same group as defined in $R_4$. Both $R_6$s are an alkyl group, which may be the same or different, and are not a secondary or tertiary alkyl group.

$R_7$ is a hydrogen atom or a group capable of being substituted on a benzene ring. Examples of a group capable of being substituted on a benzene ring include a halogen atom such as fluorine, chlorine, bromine or iodine, an alkyl group, an aryl group, a cycloalkyl group, an alkenyl group, a cycloalkenyl group, an alkynyl group, an amino group, an acyl group, an acyloxy group, an acylamino group, a sulfonylamino group, a sulfamoyl group, a carbamoyl group, an alkylthio group, a sulfonyl group, an alkylsulfonyl group, a sulfinyl group, cyan group and a heterocycle group. $R_7$ is preferably methyl, ethyl, I-propyl, t-butyl, cyclohexyl, 1-methylcyclohexyl, 2-hydroxyethyl, or 3-hydroxypropyl; and more preferably methyl or 3-hydroxypropyl.

The alkyl group is preferably substituted or unsubstituted one of 1-20 carbon atoms, and specific examples thereof include methyl, ethyl, propyl and butyl. Substituents for the alkyl group are not specifically limited and examples thereof include an aryl group, hydroxyl, an alkoxy group, an aryloxy group, an alkylthio group, an arylthio group, an acylamino group, a sulfonamido group, a sulfonyl group, a phosphoryl group, an acyl group, a carbamoyl group, an ester group and a halogen atom.

$R_6$ may combine with $(R_8)_n$ or $(R_8)_m$ to form a saturated ring. $R_6$ is preferably methyl, which is most preferred compound of formula (RD2). The compounds are those which satisfy formula (S) and formula (T) described in European Patent No. 1,278,101, specifically, compounds (1-24), (1-28) to (1-54) and (1-56) to (1-75) are cited.

Specific examples of the compound of formula (RD1) or (RD2) are shown below but are not limited to these.

(RD1-1)

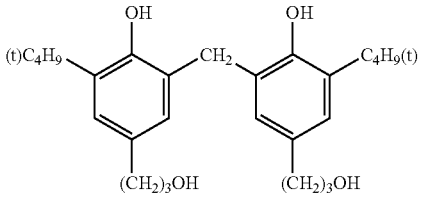

(RD1-2)

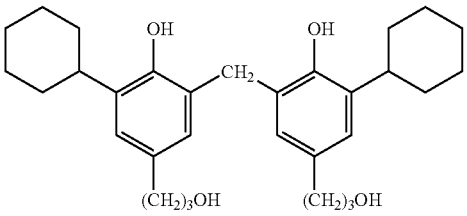

(RD1-3)

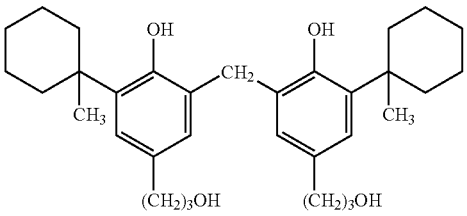

(RD1-4)

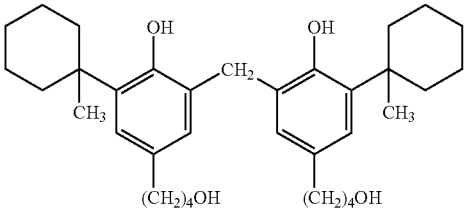

-continued (RD1-5)

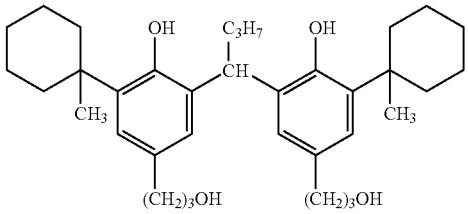

(RD1-6)

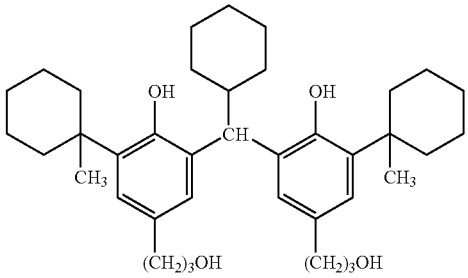

(RD1-7)

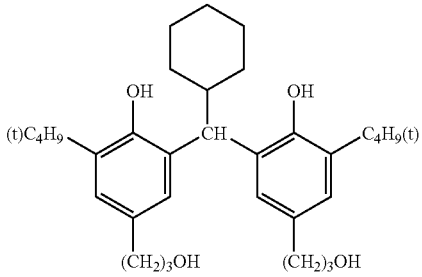

(RD1-8)

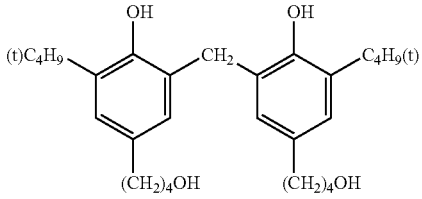

(RD1-9)

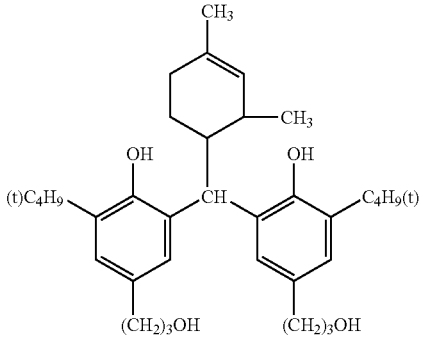

(RD1-10)

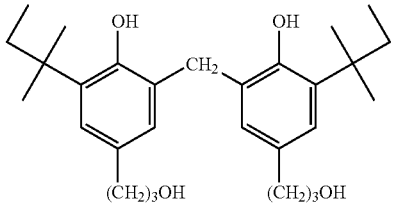

-continued
(RD1-11)
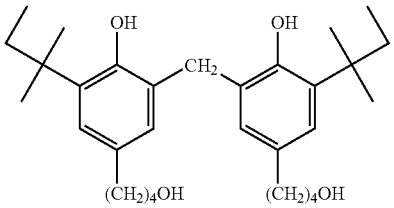
(RD1-12)
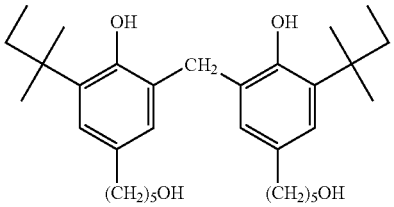
(RD1-13)
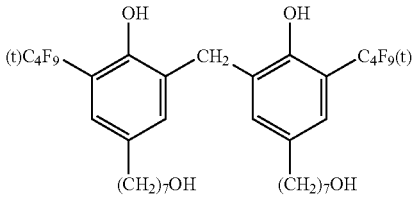
(RD1-14)
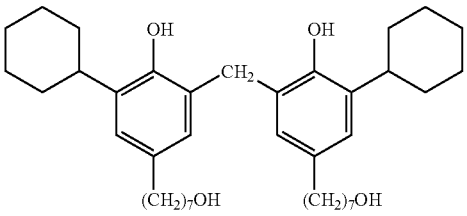
(RD1-15)
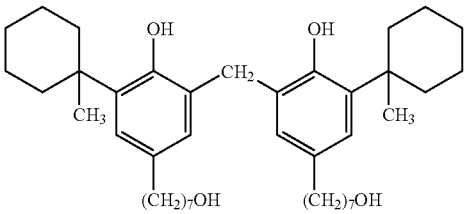
(RD1-16)
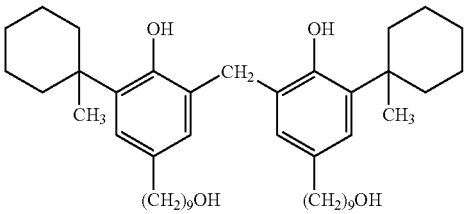
-continued
(RD1-17)
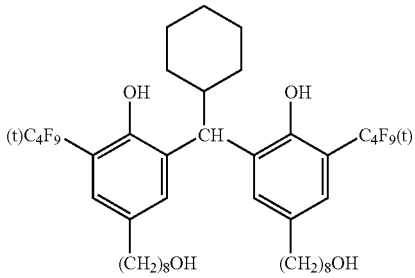
(RD1-18)
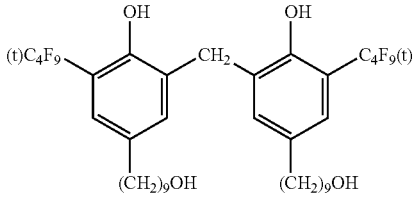
(RD1-19)
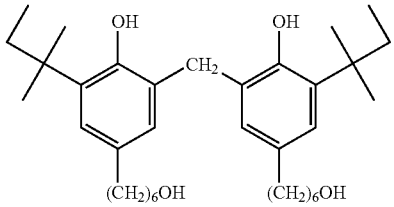
(RD1-20)
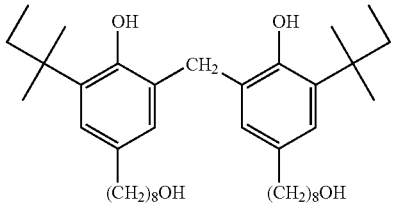
(RD1-21)
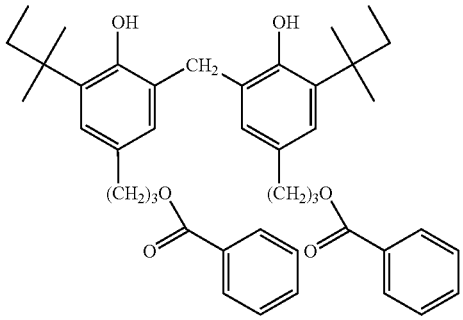
(RD1-22)
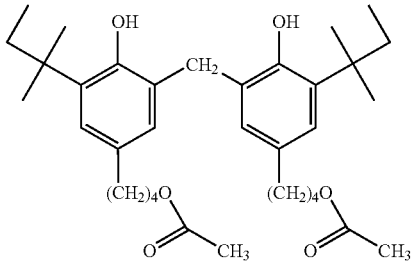

-continued
(RD1-23)
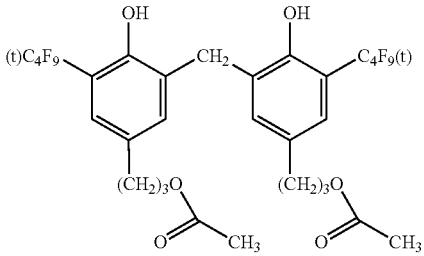
(RD1-24)
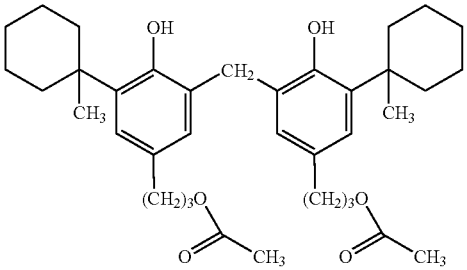
(RD1-25)
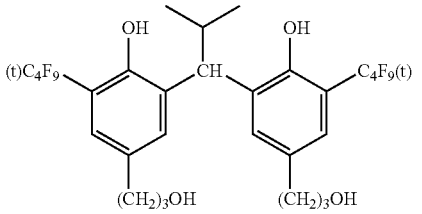
(RD1-26)
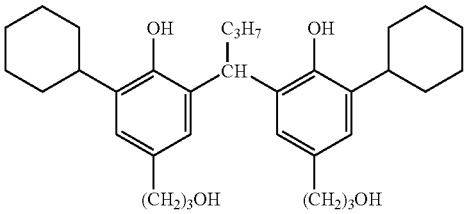
(RD1-27)
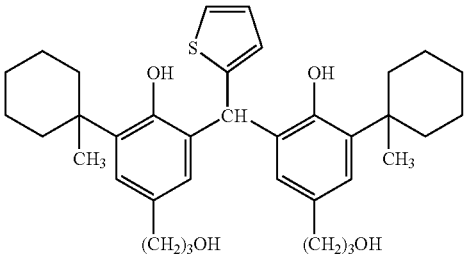
(RD1-28)
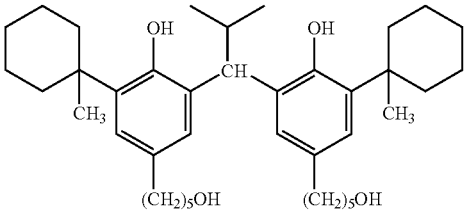
-continued
(RD1-29)
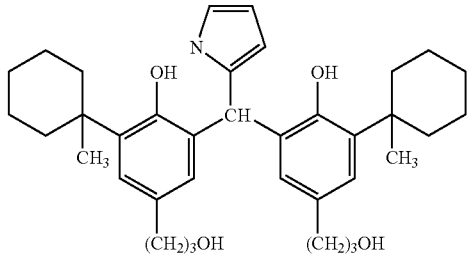
(RD1-30)
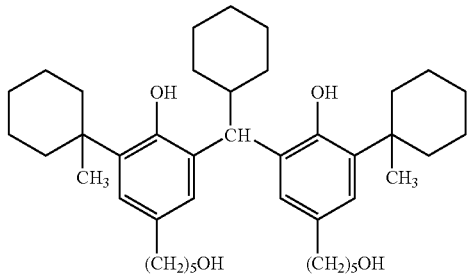
(RD1-31)
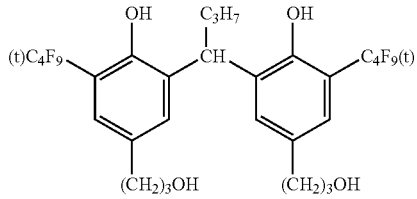
(RD1-32)
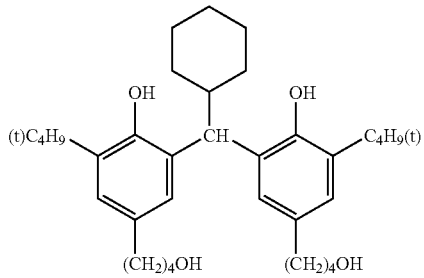
(RD1-33)
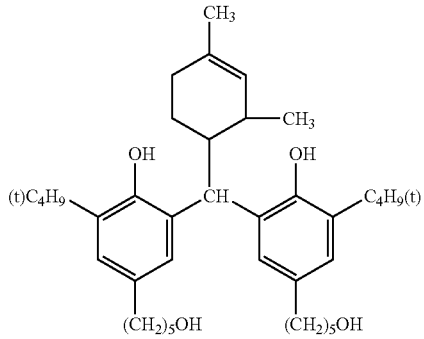
(RD1-34)
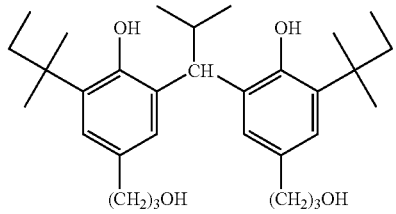

-continued
(RD1-35)
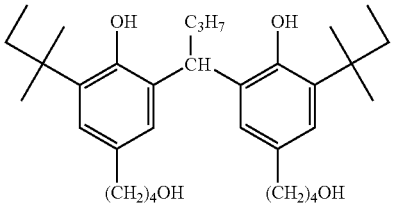
(RD1-36)
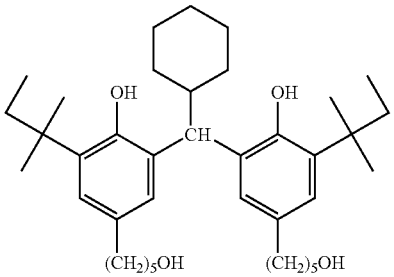
(RD1-37)
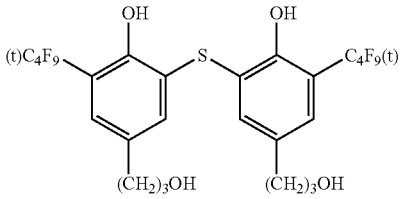
(RD1-38)
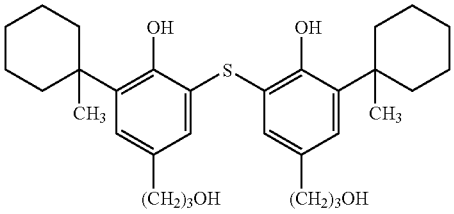
(RD1-39)
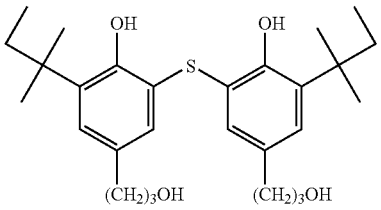
(RD1-40)
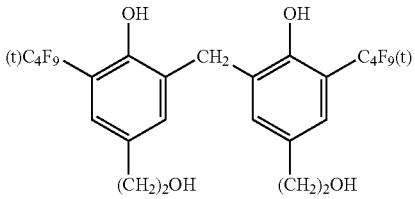
(RD1-41)
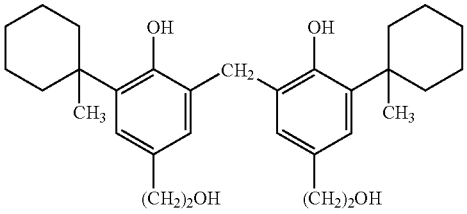
-continued
(RD1-42)
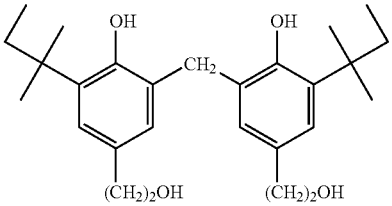
(RD1-43)
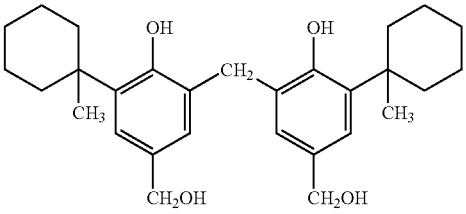
(RD1-44)
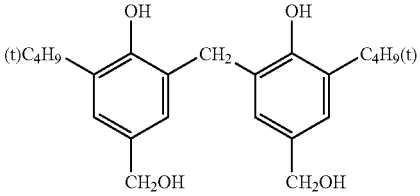
(RD1-45)
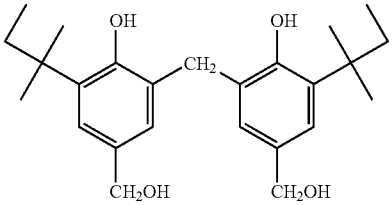
(RD1-46)
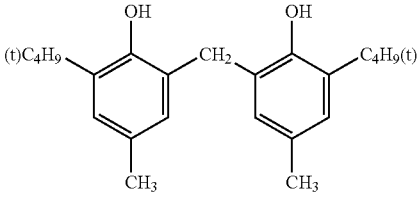
(RD1-47)
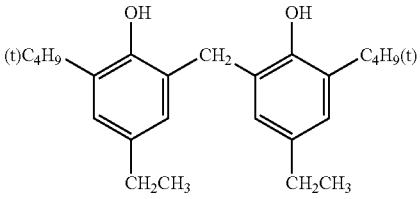
(RD1-48)
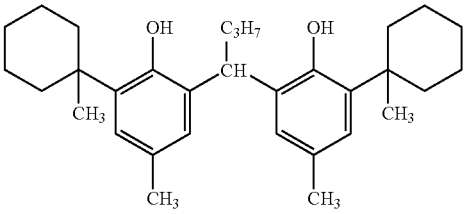

-continued
(RD2-1)
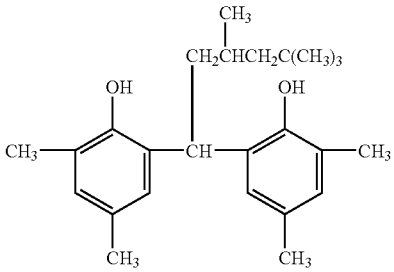
(RD2-2)
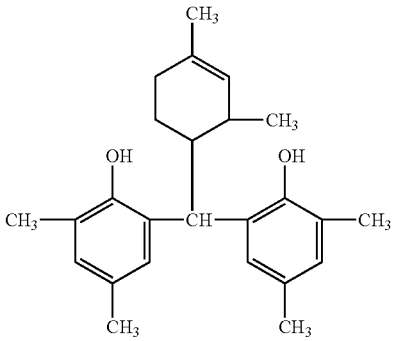
(RD2-3)
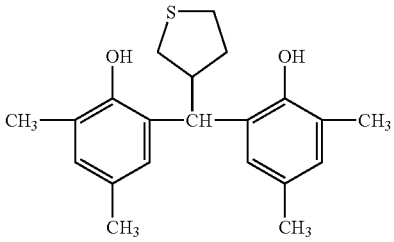
(RD2-4)
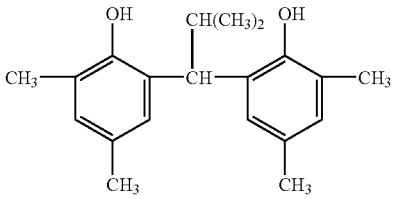
(RD2-5)
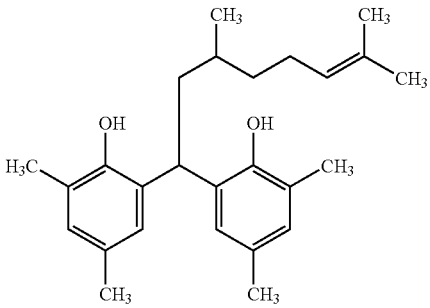
-continued
(RD2-6)
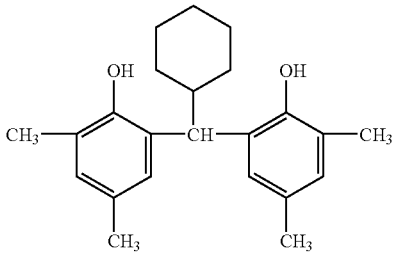
(RD2-7)
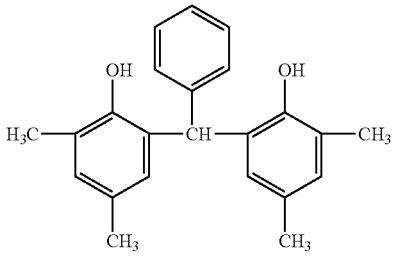
(RD2-8)
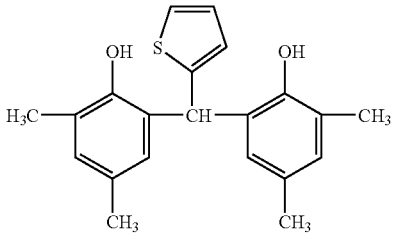
(RD2-9)
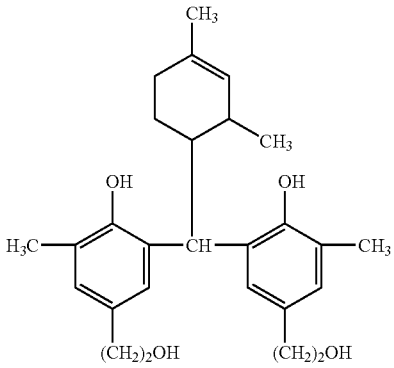
(RD2-10)
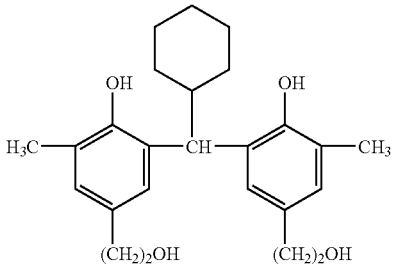
Bisphenol compounds of formula (RD1) ox (RD2) can readily be synthesized according to conventionally known methods.
Examples of reducing agents which are usable in combination with the reducing agent described above are described in U.S. Pat. Nos. 3,770,448, 3,773,512, and 3,593,863; RD 17029 and 29963; JP-A Nos. 11-119372 and 2002-62616.

Reducing agents including the compounds of formula (RD1) are incorporated preferably in an amount of $1\times10^{-2}$ to 10 mol per mol of silver, and more preferably $1\times10^{-2}$ to 1.5 mol.

Image Color

The color tone of images obtained by thermal development of the imaging material is described.

It has been pointed out that in regard to the output image tone for medical diagnosis, cold image tone tends to result in more accurate diagnostic observation of radiographs. The cold image tone, as described herein, refers to pure black tone or blue black tone in which black images are tinted to blue. On the other hand, warm image tone refers to warm black tone in which black images are tinted to brown.

The tone is more described below based on an expression defined by a method recommended by the Commission Internationale de l'Eclairage (CIE) in order to define more quantitatively.

"Colder tone" as well as "warmer tone", which is terminology of image tone, is expressed, employing minimum density $D_{min}$ and hue angle $h_{ab}$ at an optical density D of 1.0. The hue angle $h_{ab}$ is obtained by the following formula, utilizing color specifications a* and b* of L*a*b* Color Space which is a color space perceptively having approximately a uniform rate, recommended by Commission Internationale de l'Eclairage (CIE) in 1976.

$$h_{ab}=\tan^{-1}(b^*/a^*)$$

In the invention, $h_{ab}$ is preferably in the range of 180 degrees<$h_{ab}$<270 degrees, is more preferably in the range of 200 degrees<$h_{ab}$<270 degrees, and is most preferably in the range of 220 degrees<$h_{ab}$<260 degrees.

This finding is also disclosed in JP-A 2002-6463.

Incidentally, as described, for example, in JP-A No. 2000-29164, it is conventionally known that diagnostic images with visually preferred color tone are obtained by adjusting, to the specified values, u* and v* or a* and b* in CIE 1976 (L*u*v*) color space or (L*a*b*) color space near an optical density of 1.0.

Extensive investigation was performed for the silver salt photothermographic material according to the present invention. As a result, it was discovered that when a linear regression line was formed on a graph in which in the CIE 1976 (L*u*v*) color space or the (L*a*b*) color space, u* or a* was used as the abscissa and v* or b* was used as the ordinate, the aforesaid material exhibited diagnostic properties which were equal to or better than conventional wet type silver salt photosensitive materials by regulating the resulting linear regression line to the specified range. The condition ranges of the present invention will now be described.

(1) It is preferable that the coefficient of determination value $R^2$ of the linear regression line, which is made by arranging u* and v* in terms of each of the optical densities of 0.5, 1.0, and 1.5 and the minimum optical density, is also from 0.998 to 1.000.

The value v* of the intersection point of the aforesaid linear regression line with the ordinate is from −5 to +5; and gradient (v*/u*) is from 0.7 to 2.5.

(2) The coefficient of determination value $R^2$ of the linear regression line is from 0.998 to 1.000, which is formed in such a manner that each of optical density of 0.5, 1.0, and 1.5 and the minimum optical density of the aforesaid imaging material is measured, and a* and b* in terms of each of the above optical densities are arranged in two-dimensional coordinates in which a* is used as the abscissa of the CIE 1976 (L*a*b*) color space, while b* is used as the ordinate of the same. In addition, value b* of the intersection point of the aforesaid linear regression line with the ordinate is from −5 to +5, while gradient (b*/a*) is from 0.7 to 2.5.

A method for making the above-mentioned linear regression line, namely one example of a method for determining u* and v* as well as a* and b* in the CIE 1976 color space, will now be described.

By employing a thermal development apparatus, a 4-step wedge sample including an unexposed portion and optical densities of 0.5, 1.0, and 1.5 is prepared. Each of the wedge density portions prepared as above is determined employing a spectral chronometer (for example, CM-3600d, manufactured by Minolta Co., Ltd.) and either u* and v* or a* and b* are calculated. Measurement conditions are such that an F7 light source is used as a light source, the visual field angle is 10 degrees, and the transmission measurement mode is used. Subsequently, either measured u* and v* or measured a* and b* are plotted on the graph in which u* or a* is used as the abscissa, while v* or b* is used as the ordinate, and a linear regression line is formed, whereby the coefficient of determination value $R^2$ as well as intersection points and gradients are determined.

The specific method enabling to obtain a linear regression line having the above-described characteristics will be described below. In the invention, by regulating the added amount of the reducing agents (developing agents), silver halide grains, and aliphatic carboxylic acid silver, which are directly or indirectly involved in the development reaction process, it is possible to optimize the shape of developed silver so as to result in the desired tone. For example, when the developed silver is shaped to dendrite, the resulting image tends to be bluish, while when shaped to filament, the resulting imager tends to be yellowish. Namely, it is possible to adjust the image tone taking into account the properties of shape of developed silver.

Usually, image toning agents such as phthalazinone or a combinations of phthalazine with phthalic acids, or phthalic anhydride are employed. Examples of suitable image toning agents are disclosed in Research Disclosure, Item 17029, and U.S. Pat. Nos. 4,123,282, 3,994,732, 3,846,136, and 4,021,249.

In the invention, when rapid processing was performed using a compact laser image having a cooling section of a short length, it was proved that silver image tone was greatly different from preferable color. To overcome such a problem, conventional toning agents were insufficient and there were needed compounds capable of performing imagewise dye formation upon thermal development to form a dye image (e.g., leuco dyes or coupler compounds). As such a compound is preferable one capable of forming a dye image exhibiting an absorption peak at a wavelength of 360 to 450 nm upon thermal development or one capable of forming a dye image exhibiting an absorption peak at a wavelength of 600 to 700 nm upon thermal development. It is specifically preferred to contain both compounds to achieve superior image tone. Thus, it is preferable to control color tone employing couplers disclosed in JP-A No. 11-288057 and EP 1134611A2 as well as leuco dyes detailed below.

Leuco Dye

The photothermographic material relating to the invention can employ leuco dyes to control image tone, as described above. Leuco dyes are employed in the silver salt photothermographic materials relating to the invention. There may be employed, as leuco dyes, any of the colorless or slightly tinted compounds which are oxidized to form a colored state when heated at temperatures of about 80 to about 200° C. for about 0.5 to about 30 seconds. It is possible to use any of the leuco dyes which are oxidized by silver ions to form dyes. Compounds are useful which are sensitive to pH and are oxidizable to a colored state.

Representative leuco dyes suitable for the use in the present invention are not particularly limited. Examples include bisphenol leuco dyes, phenol leuco dyes, indoaniline leuco dyes, acrylated azine leuco dyes, phenoxazine leuco dyes, phenodiazine leuco dyes, and phenothiazine leuco dyes. Further, other useful leuco (dyes are these disclosed in U.S. Pat. Nos. 3,445,234, 3,846,136, 3,994,732, 4,021,249, 4,021,250, 4,022,617, 4,123,282, 4,368,247, and 4,461,681, as well as JP-A Nos. 50-36110, 59-206831, 5-204087, 11-231460, 2002-169249, and 2002-236334.

In order to control images to specified color tones, it is preferable that various color leuco dyes are employed individually or in combinations of a plurality of types. In the present invention, for minimizing excessive yellowish color tone due to the use of highly active reducing agents, as well as excessive reddish images especially at a density of at least 2.0 due to the use of minute silver halide grains, it is preferable to employ leuco dyes which change to cyan. Further, in order to achieve precise adjustment of color tone, it is further preferable to simultaneously use yellow leuco dyes and other leuco dyes which change to cyan.

It is preferable to appropriately control the density of the resulting color while taking into account the relationship with the color tone of developed silver itself. In the invention, dye formation is performed so as to have a reflection density of 0.01 to 0.05 or a transmission density of 0.005 to 0.50, and the image tone is adjusted so as to form images exhibiting tone falling within the foregoing tone range. In the present invention, color formation is performed so that the sum of maximum densities at the maximum adsorption wavelengths of dye images formed by leuco dyes is customarily 0.01 to 0.50, is preferably 0.02 to 0.30, and is most preferably 0.03 to 0.10. Further, it is preferable that images be controlled within the preferred color tone range described below.

Yellow Dye Forming Leuco Dye

In the invention, particularly preferably employed as yellow forming leuco dyes are color image forming agents represented by the following formula (YA) which increase absorbance between 360 and 450 nm via oxidation:

formula (YA)

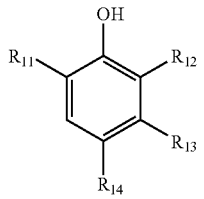

wherein $R_{11}$ is a substituted or unsubstituted alkyl group; $R_{12}$ is a hydrogen atom or a substituted or unsubstituted alkyl or acyl group, provided that $R_{11}$ and $R_{12}$ are not 2-hydroxyphenylmethyl; $R_{13}$ is a hydrogen atom or a substituted or unsubstituted alkyl group; $R_{14}$ is a group capable of being substituted on a benzene ring.

The compounds represented by formula (YA) will now be detailed. In the Formula (YA), $R_{11}$ is a substituted no unsubstituted alkyl group, provided that when $R_{12}$ is a substituent other than a hydrogen atom, $R_{11}$ is an alkyl group. In the foregoing formula (YA), the alkyl groups represented by $R_1$ are preferably those having 1 to 30 carbon atoms, which may have a substituent. Specifically preferred is methyl, ethyl, butyl, octyl, i-propyl, t-butyl, t-octyl, t-pentyl, sec-butyl, cyclohexyl, or 1-methyl-cyclohexyl. Groups (i-propyl, i-nonyl, t-butyl, t-amyl, t-octyl, cyclohexyl, 1-methyl-cyclohexyl or adamantyl) which are three-dimensionally larger than i-propyl are preferred. Of these, preferred are secondary or tertiary alkyl groups and t-butyl, t-octyl, and t-pentyl, which are tertiary alkyl groups, are particularly preferred. Examples of substituents which $R_1$ may have include a halogen atom, an aryl group, an alkoxy group, an amino group, an acyl group, an acylamino group, an alkylthio group, an arylthio group, a sulfonamide group, an acyloxy group, an oxycarbonyl group, a carbamoyl group, a sulfamoyl group, a sulfonyl group, and a phosphoryl group.

$R_{12}$ represents a hydrogen atom, a substituted or unsubstituted alkyl group, or an acylamino group. The alkyl group represented by $R_2$ is preferably one having 1-30 carbon atoms, while the acylamino group is preferably one having 1-30 carbon atoms. Of these, description for the alkyl group is the same as for aforesaid $R_{11}$.

The acylamino group represented by $R_2$ may be unsubstituted or have a substituent. Specific examples thereof include an acetylamino group, an alkoxyacetylamino group, and an aryloxyacetylamino group. $R_{12}$ is preferably a hydrogen atom or an unsubstituted group having 1 to 24 carbon atoms, and specifically listed are methyl, i-propyl, and t-butyl. Further, neither $R_1$ nor $R_2$ is a 2-hydroxyphenylmethyl group.

$R_{13}$ represents a hydrogen atom, and a substituted or unsubstituted alkyl group. Preferred as alkyl groups are those having 1 to 30 carbon atoms. Description for the above alkyl groups is the same as for $R_{11}$. Preferred as $R_{13}$ are a hydrogen atom and an unsubstituted alkyl group having 1 to 24 carbon atoms, and specifically listed are methyl, i-propyl and t-butyl. It is preferable that either $R_{12}$ or $R_{13}$ represents a hydrogen atom.

$R_{14}$ represents a group capable of being substituted to a benzene ring, and represents the same group as described for substituent $R_4$, for example, in aforesaid Formula (RED). $R_4$ is preferably a substituted or unsubstituted alkyl group having 1 to 30 carbon atoms, as well as an oxycarbonyl group having 2 to 30 carbon atoms. The alkyl group having 1 to 24 carbon atoms is more preferred. As substituents of the alkyl group are cited an aryl group, an amino group, an alkoxy group, an oxycarbonyl group, an acylamino group, an acyloxy group, an imido group, and a ureido group. Of these, more preferred are an aryl group, an amino group, an oxycarbonyl group, and an alkoxy group. The substituent of the alkyl group may be substituted with any of the above alkyl groups.

Among the compounds represented by the foregoing formula (YA), preferred compounds are bis-phenol compounds represented by the following formula (YB):

formula (YB)

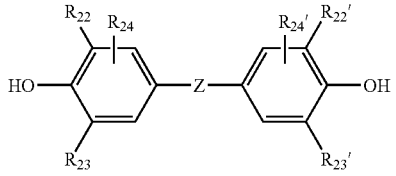

wherein, Z represents a —S— or —C($R_{21}$)($R_{21'}$)— group. $R_{21}$ and $R_{21'}$ each represent a hydrogen atom or a substituent. The substituents represented by $R_{21}$ and $R_{21'}$ are the same substituents listed for $R_{21}$ in the aforementioned Formula (RED). $R_{21}$ and $R_{21'}$ are preferably a hydrogen atom or an alkyl group.

$R_{22}$, $R_{23}$, $R_{22}'$ and $R_{23}'$ each represent a substituent. The substituents represented by $R_{22}$, $R_{23}$, $R_{22}'$ and $R_{23}'$ are the same substituents listed for $R_2$ and $R_3$ in the afore-mentioned formula (1) $R_{22}$, $R_{23}$, $R_{22}'$ and $R_{23}'$ are preferably, an alkyl group, an alkenyl group, an alkynyl group, an aryl group, a heterocyclic group, and more preferably, an alkyl group. Substituents on the alkyl group are the same substituents listed for the substituents in the aforementioned Formula (RD1). $R_{22}$, $R_{23}$, $R_{22}'$ and $R_{23}'$ are more preferably tertiary alkyl groups such as t-butyl, t-amino, t-octyl and 1-methyl-cyclohexyl.

$R_{24}$ and $R_{24'}$ each represent a hydrogen atom or a substituent, and the substituents are the same substituents listed for $R_4$ in the afore-mentioned formula (RD1).

Examples of the bis-phenol compounds represented by the formulas (YA) and (YB) are, the compounds disclosed in JP-A No. 2002-169249, Compounds (II-1) to (II-40), paragraph Nos. [0032]-[0038]; and EP 1211093, Compounds (ITS-1) to (ITS-12), paragraph No. [0026].

Specific examples of bisphenol compounds represented by formulas (YA) and (YB) are shown below.

(YA-1)

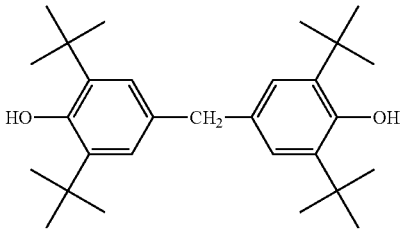

(YA-2)

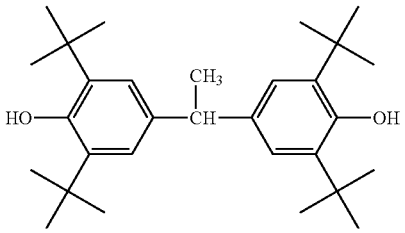

(YA-3)

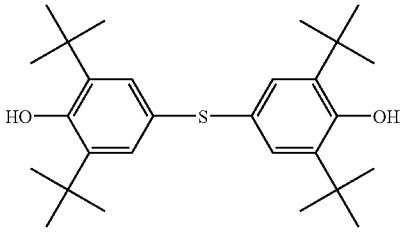

(YA-4)

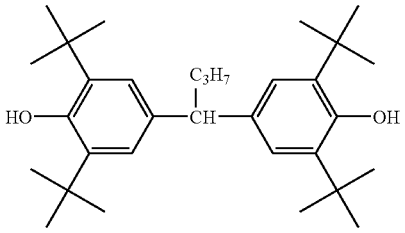

-continued (YA-5)

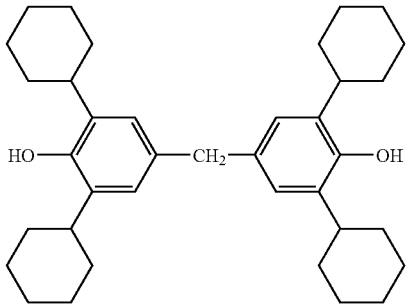

(YA-6)

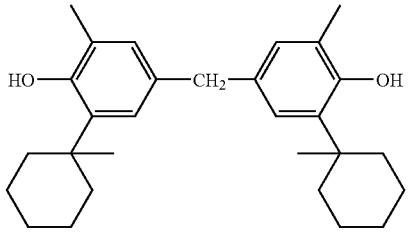

(YA-7)

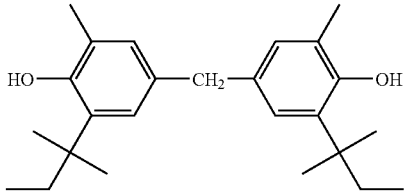

(YA-8)

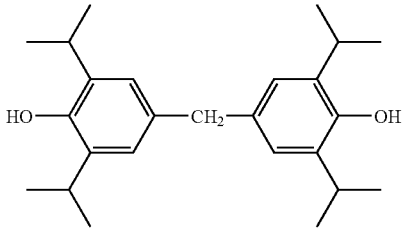

(YA-9)

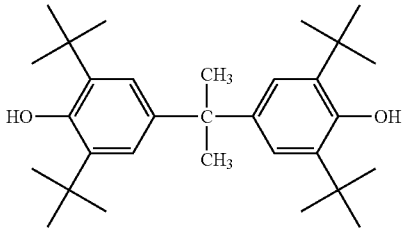

(YA-10)

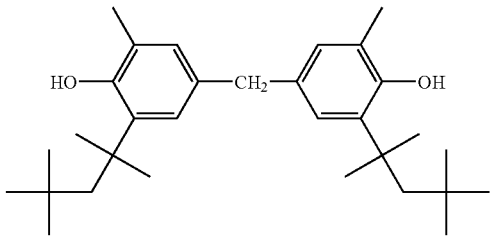

-continued (YA-11)

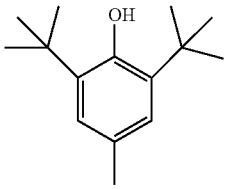

(YA-12)

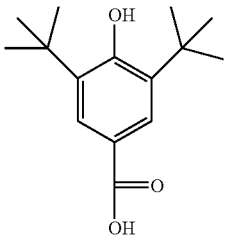

(YA-13)

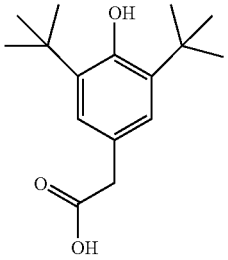

(YA-14)

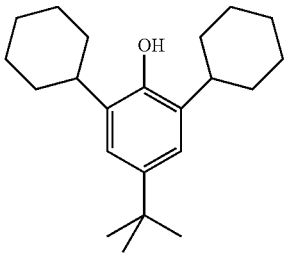

(YA-15)

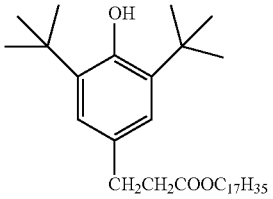

The amount of an incorporated compound represented by formula (YA), which is hindered phenol compound and includes compound of formula (YB), is usually, 0.00001 to 0.01 mol, and preferably, 0.0005 to 0.01 mol, and more preferably, 0.001 to 0.008 mol per mol of Ag.

A yellow dye forming leuco dye is incorporated preferably in a molar ration of 0.0001 to 0.2, and more preferably 0.005 to 0.1, based on the total amount of reducing agents of formulas (RD1) and (RD2). In the photothermographic material of the invention, the sum of the maximum density at the wavelength of maximum absorption of the dye image formed of at yellow dye-forming leuco dye is preferably from 0.01. to 0.50, more preferably from 0.02 to 0.30, and still more preferably from 0.05 to 0.10.

Cyan Dye Forming Leuco Dye

Besides the foregoing yellow dye forming leuco dyes, cyan dye forming leuco dyes are also usable in a photothermographic material to control image tone.

Cyan dye forming leuco dyes will be described hereinafter. A leuco dye is preferably a colorless or slightly colored compound which is capable of forming color upon oxidation when heated at 80 to 200° C. for 5 to 30 sec. There is also usable any leuco dye capable of forming a dye upon oxidation by silver ions. A compound which is sensitive to pH and being oxidized to a colored form.

Cyan dye forming leuco dyes will now be described. In the present invention, particularly preferably employed as cyan forming leuco dyes are color image forming agents which increase absorbance between 600 and 700 nm via oxidation, and include the compounds described in JP-A No. 59-206831 (particularly, compounds of λmax in the range of 600 to 700 nm), compounds represented by formulas (I) through (IV) of JP-A No. 5-204087 (specifically, compounds (1) through (18) described in paragraphs [0032] through [0037]), and compounds represented by formulas 4-7 (specifically, compound Nos. 1 through 79 described in paragraph [0105]) of JP-A No. 11-231460.

Specific examples of a cyan dye forming leuco dye are shown below, but are by no means limited to these.

(CLA-1)

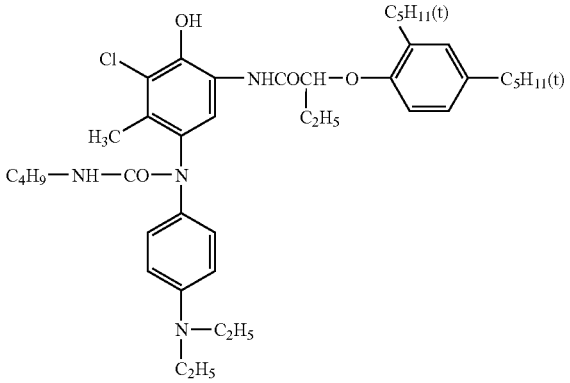

(CLA-2)

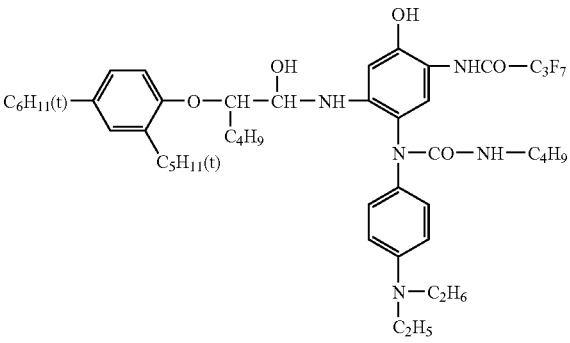

-continued
(CLA-3)
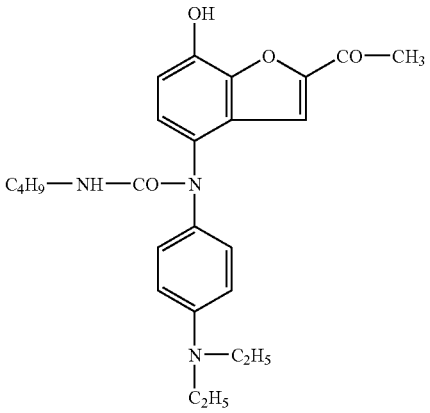
(CLA-4)
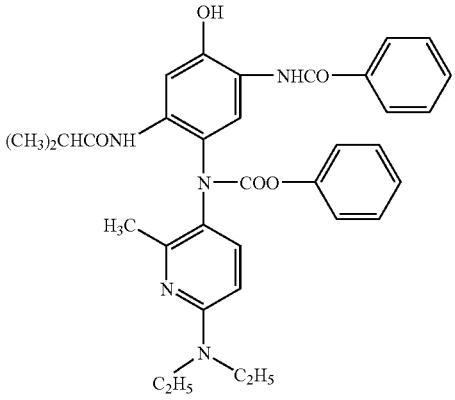
(CLA-5)
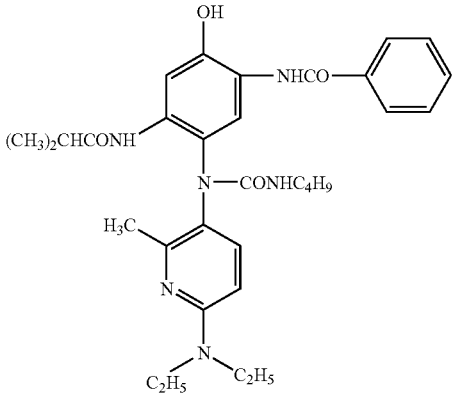
-continued
(CLB-1)
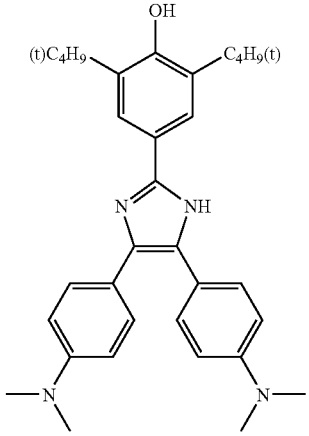
(CLB-2)
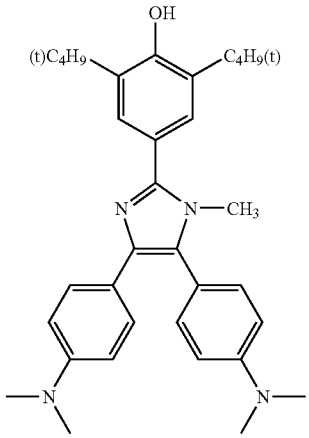
(CLB-3)
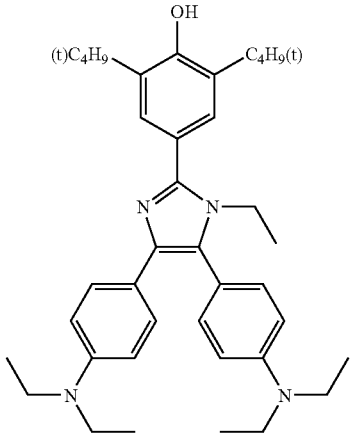

-continued (CLB-4)

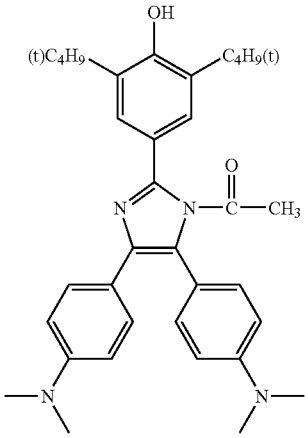

(CLB-5)

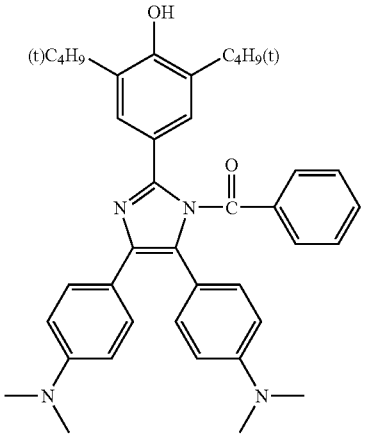

(CLB-6)

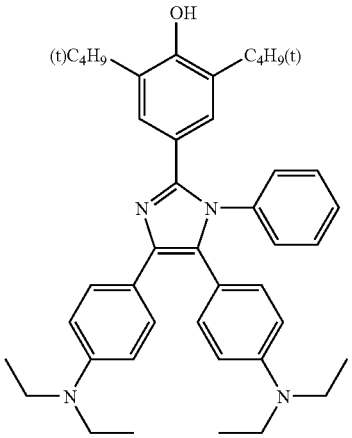

-continued (CLB-7)

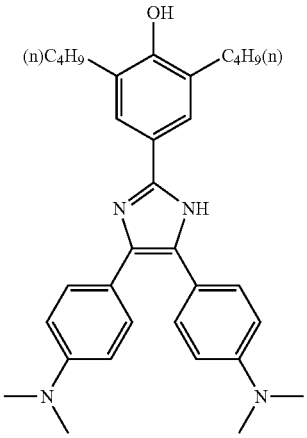

(CLB-8)

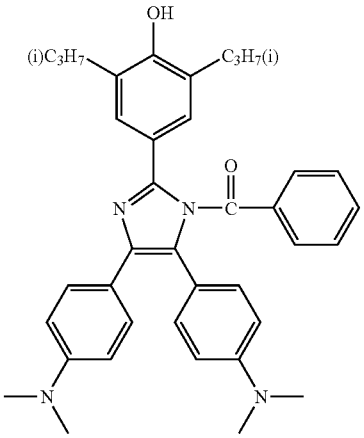

(CLB-9)

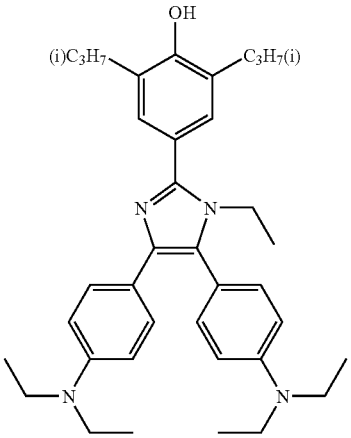

The addition amount of cyan forming leuco dyes is usually 0.00001 to 0.05 mol/mol of Ag, preferably 0.0005 to 0.02 mol/mol, and more preferably 0.001 to 0.01 mol. A cyan forming leuco dye is incorporated preferably in a molar ratio of 0.00001 to 0.2, and more preferably 0.005 to 0.1, based on the total amount of reducing agents of formulas (1) and (2). The cyan dye is preferably formed so that the sum of the maximum density at the absorption maximum of a color image formed by a cyan forming leuco dye is preferably 0.01 to 0.50, more preferably 0.02 to 0.30, and still more preferably 0.03 to 0.10.

In addition to the foregoing cyan forming leuco dye, magenta color forming leuco dyes or yellow color forming leuco dyes may be used to control delicate color tone.

The compounds represented by the foregoing formulas (YA) and (YB) and cyan forming leuco dyes may be added employing the same method as for the reducing agents represented by the foregoing formula (RD1). They may be incorporated into liquid coating compositions employing an optional method to result in a solution form, an emulsified dispersion form, or a minute solid particle dispersion form, and then incorporated in a photosensitive material.

It is preferable to incorporate the compounds represented by formulas (RD1) and (RD2), formulas (YA) and (YB), and cyan forming leuco dyes into an light-sensitive layer containing organic silver salts. On the other hand, the former may be incorporated in the light-sensitive layer, while the latter may be incorporated in a non-light-sensitive layer adjacent to the aforesaid light-sensitive layer. Alternatively, may be incorporated in the non-light-sensitive layer. Further, when the light-sensitive layer is comprised of a plurality of layers, incorporation may be performed for each of the layers.

The photothermographic material of the invention may contain a binder in the light-sensitive layer or the light-insensitive layer.

Suitable binders for the silver salt photothermographic material are to be transparent or translucent and commonly colorless, and include natural polymers, synthetic resin polymers and copolymers, as well as media to form film, for example, those described in paragraph [0069] of JP-A No. 2001-330918. Preferable binders for the light-sensitive layer of the photothermographic material of the invention are poly (vinyl acetals), and a particularly preferable binder is poly (vinyl butyral), which will be detailed hereunder.

Polymers such as cellulose esters, especially polymers such as triacetyl cellulose, cellulose acetate butyrate, which exhibit higher softening temperature, are preferable for an over-coating layer as well as an undercoating layer, specifically for a light-insensitive layer such as a protective layer and a backing layer. Incidentally, if desired, the binders may be employed in combination of at least two types.

The binder preferably introduces at least a polar group chosen from —COOM, —$SO_3M$, —$OSO_3M$, —P═O$(OM)_2$, —O—P═O$(OM)_2$, —$N(R)_2$, —$N^+(R)_3$, (in which M is a hydrogen atom, an alkali metal base or a hydrocarbon group), epoxy group, —SH, and —CN in the stage of copolymerization or addition reaction. Of these, —$SO_3M$ or —$OSO_3M$ is preferred. The content of a polar group is in the range of $1\times10^{-8}$ to $1\times10^{-1}$, and preferably $1\times10^{-6}$ to $1\times10^{-2}$.

Such binders are employed in the range of a proportion in which the binders function effectively. Skilled persons in the art can easily determine the effective range. For example, preferred as the index for maintaining aliphatic carboxylic acid silver salts in a photosensitive layer is the proportion range of binders to aliphatic carboxylic acid silver salts of 15:1 to 1:2 and most preferably of 8:1 to 1:1. Namely, the binder amount in the photosensitive layer is preferably from 1.5 to 6 g/$m^2$, and when falling within this range inhibits an increase of density of the unexposed portion.

In the invention, it is preferable that thermal transition point temperature (Tg) is preferably from 70 to 105° C. Thermal transition point temperature (Tg) can be measured by a differential scanning calorimeter, in which the crossing point of the base line and a slope of the endothermic peak is defined as Tg.

The glass transition temperature (Tg) is determined employing the method, described in Brandlap et al., "Polymer Handbook", pages III-139 to III-179, 1965 (published by Wiley and Sons Co.). The Tg of the binder composed of copolymer resins is obtained based on the following formula:

$$Tg \text{ of the copolymer (in ° C.)} = v_1Tg_1 + v_2Tg_2 + \ldots + v_nTg_n$$

wherein $v_1$, $v_2$, . . . $v_n$ each represents the mass ratio of the monomer in the copolymer, and $Tg_1$, $Tg_2$, . . . $Tg_n$ each represents Tg (in ° C.) of the homopolymer which is prepared employing each monomer in the copolymer. The accuracy of Tg, calculated based on the formula calculation, is ±5° C.

The use of a binder exhibiting a Tg of 70 to 105° C. can achieve sufficient maximum density in the image formation.

Binders usable in the invention exhibit a Tg of 70 to 105° C., a number-average molecular weight of 1,000 to 1,000,000 (preferably 10,000 to 500,000) and a polymerization degree of 50 to 1,000. Polymer containing ethylenically unsaturated monomer as a constitution unit and its copolymer are those described in JP-A No. 2001-330918, paragraph [0069]. Of these, preferred examples thereof include methacrylic acid alkyl esters, methacrylic acid aryl esters, and styrenes. Polymer compounds containing an acetal group are preferred among polymer compounds. Of such polymer compounds containing an acetal group, polyvinyl acetal having an acetal structure is preferred, including, for example, polyvinyl acetal described in U.S. Pat. Nos. 2,358,836, 3,003,879 and 2,828,204; and British Patent No. 771,155. Further, The polymer compound containing an acetal group is also preferably a compound represented by formula (V) described in JP-A no. 2002-287299, paragraph [150].

There are usable in the invention commonly known, polyurethane resins, such as a polyester-polyurethane, polyether-polyurethane, polyether-polyester polyurethane, polycarbonate-polyurethane, polyester-polycarbonate polyurethane, or polycaprolactone-polyurethane. Polyurethane preferably contains at least one hydroxyl group at each of both ends of the molecule, i.e., at least two hydroxyl groups in total. The hydroxyl group cross-links polyisocyanate as a hardener to form a network structure so that it is preferred to contain as many hydroxyl groups as possible.

Specifically, a hydroxyl group existing at the end of the molecule exhibits enhanced reactivity with a hardener. Polyurethane contains preferably at least three (more preferably at least four) hydroxyl groups at the end of the molecule. When polyurethane is employed, the polyurethane preferably has a glass transition temperature of 70 to 105° C., a breakage elongation of 100 to 2,000 percent, and a breakage stress of 0.5 to 100 M/$mm^2$.

The foregoing polymeric compounds (or polymers) may be used singly or plural polymers may be blended.

The foregoing polymer is preferably used as a main binder in the light-sensitive layer. The main binder means that at least 50% by mass of the whole binder in the light-sensitive layer is accounted for by the foregoing polymer. Accordingly, other polymers may be blended within the range of less than 50% by mass of the whole binder. Such polymers are not specifically limited when using a solvent in which the main polymer is soluble. Preferred examples thereof include polyvinyl acetate, acryl resin and urethane resin.

The light-sensitive layer may contain an organic gelling agent. The organic gelling agent refers to a compound which provides its system a yield point when incorporated to organic liquid and having a function of disappearing or lowering fluidity.

In one preferred embodiment of the invention, a coating solution for the light-sensitive layer contains an aqueous-dispersed polymer latex. The aqueous-dispersed polymer latex accounts for preferably at least 50% by mass of the whole binder of the coating solution. The polymer latex preferably accounts for at least 50% by mass of the whole binder of the light-sensitive layer, and more preferably at least 70% by mass. The polymer latex is a dispersion in which a water-insoluble hydrophobic polymer is in the form of minute particles dispersed in aqueous dispersing medium. The polymer may be dispersed in any form, such as being emulsified in the dispersing medium, being emulsion-polymerized, being dispersed in the form of micelles or a polymer partially having a hydrophilic structure in the molecule and its molecular chain being molecularly dispersed. The average size of dispersed particles is preferably 1 to 50,000 nm, and more preferably 5 to 1,000 nm. The particle size distribution of the dispersed particles is not specifically limited and may be one having a broad distribution or a monodisperse distribution.

Polymer latex usable in the invention may be not only conventional polymer latex having a uniform structure but also a so-called core/shell type latex. In this regard, core and shell differing in Tg, are occasionally preferred. The minimum film-forming temperature (MFT) of a polymer latex relating to the invention is preferably from −30 to 90° C., and more preferably 0 to 70° C. There may be added a film-forming aid to control the minimum film-forming temperature. The film-forming aid is also called a plasticizer and an organic compound (usually, organic solvent) which lowers the minimum film-forming temperature, as described in S. Muroi "Gosei Latex no Kagaku" (Chemistry of Synthetic Latex) Kobunshi Kankokai, 1970.

Polymer species used in polymer latex include, for example, acryl resin, vinyl acetate resin, polyester resin, polyurethane resin, rubber type resin, vinyl chloride resin, vinylidene chloride resin, polyolefin resin and their copolymers. The polymer may be a straight chained or branched polymer, or may be cross-linked. The polymer may be a hompolymer comprised of a single monomer or a copolymer comprised of at lest two monomers. Copolymer may be a random copolymer or a block copolymer. The polymer molecular weight is usually from 5,000 to 1,000,000, and preferably 10,000 to 100,000 in terms of number-average molecular weight. A molecular weight falling within the foregoing range results in compatibility of mechanical strength and film-forming capability.

The equilibrium moisture content of a polymer latex is preferably from 0.01% to 2% by mass at 25° C. and 60% RH (relative humidity), and more preferably 0.01% to 1%. The definition and measurement of the equilibrium moisture content is referred to, for example, "Kobunshi-Kogaku Koza 14, Kobunshi-Shilcenho" (edited by Kobunshi Gakkai, Chijin Shoin).

Specific examples of polymer latex include those described in JP-A No. 2002-287299, [0173]. These polymers may be used singly or in their combination as a blend. A carboxylic acid component as a polymer specie, such as an acrylate or methacrylate component, is contained preferably in an amount of 0.1 to 10% by mass.

A hydrophilic polymer such as gelatin, polyvinyl alcohol, methyl cellulose, hydroxypropyl cellulose, carboxymethyl cellulose, or hydroxypropyl cellulose may optionally be incorporated within the range of not more than 50% by mass of the whole binder. The hydrophilic polymer content is preferably not more than 30% by mass of the light-sensitive layer.

In the preparation of a coating solution for the light-sensitive layer, an organic silver salt and an aqueous-dispersed polymer latex may he added in any order. Thus, either one may be added at first or both nay be added simultaneously, but the polymer latex is added preferably later.

Before adding a polymer latex, an organic silver salt is added and then a reducing agent is preferably mixed. Aging a mixture of an organic silver salt and a polymer latex at an excessively low temperature results in deteriorated coated layer surface, and aging at an excessively high temperature leads to increased fogging. After mixing, the coating solution is aged preferably at a temperature of 30 to 65° C., more preferably 35 to 60° C., and still more preferably 35 to 55° C. To maintain such a temperature, a bath of a coating solution may be kept warm.

The coating solution for the light-sensitive layer, after mixing an organic silver salt and an aqueous-dispersed polymer latex, is coated preferably after 30 min. to 24 hr., more preferably after 60 min. to 10 hr., and still more preferably after 120 min. to 10 hr. The expression "after mixing" means that an organic silver salt and aqueous-dispersed polymer latex are added and additive materials have been homogeneously dispersed.

Cross-linking Agent

The light-sensitive layer may contain cross-linking agents capable of binding binder molecules through cross linking. It is known that employing cross-linking agents in the aforesaid binders minimizes uneven development, due to the improved adhesion of the layer to the support. In addition, it results in such effects that fogging during storage is minimized and the creation of printout silver after development is also minimized.

There may be employed, as cross-linking agents used in the invention, various conventional cross-linking agents, which have been employed for silver halide photosensitive photographic materials, such as aldehyde type, epoxy type, ethyleneimine type, vinylsulfone type, sulfonic acid ester type, acryloyl type, carbodiimide type, and silane compound type cross-linking agents, which are described in JP-A No. 50-96216. Of these, isocyanate type compounds, silane type compounds, epoxy type compounds and acid anhydride are preferred.

The aforesaid isocyanate based cross-linking agents are isocyanates having at least two isocyanate groups and adducts thereof. Specific examples thereof include aliphatic isocyanates, aliphatic isocyanates having a ring group, benzene diisocyanates, naphthalene diisocyanates, biphenyl isocyanates, diphenylmethane diisocyanates, triphenylmethane diisocyanates, triisocyanates, tetraisocyanates, and adducts of these isocyanates and adducts of these isocyanates with dihydric or trihydric alcohols. Employed as specific examples may be isocyanate compounds described on pages 10 through 12 of JP-A No. 56-5535.

Incidentally, adducts of an isocyanate with a polyalcohol are capable of markedly improving the adhesion between layers and further of markedly minimizing layer peeling, image dislocation, and air bubble formation. Such isocyanates may be incorporated in any portion of the silver salt photothermographic material. They may be incorporated in, for example, a support (particularly, when the support is paper, they may be incorporated in a sizing composition), and optional layers such as a photosensitive layer, a surface protective layer, an interlayer, an antihalation layer, and a subbing layer, all of which are place on the photosensitive layer side of the support, and may be incorporated in at least two of the layers.

Further, as thioisocyanate based cross-linking agents usable in the present invention, compounds having a thioisocyanate structure corresponding to the isocyanates are also useful as thioisocyanate based cross-linking agents usable in the present invention.

The amount of the cross-linking agents employed in the present invention is in the range of 0.001 to 2.000 mol per mol of silver, and is preferably in the range of 0.005 to 0.500 mol.

Isocyanate compounds as well as thioisocyanate compounds, which may be incorporated, in the present invention, are preferably those which function as the cross-linking agent. However, it is possible to obtain the desired results by employing compounds which have "v" of 0, namely compounds having only one functional group.

Examples of silane compounds which can be employed as a cross-linking agent in the invention are compounds represented by General formulas (1) to (3), described in JP-A No. 2001-264930.

Compounds, which can be used as a cross-linking agent, may be those having at least one epoxy group. The number of epoxy groups and corresponding molecular weight are not limited. It is preferable that the epoxy group be incorporated in the molecule as a glycidyl group via an ether bond or an imino bond. Further, the epoxy compound may be a monomer, an oligomer, or a polymer. The number of epoxy groups in the molecule is commonly from about 1 to about 10, and is preferably from 2 to 4. When the epoxy compound is a polymer, it may be either a homopolymer or a copolymer, and its number average molecular weight Mn is most preferably in the range of about 2,000 to about 20,000.

Acid anhydrides usable in the invention are compounds containing at least one acid anhydride group having a structure, as shown below:

—CO—O—CO—.

Any compound containing such at least one acid anhydride group is not limited with respect to the number of acid anhydride groups, molecular weight and others.

The foregoing epoxy compounds or acid anhydrides may be used singly or in combination. The addition amount is preferably $1\times10^{-6}$ to $1\times10^{-2}$ mol/m$^2$, and more preferably $1\times10^{-5}$ to $1\times10^{-3}$ mol/m$^2$. The epoxy compounds or acid anhydrides may be incorporated into any layer of the light-sensitive layer side, such as a light-sensitive layer, surface protective layer, an interlayer, an antihalation layer or a sublayer. The compounds may be incorporated into one or more of these layers.

Silver Saving Agent

A silver saving agent may be incorporated to the light-sensitive or light-insensitive layer. The silver saving agent refers to a compound which is capable of lessen a silver amount necessary to obtain a prescribed silver image density. Various mechanisms of working have been assumed with respect to function of lessening the silver count but a compound capable of enhancing covering power of developed silver is preferred. The covering power of developed silver refers to an optical density per unit amount of silver. Silver saving agents may be incorporated to a light-sensitive layer or a light-insensitive layer, or to both layers. Examples of a silver saving agent include a hydrazine derivative compound, a vinyl compound a phenol compound, a naphthol compound, a quaternary onium compound and a silane compound.

Specific examples of the hydrazine derivative include compounds H-1 through H-29 described in U.S. Pat. No. 5,545,505, col. 1-20; compounds 1 through 12 described in U.S. Pat. No, 5,464,738, col. 9-11; and compounds H 1-1 through H 1-28, H 2-1 through H 2-9, H 3-1 through H-3-12, H 4-1 through H 4-21, and H-5-1 through H-5-5, described in JP-A No. 2001-27790.

Specific examples of the vinyl compound include compounds CN-01 through CN-13, described in U.S. Pat. No. 5,545,515, col. 13-14; compounds HET-01 through HET-02, described in U.S. Pat. No. 5,635,339, col. 10; compounds M-4-01 through MA-07, described in U.S. Pat. No. 5,654,130, col. 9-10; compounds IS-01 through IS-04, described in U.S. Pat. No. 5,705,324, col. 9-10; and compounds 1-1 through 218-2, described in JP-A No. 2001-125224.

Specific examples of phenol and naphthol derivatives include compounds A-1 through A-89 described in JP-A No. 2000-267222, paragraph [0075]-[0078]!; compounds A-1 through A-258 described in JP-A No. 2003-66558, paragraph [0025]-[0045].

Specific examples of the onium compound include triphenyltetrazolium.

Specific examples of the silane compound include an alkoxysilane compounds having a primary or secondary amino group, e.,g., compounds A1 through A33, described in JP-A No. 2003-5324, paragraph [0027]-[0029].

A silver saving agent is contained in an amount of $1\times10^{-5}$ to 1 mol, preferably $1\times10^{-4}$ to $5\times10^{-1}$ mol per mol of organic silver salt.

Specific examples of a preferred silver saving agent are shown below, but are not limited to these.

(SE1-1)

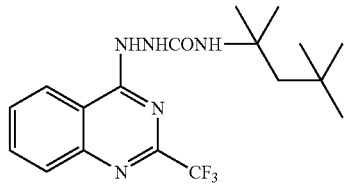

(SE1-2)

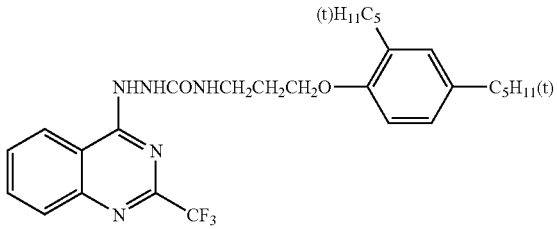

(SE1-3)

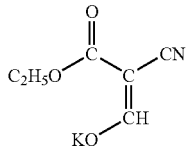

(SE1-4)

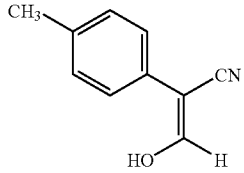

(SE1-5)

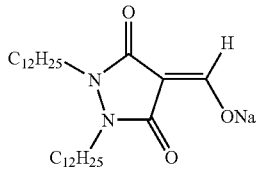

-continued (SE1-6)

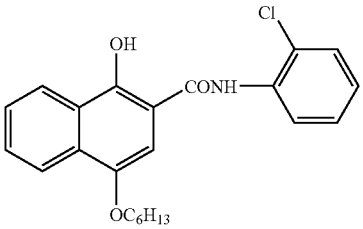

(SE1-7)

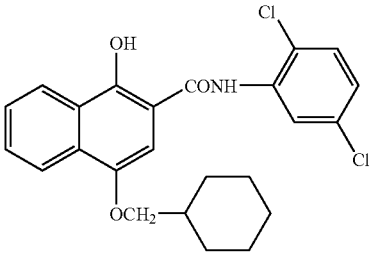

(SE1-8)

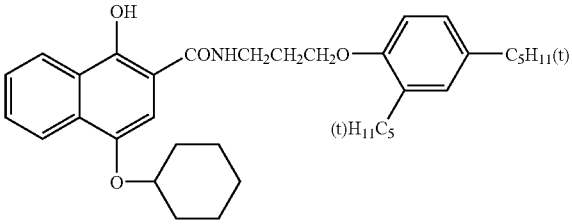

(SE1-9)

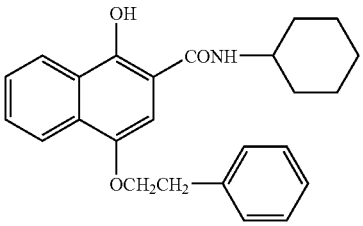

(SE1-10)

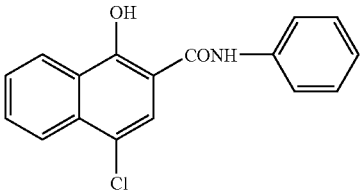

(SE1-11)

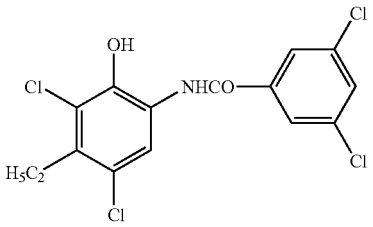

The photothermographic material of the invention preferably contains a thermal solvent. In the invention, the thermal solvent is defined as a material capable of lowering the thermal developing temperature of a thermal solvent-containing photothermographic material by at least 1° C. (preferably at least 2° C., and more preferably at least 3° C.), as compared to a photothermographic material containing no thermal solvent. For example, a density obtained by developing a photothermographic material (B) containing no thermal solvent at 120° C. for 20 sec., can be obtained by developing a photothermographic material (A) in which a thermal solvent is added to the photothermographic material (B), at a temperature of 119° C. or less for the period of the same time as the photothermographic material (B).

A thermal solvent contains a polar group and is preferably a compound represented by the following formula (TS):

$$(Y)_r Z \qquad \text{formula (TS)}$$

wherein Y is a group selected from an alkyl group, an alkenyl group, an alkynyl group, an aryl group or a heterocyclic group; Z is hydroxyl, carboxyl, an amino group, an amide group, a sulfonamido group, a phosphoric acid amide, cyano, imide, ureido, sulfonoxide, sulfone, phosphine, phosphine oxide and nitrogen-containing heterocyclic group; r is an integer of 1 to 3, provided that when Z is a mono-valent, r is 1 and when Z has a valence of two or more, r is the same as a valence number of Z, and when r is 2 or more, plural Ys may be the same or different.

Y may be substituted and examples of a substituent may be the same as represented by Z described above. In the formula (TS) Y is a straight, branched or cyclic alkyl group (preferably having 1-40 carbon atoms, more preferably 1-30, still more preferably 1-25 carbon atoms, e.g., methyl, ethyl, propyl, isopropyl, sec-butyl, tert-butyl, t-octyl, n-amyl, t-amyl, n-dodecyl, n-tridecyl, octadecyl, icosyl, docosyl, cyclopentyl, cyclohexyl), alkenyl group (preferably having 2-40 carbon atoms, more preferably 2-30, still more preferably 2-25 carbon atoms, e.g., vinyl, allyl, 2-butenyl, 3-pentenyl), aryl group (preferably having 6-40 carbon atoms, more preferably 6-30, still more preferably 6-25 carbon atoms, e.g., phenyl, p-methylphenyl, naphthyl), heterocyclic group preferably having 2-20 carbon atoms, more preferably 2-16, still more preferably 2-12 carbon atoms, e.g., pyridyl, pyrazyl, imidazolyl, pyrrolidyl). These substituents may be substituted and substituents may combine with each other to form a ring.

Y may be substituted and as examples of a substituent are cited those described in JP-A No. 2004-21068, paragraph [0015]. It is assumed, as the reason for the use of a thermal solvent activating development that the thermal solvent melts at a temperature near a developing temperature and solubilizes a material participating in development, rendering a reaction feasible at a temperature lower than the case containing no thermal solvent. Thermal development is a reduction reaction in which a carboxylic acid having a relatively high polarity or a silver ion carrier is involved. It is therefore preferred that a reaction field exhibiting an appropriate polarity is formed by a thermal solvent having a polar group.

The melting point of a thermal solvent is preferably 50 to 200° C., and more preferably 60 to 150° C. The melting point is preferably 100 to 150° C. specifically in a photothermographic material which places primary importance on stability to external environments, such as image fastness.

Specific examples of a thermal solvent include compounds described in JP-A No. 2004-21068, paragraph [0017] and compounds MF-1 through MF-3, MF-6, MF-7, MF-9 through MF-12 and MF-15 through MF-22.

A thermal solvent is contained preferably at 0.01 to 5.0 $g/m^2$, more preferably 0.05 to 2.5 $g/m^2$, and still more preferably 0.1 to 1.5 $g/m^2$. Thermal solvents may be contained singly or in combination thereof. A thermal solvent may be added to a coating solution in any form, such as a solution, emulsion or solid particle dispersion.

There is known a method in which a thermal solvent is dissolved using oil such as dibutyl phthalate, tricresyl phosphate, glyceryl triacetate or diethyl phthalate, and optionally an auxiliary solvent such as diethyl acetate or cyclohexanone, and is mechanically dispersed to obtain an emulsified dispersion.

Solid particle dispersion is prepared by dispersing powdery thermal solvent in an appropriate solvent such as water using a ball mill, a colloid mill, a vibration ball mill, a jet mill, a roller mill or a ultrasonic homogenizer. A protective colloid (e.g., polyvinyl alcohol), a surfactant (e.g., anionic surfactants such as sodium triisopropylnaphthalenesulfonate) may be used therein. In the foregoing mills, beads such as zirconia are usually used. Zr or the like is sometimes dissolved out and mixed in the dispersion within a range of 1 to 1,000 ppm, depending on dispersing conditions. A Zr content of 0.5 g or less per g of silver is acceptable to practical use. Aqueous dispersion preferably contains an antiseptic (e.g., benzoisothiazolinone sodium salt.)

Antifoggant and Image Stabilizer

Any component layer of the photothermographic material of the invention preferably contains an antifoggant to inhibit fogging caused before being thermally developed and an image stabilizer to prevent deterioration of images after being thermally developed.

Next, there will be described an antifoggant and an image stabilizer usable in the photothermographic material of the invention.

Since bisphenols and sulfonamidophenols which contain a proton are mainly employed as a reducing agent, incorporation of a compound which generates reactive species capable of abstracting hydrogen is preferred to deactivate the reducing agent. It is also preferred to include a compound capable of oxidizing silver atoms or metallic silver (silver cluster) generated during storage of raw film or images. Specific examples of a compound exhibiting such a function include biimidazolyl compounds and iodonium compounds. The foregoing biimidazolyl compounds or iodonium compound are incorporated preferably in an amount of 0.001 to 0.1 mol/$m^2$ and more preferably 0.005 to 0.05 mol/$m^2$.

In cases when a reducing agent used in the invention is a compound containing an aromatic hydroxyl group, specifically bisphenols it is preferred to use a non-reducible compound capable of forming a hydrogen bond with such a group, for example, compounds (II-1) to (II-40) described in JP-A No. 2002-90937, paragraphs [0061]-[0064].

A number of compounds capable of generating a halogen atom as reactive species are known as an antifoggant or an image stabilizer. Specific examples of a compound generating an active halogen atom include compounds of formula (9) described in JP-A No. 2002-287299, paragraphs [0264]-[0271]. These compounds are incorporated preferably at an amount within the range of an increase of printed-out silver formed of silver halide being ignorable. Thus, the ratio to a compound forming no active halogen radical is preferably at most 150%, more preferably at most 100% . Specific examples of a compound generating active halogen atom include compounds (III-1) to (III-23) described in paragraphs [0086]-[0087] of JP-A NO. 2002-169249; compounds 1-1a to 1-1o, and 1-2a to 1-2o described in paragraphs [0031] to [0034] and compounds 2a to 2z, 2aa to 2ll and 2-1a to 2-1f described in paragraphs [0050]-[0056] of JP-A No. 2003-50441; and compounds 4-1 to 4-32 described in paragraphs [0055] to [0058] and compounds 5-1 to 5-10 described in paragraph [0069] to [0072] of JP-A No. 2003-91054.

Examples of preferred antifoggants usable in the invention include compounds a to j described in [0012] of JP-A No. 8-314059, thiosufonate esters A to K described in [0028] of JP-A No. 7-209797, compounds (1) to (44) described on page 14 of JP-A No. 55-140833, compounds(I-1) to (I-6) described in [0063]and compounds (C-1) to (C-3) described in [0066] of JP-A No. 2001-13617, compounds (III-1) to (III-108) described in [0027] of JP-A No. 2002-90937, vinylsulfone and/or β-halosultone compounds VS-1 to VS-7 and HS-1 to HS-5 described in [0013] of JP-A No. 6-208192, sulfonylbenzotriazole compounds KS-1 to KS-8 described in JP-A No. 200-330235, substituted propenenitrile compounds PR-01 to PR-08 described in JP-A. No. 2000-515995 (published Japanese translation of PCT international publication for patent application) and compounds (1)-1 to (1)-132 described in [0042] to [0051] of JP-A No. 2002-207273. The foregoing antifoggant is used usually in an amount of at least 0.001 mol per mol of silver, preferably from 0.01 to 5 mol, and more preferably from 0.02 to 0.6 mol.

Compounds commonly known as other than the foregoing compounds may be contained in the photothermographic material of the invention, which may be a compound capable of forming a reactive species or a compound exhibiting a different mechanism of antifogging. Examples of such compounds include those described in U.S. Pat. Nos. 3,589,903, 4,546,075 and 4,452,885; JP-A No. 59-57234; U.S. Pat. Nos. 3,874,946 and 4,756,999; JP-A No. 59-57234, 9-188328 and 9-90550. Further, other antifoggants include, for example, compounds described in U.S. Pat. No. 5,028,523 and European Patent No. 600,587, 605,981 and 631,176.

Toning Agent

The photothermographic material of the invention forms a photographic image upon thermal development and preferably contains an image toning agent to control image color in the form of dispersion in an organic binder matrix.

Examples of suitable image toning agents are described in RD 17029, U.S. Pat. Nos. 4,123,282, 3,994,732 and 4,021,249. Specific examples include imides (e.g. succinimide phthalimide, naphthalimide, N-hydroxy-1,8-naphthalimide), mercaptans (e.g., 3-mercapto-1,24-triazole), phthalazinone derivatives and their metal salts (e.g., phthalazinone, 4-(1-naphthyl)phthalazinone, 6-chlorophthalazinone, 5,7-dimethyloxyphthalazinone, 2,3-dihydroxyl, 4-phthalazine-dione), combination of phthalazine and phthalic acids (e.g., phthalic acid, 4-methylphthalic acid, 4-nitrophthalic acid, tetrachlorophthalic acid); combination of phthalazine and a compound selected from maleic acid anhydride, phthalic acid, 2,3-naphthalenedicarboxylic acid and o-phenylene acid derivatives and their anhydrides (e.g., phthalic acid, 4-methylpthalic acid, 4-nitrophthalic acid, tetrachlorophthalic acid anhydride). Of these, a specifically preferred image toning agent is a combination of phthalazinone or phthalazine, and phthalic acids or phthalic acid anhydrides.

Radiation Absorption Compound

Various kinds of dyes and pigments known in the art are usable as radiation-absorbing compounds used in the layer provided on the light-sensitive layer side or the layer provided on the side opposite the light-sensitive layer. Such dyes and pigments include those described in Color Index, for example, pyrazoloazole dyes, anthraquinone dyes, azo dyes, azomethine dyes, oxonol dyes, carbocyanine dyes, styryl dyes, triphenylmethane dyes, indoaniline dyes, indophenol dyes, organic pigments such as phthalocyanine and inorganic pigments.

Examples of preferred dyes used in the invention include anthraquinone dyes (e.g., compounds 1-9 described in JP-A No. 5-341441, compounds 3-6 to 3-18 and 3-23 to 3-38 described in JP-A No. 5-165147), azomethine dyes (e.g., compounds 17-47, described in JP-A No. 5-289227), indoaniline dyes (e.g., compounds 11-19, described in JP-A No. 5-289227, compound 47 described in JP-A No. 5-341441, compounds 2-10 to 2-11, described in JP-A No. 5-165147), and azo dyes (e.g., compounds 10-16, described in JP-A No. 5-341441).

When the photothermographic material of the invention is applied as an image recording material using infrared light, for instance, squarylium dyes containing a thiopyrylium nucleus and squarylium dyes containing a pyrylium nucleus, thiopyrylium chroconium similar to squarylium dyes, and pyrylium chroconium dyes are preferable. A compound containing a squarylium nucleus means a compound containing 1-cyclobutene-hydroxy-4-one in the molecular structure, and a compound containing a chroconium nucleus means a 1-cyclopentene-2-hydroxy-4,5-dione contained in the molecular structure, in which the hydroxy group may be dissociated. Preferred examples of such dyes include compounds described in JP-A No. 8-201959, compound described in Japanese translation of PCT International Patent Application Publication No. 9-509503, and compounds AD-1 to AD-55 described in JP-A No. 2003-195450.

When the photothermographic material of the invention is employed as an image recording material using blue light, there are preferably used compounds Nos. 1-93 described in JP-A No. 2003-215751 and Dye-1 to Dye-51 described in JP-A No. 2005-157245.

These dyes or compounds described above can be incorporated by any means, for instance, in the form of a solution, emulsion or solid particle dispersion, or in a state mordanted by mordants. These dyes or compounds are used in amounts depending on the objective absorption amount, but preferably in the range from 1 μg to 1 g per $m^2$ of the photothermographic material.

In the photothermographic material of the invention, it is preferred that radiation-absorbing compounds (dyes or pigments) are contained in a layer provided on the light-sensitive layer side of the support, for example, a sublayer, light-sensitive layer, interlayer or protective layer (preferably, light-sensitive layer) and are set so as to have an absorbance of 0.40 to 0.90 (preferably, 0.50 to 0.80) at absorption wavelengths of the whole layers described above, and radiation-absorbing compounds (dyes or pigments) are contained in a layer provided on the opposite side of the support to the light-sensitive layer, for example, an antistatic sublayer, antihalation layer, or protective layer and are set so as to have an absorbance of 0.30 to 1.20, and preferably 0.40 to 1.00 at absorption wavelengths of the whole layers described above. An absorbance falling within the range described above can improve density variation caused along with image quality or humidity change, even when using resin lenses in an exposure system.

Support

Suitable supports used in the photothermographic imaging materials of the invention include various polymeric materials, glass, wool cloth, cotton cloth, paper, and metals (such as aluminum). Flexible sheets or roll-convertible one are preferred. Examples of preferred support used in the invention include plastic resin films such as cellulose acetate film, polyester film, polyethylene terephthalate film, polyethylene naphthalate film, polyamide film, polyimide film, cellulose triacetate film and polycarbonate film, and biaxially stretched polyethylene terephthalate (PET) film is specifically preferred. The support thickness is 50 to 300 μm, and preferably 70 to 180 μm.

To improve electrification properties of photothermographic imaging materials, metal oxides and/or conductive compounds such as conductive polymers may be incorporated into the constituent layer. These compounds may be incorporated into any layer and preferably into a sublayer, a backing layer, interlayer between the light sensitive layer and the sublayer. Conductive compounds described in U.S. Pat. No. 5,244,773, col. 14-20. Specifically, the surface protective layer of the backing layer side preferably contains conductive metal oxides.

The conductive metal oxide is crystalline metal oxide particles, and one which contains oxygen defects or one which contains a small amount of a heteroatom capable of forming a donor for the metal oxide, both exhibit enhanced conductivity and are preferred. The latter, which results in no fogging to a silver halide emulsion is preferred. Examples of metal oxide include ZnO, $TiO_2$, $SnO_2$, $Al_2O_3$, $In_2O_3$, $SiO_2$, MgO, BaO, $MoO_3$ and $V_2O_5$ and their combined oxides. Of these, ZnO, $TiO_2$ and $SnO_2$ are preferred. As an, example of containing a heteroatom, addition of Al or In to ZrO, addition of Sb, Nb, P or a halogen element to $SnO_2$, and addition of Nb or Ta to $TiO_2$ are effective. The heteroatom is added preferably in an amount of 0.01 to 30 mol %, and more preferably 0.1 10 mol %. To improve particel dispersibility and transparency, a silicon compound may be added in the course of particle preparation.

The metal oxide particles have electric, conductivity, exhibiting a volume resistance of $10^7$ Ω·cm or less and preferably $10^5$ Ω·cm or less. The foregoing metal oxide may be adhered to other crystalline metal oxide particles or fibrous material (such as titanium oxide), as described in JP-A Nos. 56-143431, 56-120519 and 58-62647 and JP-B No. 50-6235.

The particle size usable in the invention is preferably not more than 1 μm, and a particle size of not more than 0.5 μm results in enhanced stability after dispersion, rendering it easy to make use thereof. Employment of conductive particles of 0.3 μm or less enables to form a transparent photothermographic material. Needle-form or fibrous conductive metal oxide is preferably 30 μm or less in length and 1 μm or less in diameter, and more preferably 10 μm or less in length and 0.3 μm or less in diameter, in which the ratio of length to diameter is preferably 3 or more. $SnO_2$ is also commercially available from Ishihara Sangyo Co., Ltd., including SNS10M, SN-100P, SN-100D and FSS10M.

Constitution Layer

The photothermographic material of the invention is provided with at least one light-sensitive layer as a light-sensitive layer on the support. There may be provided an light-sensitive layer alone on the support but it is preferred to form at least one light-insensitive layer on the light-sensitive layer. For instance, a protective layer may be provided on the light-sensitive layer to protect the light-sensitive layer. Further, to prevent blocking between photothermographic materials or adhesion of the photothermographic material to a roll, a back-coat layer may be provided on the opposite side of the support.

A binder used in the protective layer or the back coat layer can be chosen preferably from polymers having a higher glass transition point (Tg) than a binder used in the light-sensitive layer and exhibiting resistance to abrasion or deformation, for example, cellulose acetate, cellulose butyrate or cellulose propionate.

To control gradation, at least two light-sensitive layers may be provided on one side of the support or at least one light-sensitive layer may be provided on both sides of the support.

When coating the light-sensitive layer side by using a slide coater, preferably, a subbing layer (slip later), a light-sensitive layer and a protective layer on the light-sensitive layer are provided preferably by simultaneous multilayer coating. A slip layer and a BC layer are provided on the BC layer side, preferably by simultaneous coating. A light-sensitive layer, a protective layer on the light-sensitive layer and a BC layer each may be constituted of plural layers. The slip layer is thinly formed by a layer containing an organic silver salt and a binder or a layer containing a binder. When a dry thickness of a slip layer of the light-sensitive layer side and a dry thickness of the light-sensitive layer are denoted as SA and SB, respectively, the ratio of SA/SB is preferably from 0.005 to 0.10, more preferably from 0.01 to 0.07, and still more preferably 0.02 to 0.06. The dry thickness of a slip layer of the light-sensitive layer side, SA is preferably from 0.1 to 1.0 μm, more preferably 0.2 to 0.7 μm, and still more preferably 0.3 to 0.6 μm. The ratio of Sc/Sd, in which Sc is a dry thickness of a slip layer of the BC layer side and Sd is a dry thickness of a BC layer, is preferably from 0.01 to 0.30, more preferably 0.05 to 0.25, and still more preferably 0.08 to 0.20. The dry thickness (Sd) of a slip layer of the BC layer side is preferably from 0.1 to 0.8 μm, more preferably 0.15 to 0.7 μm, and still more preferably 0.2 to 0.5 μm.

As a binder of the slip layer is preferably used a polyvinyl acetal resin, an acryl resin, a polyester resin, a polyurethane resin and a cellulose ester.

When simultaneously coating a slip layer and a light-sensitive layer, coating unevenness is markedly improved at a coating speed of the light-sensitive layer of not less than 25 m/min, and improvements are more marked at a coating speed of not less than 30 m/min and still more marked at a coating speed of not less than 35 m/min. A greater coating speed is preferred for productivity but the coating speed is usually not more than 300 m/min and a coating speed of not more than 200 n/min is preferred to maintain productivity. The slip layer may be an aqueous system or a solvent system using organic solvents. An aqueous system is preferred for the aqueous light-sensitive layer and an organic solvent system is preferred for a light-sensitive layer of an organic solvent system to perform simultaneous multilayer coating. When using an acryl resin or a polyurethane in the aqueous system, it is preferred to use a water-soluble acryl resin or polyurethane or in the form of a water-dispersible latex.

It is preferable to prepare the photothermographic material of the present invention as follows. Materials of each constitution layer as above are dissolved or dispersed in solvents to prepare coating compositions. Resultant coating compositions are subjected to simultaneous multilayer coating and subsequently, the resultant coating is subjected to a thermal treatment. "Simultaneous multilayer coating", as described herein, refers to the following. The coating composition of each constitution layer (for example, a photosensitive layer and a protective layer) is prepared. When the resultant coating compositions are applied onto a support, the coating compositions are not applied onto a support in such a manner that they are individually applied and subsequently dried, and the operation is repeated, but are simultaneously applied onto a support and subsequently dried. Namely, before the residual amount of the total solvents of the lower layer reaches 70 percent by weight, the upper layer is applied.

Simultaneous multilayer coating methods, which are applied to each constitution layer, are not particularly limited. For example, are employed methods, known in the art, such as a bar coater method, a curtain coating method, a dipping method, an air knife method, a hopper coating method, and an extrusion method. Of these, more preferred is the pre-weighing type coating system called an extrusion coating method. The extrusion coating method is suitable for accurate coating as well as organic solvent coating because volatilization on a slide surface, which occurs in a slide coating system, does not occur. Coating methods have been described for coating layers on the photosensitive layer side. However, the backing layer and the subbing layer are applied onto a support in the same manner as above.

In the invention, silver coverage is preferably from 0.3 to 1.5 g/m$^2$, and is more preferably from 0.5 to 1.5 g/m$^2$ for use in medical imaging. The ratio of the silver coverage which is resulted from silver halide is preferably from 2% to 18% with respect to the total silver, and is more preferably from 5% to 15%. Further, in the present invention, the number of coated silver halide grains, having a grain diameter (being a sphere equivalent grain diameter) of at least 0.01 μm, is preferably from $1\times10^{14}$ to $1\times10^{18}$ grains/m$^2$$_1$ and is more preferably from $1\times10^{15}$ to $1\times10^{17}$. Further, the coated weight of aliphatic carboxylic acid silver salts of the present invention is from $10^{-17}$ to $10^{-14}$ g per silver halide grain having a diameter (being a sphere equivalent grain diameter) of at least 0.01 μm, and is more preferably from $10^{-16}$, to $10^{-15}$ g. When coating is carried out under conditions within the aforesaid range, from the viewpoint of maximum optical silver image density per definite silver coverage, namely covering power as well as silver image tone, desired results are obtained.

The photothermographic material of the invention contains solvent preferably at 5 to 1,000 mg/m$^2$ when subjected to thermal development, and more preferably 100 to 500 mg/m$^2$, thereby leading to enhanced sensitivity, reduced fogging and enhanced maximum density. Examples of such a solvents are described, for instance, in JP-A No. 2001-264936, paragraph [0030] but are not limited to thereto. The solvent may be used singly or in combination.

The solvent content in the photothermographic material can be controlled by adjusting conditions in the drying stage after coating, for example, temperature conditions. The solvent content can be determined by gas chromatography under the condition suitable for detection of contained solvents.

Packaging Material

There will be described packaging methods of sheet-form recording materials and a package of a sheet-form recording material, used in the invention.

In the invention, the process of cutting and packaging is conducted preferably under an environment at an air cleanliness degree, of 10,000 or less of U.S. Standard 209d class, whereby internal staining in a thermal processor during thermal processing is markedly improved. The reason therefor is not clear but it is assumed as below. Chips or dust particles carried-in from the cutting and packaging process and adhered to photothermographic material are subsequently adhered to transporting members such as rollers in the thermal processor and accumulated therein, causing internal staining.

The U.S. Standard 209d class indicates to a standard of a clean room and the environment at an air cleanliness degree of 10,000 or less of U.S. Standard 209d class refers to an environment in which the cumulative number of particles having a size of 0.5 μm or more is not more than 10,000/ft$^3$ (=28,317 cm$^3$) and the cumulative number of particles having a size of more than 0.5 μm is not more than 65 particles/ft$^3$.

An environment meeting the above conditions may be formed in a clean room but the method of the invention is not limited to embodiments in such a clean room. It is not necessarily required to place the overall apparatus for cutting and packaging of sheet-form recording material in a clean room to perform working. For instance, a mechanism to blow air flow onto the sheet-form recording material is provided in an apparatus cutting to packaging and work is performed with maintaining the environment at an air cleanliness degree of 10,000 or less of U.S. Standard 209d class.

It is necessary to maintain an environment at an air cleanliness degree of 10,000 or less of U.S. Standard 209d class during at least one of the cutting step and the packaging step. Preferably, the cutting step is conducted in an environment at an air cleanliness degree of 10,000 or less of U.S. Standard 209d class, and more preferably, both the cutting step and the packaging step are each conducted in an environment at an air cleanliness degree of 10,000 or less of U.S. Standard 209d class.

The cutting step in the invention refers to a step of cutting sheet-form recording material to a prescribed size or to a commonly used size (e.g., A4 size or a size of 34.5×43.0. cm). The number of times for cutting is not limited, which may he a single operation or plural ones. Cutting may be done all together in the longitudinal direction to form a stripe-form recording material and then cutting it in the cross direction is conducted to the prescribed size. There are not specifically limited cutting means or cutting devices used for cutting.

In cases when a sheet form recording material is mounted in an image recording apparatus, the packaging step in the invention means a process including a step of packaging the sheet form recording material. In cases when a load of sheet from recording material is mounted in an image recording apparatus, the packaging step is a process including the step of packaging the sheet form recording material. Thus, it refers to a step of packaging sheet from recording material or a load of sheet form recording material. There are not specifically limited packaging means or the packaging device.

The air cleanliness degree in the course from the cutting step to the packaging step is not necessarily 10,000 or less of U.S. Standard 209d class but it is preferred to maintain an environment at an air cleanliness degree of 10,000 or less of U.S. Standard 209d class. Similar conditions are preferred during the course until cutting manufactured sheet form recording material.

The air cleanliness degree in the cutting step is preferably in class of 7,000 or less in the measurement method in accordance with the U.S. Standard 209d, more preferably 4,000 or less, still more preferably 1,000 or less, and 500 or less is specifically preferred. The air cleanliness degree in the packaging step is preferably a class of 7,000 or less in the measurement method in accordance with the U.S. Standard 209d, more preferably 4,000 or less, still more preferably 1,000 or less, and 500 or less is specifically preferred.

In the invention, a packaging material used for packaging sheets of recording material is chosen from materials barely generating dust. In the case when dust due to packaging material renders it difficult to maintain the cleanliness degree at a level of 10,000 or less of U.S. Standard 209d class, it is preferred not to choose such packaging material.

To prevent density change or fogging with time during storage or to reduce curl or roll-set curl, it is preferred to pack the photothermographic material of the invention with a packaging material exhibiting a low oxygen permeability and/or moisture permeability.

The oxygen permeability is preferably not more than 50 ml/atm·m$^2$·day, more preferably not more than 10 ml/atm·m$^2$·day, and still more preferably not more than 1.0 ml/atm·m$^2$·day.

The moisture permeability is preferably not more than 0.01 g/m$^2$·40° C.·90% RH·day (in accordance with JIS Z0208, Cap Method), more preferably not more than 0.005 g/m$^2$·40° C.·90% RH·day, and still more preferably not more than 0.001 g/m$^2$·40° C.·90% RH·day.

Specific examples of packaging material include those described in JP-A Nos. 8-254793, 2000-206653, 2000-235241, 2002-062625, 2003-015261, 2003-057790, 2003-084397, 2003-098648, 2003-098635, 2003-107635, 2003-131337, 2003-146330, 2003-226439 and 2003-228152. The free volume within a package is preferably 0.01 to 10%, ancid preferably 0.02 to 5%, and it is also preferred to fill nitrogen within the package at a nitrogen partial pressure of at least 80%, preferably at least 90% The relative humtlidity witlhin the package is preferably 10% to 60%, and more preferably 40% to 55%.

A laser imager (thermal development apparatus) used in the invention is constituted of a sheeot photogrphic material supplying device section, as typified by a sheet photographic material tray, a laser image recording device section, a thermal development device section to supply uniform and stable heat to the overall photothermographic material and a transport device section of from the photothermographic sheet material supplying section to discharge the thermally developed photothermographic material via laser recording.

In the laser imager relating to the invention, the ratio of the path length of the cooling section to the path length of the thermal developing section is 1.5 or less, preferably from 0.1 to 1.2, more preferably from 0.2 to 1.0. The path length of the thermal developing section refers to the distance of conveying a photothermographic material with heating at a developing temperatures. The path length of the cooling section refers to the distance of conveying the thermally developed photothermographic material from the end of the thermal developing section (being after completion of heating) to the exit of the laser imager (or until discharging the photothermographic material under the ambient light of a room where the laser imager is installed, from the light-tight region of the laser imager).

The laser imager preferably has a function of making the cooling rate of the opposite side of the photothermographic material to the light-sensitive layer (hereinafter, also denoted as the light-insensitive side) greater than that of the light-sensitive layer side (hereinafter, also denoted as the light-sensitive side).

In the invention, the cooling rate ratio of the light-insensitive side to that of the light-sensitive side is preferably at least 1.1, more preferably from 1.1 to 5.0, and still more preferably from 1.5 to 3.0. The means for increasing the cooling rate on the light-insensitive side are not specifically limited but it is a preferred embodiment to bring the light-insensitive side into direct contact with a metal plate, a metal roller, unwoven fabric or a flocked roller. It is more preferred to use a heat sink or a heat pipe in combination with the foregoing members to externally discharge heat accumulated in these members.

A laser imager having a short cooling section, which exhibits the ratio of a path length of a cooling section to that of a thermal-developing section of 1.5 or less, can provide a compact, higher-speed laser imager.

The cooling time of from leaving the thermal-developing section until being discharged from the exit of the laser imager is preferably 0 to 25 sec., more preferably 0 to 15 sec., and still more preferably 5 to 15 sec. The path length over which a photothermographic material passes after leaving the thermal developing section and before being discharged, is optional, preferably 1 to 60 cm, more preferably 5 to 50 cm, and still more preferably 5 to 40 cm.

Photothermographic material relating to this invention may be thermally developed in any method, but usually, an imagewise exposed photothermographic material is developed, while being heated at a relatively high temperature. The developing, temperature is preferably 80 to 250° C., more preferably 100 to 140° C., and still more preferably 110 to 130° C. The developing time is preferably 1 to 10 sec., more preferably 2 to 10 sec., and still more preferably 3 to 10 sec. A developing temperature falling within the foregoing range can obtain sufficiently high image density over a short period of time and also car prevent adversely affect on transportability or the processor, due to melting of the binders. Heating causes oxidation-reduction reaction between an organic silver salt (which functions as an oxidant) and a reducing agent to form a silver image. This reaction proceeds without supplying any processing solution such as water. The thermal processing time (the time from pickup of photothermographic material in the tray section and to discharge thereof) is preferably not more than 60 sec. and more preferably 10 to 50 sec., whereby diagnosis in case of emergency can be performed.

The thermal development system of the invention can employ a drum type heater or a plate type heater but a plate heater system is preferred. The preferred thermal development system of a plate heater system is the method described in JP-A No. 11-133572, that is, a laser imager in which a photothermographic material which has been exposed to light to form latent images on silver halide grains, is brought into contact with a heating means in the thermal-developing section to obtain a visible image. The heating means is composed of a plate heater and a plurality of pressure rollers are arranged facing and along the surface of the plate heater. The photothermographic material is allowed to pass between the plate heater and the pressure rollers to perform thermal development.

The transport speed (or linear velocity) in each of the exposure section, the thermal-developing section and the cooling section is optional but a higher speed is preferred for rapid processing or enhancement of through-put. The transport speed is preferably 30 to 200 mm/sec, more preferably 30 to 150 mm/sec, and still more preferably 30 to 60 mm/sec. A transport speed falling within this range can improve density unevenness due to thermal development and can decrease the processing time, which is suitable for urgent medical diagnosis.

An exemplary thermal development apparatus according to the preferred embodiment of the invention will be described with reference to the drawings.

FIG. 1 is a side-view illustrating the main part of a thermal development apparatus according to one preferred embodiment of the invention.

The distance between an exposure section and a thermal-developing section is preferably within a range from 0 to 50 cm to perform thermal development concurrently with exposure, i.e., to start development of an exposed portion of a sheet while simultaneously exposing an unexposed portion of the sheet. Thereby, the processing time for exposure and development is extremely reduced. The distance is more preferably 3 to 40 cm, and still more preferably 5 to 30 cm.

The exposure section refers to the region in which light from a light source exposes a photothermographic material, and the thermal developing section refers to a region in which a photothermographic material is heated to perform thermal development. In FIG. 1, the portion designated as L at which a photothermographic material is exposed to laser light (top of the arrow) is an exposure section, and the portion at which a photothermographic material conveyed from photothermographic sheet material housing section 45 is brought into contact with plate 50 is a development section.

Heating instruments, devices or means can employ typical heating means such as a hot plate, an iron, a hot roller and a heat generator using carbon or white titanium. Heating a photothermographic material having a protective layer on the light-sensitive layer with contacting the protective layer side with heating means to achieve uniform heating is preferred in a terms of heat efficiency and workability.

In thermal development apparatus 40, as shown in FIG. 1, film F comprising a EC-face having a photothermographic material coating on one side of a sheet support comprised of PET or the like and a BC-face on the side opposite the EC-face is exposed to laser light from light scanning exposure section 55 to form a latent image, while conveyed in the sub-scanning direction. Subsequently, the film F is heated from the BC-face side to develop the latent image to form a visible image, then, conveyed through a transport route having a curvature to the upper portion of the apparatus and discharged.

As shown in FIG. 1, the image forming apparatus 40 is provided with film enclosure section 45 enclosing unexposed film (F) stock, installed near the bottom of apparatus frame 40*a*, pickup roller 46 to pick up the uppermost sheet of film F in the film enclosure tray section 45, paired transport rollers 47 to convey the film F from the pickup roller 46, to curved guide 48 which is arranged in a curved form so as to guide the film F conveyed by the transport roller 47 and to convey the film F in a nearly reversed direction, paired transport rollers 49*a* and 49*b* to convey the films F from the curved guide 48, and light scanning exposure section 55 to expose laser light L by light-scanning onto the film F, based on image data, between paired transport rollers 49*a* and 49*b* to form a latent image on the EC face.

The image forming apparatus 40 is further provided with temperature-raising section 50 to raise the temperature of the exposed film F having formed at latent image to a prescribed development temperature by heating the film from the BC-face size, temperature-retaining section 53 to heat the heated film F to maintain the film 1 at a prescribed temperature, cooling section 54 to cool the heated film F from the BC-face side, densitometer 56 arranged in the exit side of the cooling section 54 to measure the density of the film, paired transport rollers 57 to discharge the film from the densitometer, and film storage section 58 to stack the film F discharged by the paired transport rollers 57 and installed on upper surface of the apparatus frame with being inclined upward.

In the image forming apparatus 40, as shown in FIG. 1, the film enclosure section 45, base plate section 59, the paired transport rollers 49*a* and 49*b*, the temperature-raising section 50 and the temperature-retaining section 53, are arranged in the order from the bottom of the apparatus frame 40*a* to the above, and the film enclosure section 45 is not subject to heating influence since it is located lowermost and has the base plate section 59 intervened under the temperature-raising section 50 and temperature-retaining section 53, is not subject to heating influence.

The transport route from the paired transport rollers 49*a* and 49*b* to the temperature-raising section 50 is arranged to be relatively short so that the top portion of a sheet of the film F is already thermally developed in the temperature-raising section 50 and the temperature-retaining section 53, while the end portion of the sheet of the film F is exposed by the light-scanning exposure section 55.

The temperature-raising section 50 and the temperature-retaining section 53 constitute a heating section, where the film F is heated to a thermal development temperature and maintained at the thermal development temperature. The temperature-raising section 50 is comprised of upstream first heating zone 51 to heat the film F and downstream second heating zone 52 to heat the film F.

The first heating zone 51 is composed of fixed planar heating guide 51*b* of metallic material such aluminum, planar heater 51*c* of silicone rubber heater or the like, tightly attached to the back face of the heating guide 51*b*, and plural opposed rollers 51*a* which are arranged so that a narrower clearance than the film thickness is kept to compress the film onto fixed guide surface 51*d* and the surface of which is formed of silicone rubber exhibiting a high heat-insulating capability as compared to metals or the like.

The first heating zone 52 is structured of fixed planar heating guide 52*b* and composed of metallic material such aluminum, while planar heater 52*c* composed of silicone rubber heater or the like, tightly attached to the back face of the heating guide 52*b*, and plural opposed rollers 52*a* which are arranged so that a clearance narrower than the film thickness is maintained to press them film onto fixed guide surface 52*d* and the surface of which is formed of silicone rubber exhibiting a higher heat-insulating capability as compared to metals or the like.

The temperature-retaining section 53 is structured of fixed planar heating guide 53*b* and composed of metallic material such aluminum, planar heater 53*c* composed of silicone rubber heater or the like, tightly attached to the back face of the heating guide 52*b*, aid guide section 53*a* which is arranged facing fixed guide surface 53*d* constituted on the surface of the heating guide 53*b* with holding a prescribed clearance (slit) d and which is formed of a heat-insulating material. The heat-retaining section 53, in which a portion of the side of the temperature-raising section 50 is planarily arranged after the second heating zone 52, upward curves in the middle thereof at a prescribed curvature.

In the first heating zone 51 of the temperature-raising section 50, the film F which is conveyed by paired transport rollers 49*a* and 49*b* from upstream of the temperature-raising section 50, is conveyed, while heated on the BC-face (denoted as BC) being pressed onto the guide face 51*d* by driven opposed rollers 51*a* so as to be in close contact with the fixed guide surface 51*d*.

Similarly, in the second heating zone 52, the film F conveyed from the first heating zone 51 is conveyed, while heated on the BC-face being compressed onto the fixed guide face 51*d* by opposed rollers 52 a so as to be in close contact with the fixed guide surface 51*d*.

A recess, opening upward in a V form may be provided between the second heating zone 52 of the temperature raising section 50 and the the temperature-retaining section 53. Foreign matter carried out of the temperature-raising section 50 can fall down into the interior of the recess, and thereby prevent the foreign matter from being carried in the temperature-retaining section 53.

In the temperature-retaining section 53, the film F conveyed from the second heating zone passes through clearance d between the fixed guide surface 53*d* and the guide section 53*a* by the conveying force of the opposed roller 52*a* on the side of the second heating zone 52, while heated (or temperature-maintained) in the clearance d by heat from the heating guide 53*b*. The film F is conveyed toward the cooling section 54, while gradually turned from the horizontal direction to the vertical direction.

In the cooling section 54, the film F vertically conveyed from the temperature-retaining section 53 is conveyed toward the film accumulation section 58, while cooled by bringing the film F into contact with the cooling guide surface 54*c* of the cooling plate 54*b* formed of a metallic material by the opposed roller 54*a* and turning the direction of the film from the vertical direction to an oblique. Cooling effects can be promoted by modifying the cooling plate 54*b* by a finned heat sink structure. A part of the cooling plate 54*b* may be modified by a finned heat sink structure.

The cooled film F conveyed from the cooling section is then subjected to densitometry by densitometer 56, conveyed by the paired transport rollers 57 and discharged onto the film storage section 58. The film storage section 58 can temporarily stack plural sheets of the film F.

In the thermal development apparatus 40 shown in FIG. 1, the film F is conveyed through the temperature-raising section 50 and the temperature-retaining section 53, while the BC-face faces the fixed guide surfaces 51*d*, 52*d* and 53*d* and the EC-face coated with photothermographic material is opened.

The film F is conveyed by opposed rollers 51*a* ad 52*a* so as to pass through the temperature-raising section 50 and the temperature-retaining section 53 within 10 sec. Accordingly, the heating duration over the temperature-raising section and the temperature-retaining section is to be 10 sec. or less.

The film F is conveyed in the temperature-raising section 50 requiring uniform heat-transfer of the thermal development apparatus 40, as shown in FIG. 1, while securing contact heat-transfer by bringing the film F into direct contact with the fixed guide surface 51*d* and 52*d* by the heating guide 51*b* and 52*b*, and plural opposed rollers 51*a* and 52*a* to press the film onto the heating guides 51*b* and 52*b*. Thereby, the film sheet is uniformly heated overall, resulting in homogeneous temperature-rise, leading to a finished film of high image quality without unevenness in density.

After heating to a thermal development temperature, the film is conveyed into clearance d between the fixed guide surface 53*d* of the heating guide 53*b* and the guide section 53*a*. Even if heated in the clearance d without being in contact with the fixed guide surface 53*d* (heat-transfer by direct contact with the fixed guide surface 53*d* and/or heat-transfer due to contact with surrounding hot air), the film temperature falls within the range (e.g., ±0.5° C.) of the thermal development temperature (e.g., 123° C.). Thus, even when the film sheet is conveyed within the clearance d along the surface of the heating guide 53*d* or the surface of the curved guide 53*a*, the difference in temperature is less than 0.5° C. and uniform temperature-retaining is maintained, causing no unevenness of density in the finished film. The temperature-retaining section 53 requires no driving part such as a roller i, realizing reduction of the number of parts of the apparatus.

As stated before, heating the photothermographic sheet material F is completed within 10 sec., achieving rapid thermal processing. The temperature-retaining section which extends horizontally from the temperature-raising section, is curved and becomes vertical on the way, and the film F almost reverses its direction in the cooling section 54 and is discharged to the film storage section 58. Thus, a compact apparatus and reduced setting area for the apparatus can be achieved by allowing the cooling section 54 to have a prescribed curvature in accordance with the layout of the apparatus.

In conventional large-side processing machine, a heating and transport mechanism is provided even in a section after having the film temperature raised to the development temperature, which is sufficient for a temperature-retaining function, resulting in unnecessary members, leading to an increase of the number of parts and cost. On the other hand, conventional compact machines cannot secure sufficient heat transfer, causing uneven density and making it difficult to attain the desired high image quality. On the contrary, in one preferred embodiment of the invention, the thermal development process is divided into the temperature-raising section 50 and the temperature-retaining section 53, each of which is performed separately, that the foregoing problems can be overcome.

In the temperature-raising section 50, and the temperature-retaining section 53, the photothermographic sheet material F is heated on the BC-side, while the EC-side being coated with photothermographic material is opened. When thermal development is rapidly performed within 10 sec., volatile solvents contained in the film F (such as water or organic solvents) vaporize from the opened EC-side, so that even when the heating time is shortened, little is subjected to such shortened time. Even when contact of the film F with the fixed guide surface 51*d* or 52*d* is somewhat insufficient, any difference in temperature from the portion having surface contact is mitigated, resulting in a reduced temperature difference, leading to stable image quality as well as stable density. Heating from the EC-side was considered to be better in terms of heating efficiency. However, taking into account that the thermal conductivity of a PET used as a support of the film F I0.17 W/m·° C. and the thickness of the PET is approximately 170 μm, the time lag is small and can easily be compensated, for instance, by an increase of heater capacity. Mitigation of the foregoing uneven contact is thereby expected to be more effective.

Solvents (water, organic solvent) contained in the film F also vaporize in the course of from coming out of the temperature-retaining section 53 to reaching the cooling section 54 which is still maintained at a relatively high temperatures. Since the EC-side is in the opened state even in the cooling section 54, the solvents vaporize, leading to stabilized image quality. Thus, the cooling time cannot be ignored in rapid processing process and is effective specifically for a rapid process including a heating time of 10 sec. or less.

The thermal development temperature is preferably in the range of 110 to 150° C., and more preferably 115 to 135° C. Maintaining a heating temperature within this range results in sufficient image density for a short period and can also prevent transfer onto a roller due to melting of a binder and adverse effects on transportability or developing instruments.

Heating means may be any contact heating with a heating drum or a heating plate and non-contact heating such as radiation, but contact heating with a heating plate is preferred. The contact heating surface may be either the light-sensitive layer side or the non-light-sensitive layer side but the contact heating surface of the non-light-sensitive layer side is preferred in terms of stability in the processing environment. The development section is preferably constituted of a combination of a plurality of independently temperature-controlled zones and plural means and preferably has at least one heat-retention zone to maintain a specific development temperature. One preferred thermal development apparatus used in the invention can employ the thermal development process constituted of a heat raising section and a heat-retention section. The heat raising section achieves close contact of a heating means such as a heating member with a photothermographic sheet material to minimize density unevenness but the heat-retention section is not required to achieve such close contact, so that the heat raising section and the heat-retention section can independently employ a different, but appropriate, heating system, enabling raped thermal development processing and downsizing and resulting in cost reduction of the apparatus, while maintaining high image quality with density uniformity.

In the foregoing thermal development apparatus, the heat-raising section heats the photothermographic sheet material with pressing the photothermographic material onto a plate heater by an opposed roller and the heat-retention section heats the photothermographic sheet material within a slit formed between guides having a heater on at least one side thereof. In the heat raising section, the opposed roller compresses the photothermographic sheet material onto the plate heater, bringing the photothermographic material into close contact with the plate heater; on the other hand, the heat-retention section conveys the photothermographic material between slits merely by conveyance power of the opposed roller of the heat raising section with heating (heat-retaining) and does not need any driving part of a conveyance system, nor does it require high accuracy of a slit size, enabling downsizing of the apparatus and cost reduction.

This thermal development apparatus ensures close contact of a heating means such as a beating member with the photothermographic sheet material in the first zone to perform heat raising of the photothermographic sheet material, leading to reduced density unevenness, but the second zone does not need such close contact and heat-retention of the photothermographic sheet material in the space between guides (or guide space) can realize constitution (enabling rapid access of the thermal development process, downsizing and cost reduction of the apparatus, while maintaining high image quality with density uniformity. A guide space of 3 mm or less exhibits little effect on heat-retention capability irrespective of the conveyance position of the photothermographic sheet material and does not require high layout accuracy of a fixed guide and the other guide, resulting in an increased amount for a permissible curvature error of both guides, caused in working and fitting accuracy and an increased degree of freedom in designation, and leading to cost reduction.

In the thermal development apparatus relating to the invention, the guide spacing of the second zone is preferably in the range of 1 to 3 mm. A guide space of 1 mm or more makes it difficult that the coated side of a photothermographic sheet material is brought into contact with the guide surface, resulting in reduced concern of occurrence of abrasion marks.

In the second zone, the fixed guide and the other guide preferably have substantially the same curvature. When guides in the second zone are structured to have a curvature which allows for downsizing of the apparatus, guides having an almost constant guide space can be formed.

It is feasible to make up the heat raising section and the heat-retention section so as to have 10 sec or less for engaging time with the photothermographic sheet material, whereby the time for the heat raising step and the heat-retention step is shortened, enabling more rapid access of thermal development.

There may be provided recesses between the heat raising section and the heat-retention section to allow foreign substances carried from the heat raising section to enter into the recesses, preventing foreign substances collected on the top of the photothermographic sheet material from entering the heat-retention section and inhibiting occurrence of jamming, abrasion marks and density unevenness.

The heat raising section and the heat-retention section preferably heat the photothermographic sheet material, while opening the coated side of the photothermographic material. In the cooling section, it is also preferred to perform cooling, while opening the coated side of the photothermographic material.

The mechanism of the heat-retention zone, which maintains the temperature of the heated photothermographic material, is not limited to the foregoing. The development time is preferably in the range of 5 to 10 sec.

The development apparatus may be provided with a preheating zone which heats the photothermographic material to a temperature of 70 to 100° C. (preferably 90 to 100° C.) after imagewise exposure and before the thermal development step to perform heating at an intended development temperature. The heating mechanism of the pre-heating zone is not specifically limited but contact heating with a heated plate is preferred. The heating temperature precision of the pre-heating zone is preferably within ±1° C. The heating time, depending on the heating mechanism, is preferably in the range of 0.5 to 7 sec.

The development apparatus may be provided with a slow cooling zone which heats a photothermographic material at a temperature of 10-20° C. (preferably, 10-15° C.) lower than the thermal development temperature to stop development after completion of imagewise exposure and thermal development. The mechanism of the slow cooling zone is not specifically limited but preferably is contact cooling with a plate adjusted to the prescribed temperature in terms of cost and controllability. The temperature precision of the slow cooling zone is preferably, ±1° C., and more preferably ±0.5° C. The slow cooling time is preferable not less than 0.25 times the development time, and more preferably in the range of 0.25-1.0 times the development time in terms of rapid processing.

In the invention, there may be provided a temperature-humidity sensor near the conveyance route of from the photothermographic sheet material-housing section (45) to the heat raising section (50) to control the development time or development temperature, based on the measured temperature or humidity, enabling to maintain stable image quality. At a high environmental humidity, lowering the development temperature or shortening the development time can achieve stabilization of image density.

EXAMPLES

The present invention will be further described based on examples but is by no means limited to these. Unless specifically noted, "%" designates percent by weight.

Example 1

A photothermographic material was prepared according to the following procedure.

Preparation of Subbed Photographic Support:

A photographic support comprised of a 175 μm thick biaxially oriented polyethylene terephthalate film blue tinted at an optical density of 0.170 (determined by Densitometer PDA-65, manufactured by Konica Corp.) which had been subjected to corona discharge treatment of 8 W·minute/m$^2$ on both sides, was subjected to subbing. Namely, subbing liquid coating composition a-1 was applied onto one side f the above photographic support at 22° C. and 100 m/minute to result in a dried layer thickness of 0.2 μm and dried at 140° C., whereby a subbing layer on the light-sensitive layer side (designated as Subbing Layer A-1) was formed. Further, subbing liquid coating composition b-1 described below was applied, as a backing layer subbing layer, onto the opposite side at 22° C. and 100 m/minute to result in a dry layer thickness of 0.12 μm and dried at 140° C. An electrically conductive subbing layer (designated as subbing lower layer B-1), which exhibited an antistatic function, was applied onto the backing layer side. The surface of subbing lower layer A-1 and subbing lower layer B-1 was subjected to corona discharge treatment of 8 W·minute/m$^2$. Subsequently, subbing liquid coating composition a-2 was applied onto subbing lower layer A-1 was applied at 33° C. and 100 m/minute to result in a dried layer thickness of 0.03 μm and dried at 140° C. The resulting layer was designated as subbing upper layer A-2. Subbing liquid coating composition b-2 described below was applied onto subbing lower layer B-1 at 33° C. and 100 m/minute to results in a dried layer thickness of 0.2 μm and dried at 140° C. The resulting layer was designated as subbing upper layer B-2. Thereafter, the resulting support was subjected to heat treatment at 123° C. for two minutes and wound up under the conditions of 25° C. and 50 percent relative humidity, whereby a subbed sample was prepared.

Blue dye

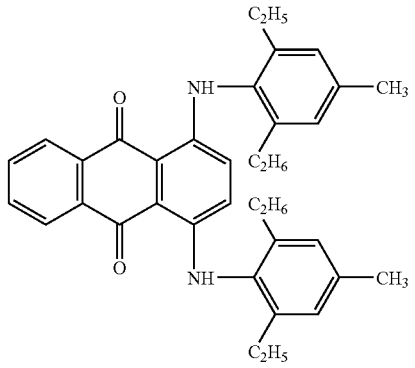

Preparation of Hydrophilic Polyester A-1:

A mixture consisting of 35.4 parts by weight of dimethyl terephthalate, 33.63 parts by weight of dimethyl isophthalate, 17.92 parts by weight of sodium salt of dimethyl 5-sulfoisophthalate, 62 parts by weight of ethylene glycol, 0.065 part by weight of calcium acetate monohydrate, and 0.022 part by weight of manganese acetate tetrahydrate underwent trans-esterification at 170 to 220° C. under a flow of nitrogen while distilling out methanol. Thereafter, 0.04 parts by weight of trimethyl phosphate, 0.04 part by weight of antimony trioxide, and 6.8 parts by weight of 4-cyclohexanedicarboxylic acid were added. The resulting mixture underwent esterification at a reaction temperature of 220 to 235° C. while a nearly theoretical amount of water was distilled away. Thereafter, the reaction system was subjected to pressure reduction and heating over a period of one hour and was subjected to polycondensation at a final temperature of 280° C. and a maximum pressure of 133 Pa for one hour, whereby water-soluble polyester A-1 was synthesized. The intrinsic viscosity of the resulting water-soluble polyester A-1 was 0.33, the average particle size was 40 nm, and Mw was 80,000 to 100,000.

Subsequently, 850 ml of pure water was placed in a 2-liter three-necked flask fitted with stirring blades, a refluxing cooling pipe, and a thermometer, and while rotating the stirring blades, 150 g of water-soluble polyester A-1 was gradually added. The resulting mixture was stirred at room temperature for 30 minutes without any modification. Thereafter, the interior temperature was raised to 98° C. over a period of 1.5 hours and at that resulting temperature, dissolution was performed. Thereafter, the temperature was lowered to room temperature over a period of one hour and the resulting product was allowed to stand overnight, whereby hydrophilic polyester A-1 solution was prepared.

Preparation of Modified Hydrophilic Polyester Solution

Into a 3-liter four-necked flask fitted with stirring blades, a reflux cooling pipe, a thermometer, and a dropping funnel were put 1,900 ml of the aforesaid 15 percent by weight water-based polyester A-1 solution, and the interior temperature was raised to 80° C., while rotating the stirring blades. Into this was added 6.52 ml of a 24 percent aqueous ammonium peroxide solution, and a monomer mixed liquid composition (consisting of 28.5 g of glycidyl methacrylate, 21.4 g of ethyl acrylate, and 21.4 g of methyl methacrylate) was dripped over a period of 30 minutes, and reaction was allowed for an additional 3 hours. Thereafter, the resulting product was cooled to at most 30° C., and filtrated, whereby modified water-based polyesters solution B-1 (vinyl based component modification ratio of 20 percent by weight) of 18 wt % solid was obtained.

Subsequently, modified polyester B-2 at a solid concentration of 18 percent by weight (a vinyl based component modification ratio of 20 percent by weight) was prepared in the tame manner at above except that the, vinyl modification ratio was changed to 36 percent by weight and the modified component was changed to styrene:glycidyl methacrylate:acetacetoxyethyl methacrylate:n-butyl acrylate=39.5:40:20:0.5.

Preparation of Acryl Polymer Latexes C-1 to C-3

Acryl polymer latexes C-1 to C-3 having the monomer compositions shown in Table 1 were synthesized employing emulsion polymerization. All the solid concentrations were adjusted to 30 percent by weight.

TABLE 1

| Latex No. | Monomer Composition (weight ratio) | Tg (° C.) |
|---|---|---|
| C-1 | styrene:glycidyl methacrylate:n-butyl acrylate = 20:40:40 | 20 |
| C-2 | styrene:n-butyl acrylate:t-butyl acrylate:hydroxyethyl methacrylate = 27:10:35:28 | 55 |
| C-3 | styrene:glycidyl methacrylate:acetoacetoxyethyl methacrylate = 40:40:20 | 50 |

Preparation of Subbinig Layer Coating Solution:

Coating Composition (a-1) of Subbing Lower Layer a-1 on Light-Sensitive Layer Side

| | |
|---|---|
| Acryl Polymer Latex C-3 (30% solids) | 70.0 g |
| Aqueous dispersion of ethoxylated alcohol and ethylene homopolymer (10% solids) | 5.0 g |
| Surfactant (A) | 0.1 g |
| Distilled water to make | 1000 ml |

Coating Composition (a-2) of Light-sensitive Layer Side Subbing Upper Layer

| | |
|---|---|
| Modified Water-based Polyester B-2 (18 wt %) | 30.0 g |
| Surfactant (A) | 0.1 g |
| Spherical silica matting agent (Sea Hoster KE-P50, manufactured by Nippon Shokubai Co., Ltd.) | 0.04 g |
| Distilled water to make | 1000 ml |

Coating Composition (b-1) of Backing Layer Side Subbing Lower Layer

| | |
|---|---|
| Acryl Based Polymer Latex C-1 (30% solids) | 30.0 g |
| Acryl Based Polymer Latex C-2 (30% solids) | 7.6 g |
| $SnO_2$ sol* | 180 g |
| Surfactant (A) | 0.5 g |
| Aqueous 5 wt. % PVA-613 (PVA, manufactured by Kuraray Co., Ltd.) | 0.4 g |
| Distilled water to make | 1000 ml |

*The solid concentration of $SnO_2$ sol synthesized employing the method described in Example 1 of JP-B No. 35-6616 was heated and concentrated to reach a solid concentration of 10 percent by weight, and subsequently, the pH was adjusted to 10 by the addition of ammonia water.

Coatings Composition (b-2) of Backing Layer Side Subbing Upper Layer

| | |
|---|---|
| Modified Water-based Polyester B-1 (18% by weight) | 145.0 g |
| Spherical silica matting agent (Sea Hoster KE-P50, manufactured by Nippon Shokubai Co., Ltd.) | 0.2 g |
| Surface Active Agent (A) | 0.1 g |
| Distilled water to make | 1000 ml |

Surfactant (A)

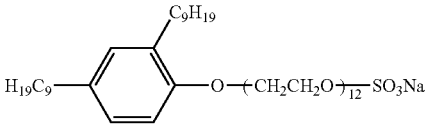

Preparation of Silver Halide Emulsion

| | |
|---|---|
| **Solution A** | |
| Phthalated gelatin (99% phthalation) | 66.20 g |
| Surfactant (AO-1) (10% aqueous methanol solution) | 10 ml |
| Potassium bromide | 0.32 g |
| Water to make | 5429 ml |
| **Solution B** | |
| 0.67 mol/L aqueous silver nitrate solution | 2635 ml |
| **Solution C** | |
| Potassium bromide | 51.55 g |
| Potassium iodide | 1.47 g |
| Water to make | 660 ml |
| **Solution D** | |
| Potassium bromide | 154.90 g |
| Potassium iodide | 4.41 g |
| Potassium hexacyanoiron (II) (0.5% solution) | 15 ml |
| Potassium hexachloroiridium (III) (1% solution) | 0.93 ml |
| Water to make | 1982 ml |
| **Solution E** | |
| Aqueous 0.4 mol/L potassium bromide solution in an amount to control silver potential | |
| **Solution F** | |
| Potassium hydroxide | 0.71 g |
| Water to make | 20 ml |
| **Solution G** | |
| 56% aqueous acetic acid solution | 10.0 ml |
| **Solution H** | |
| Sodium carbonate anhydride | 1.16 g |
| Water to make | 107 ml |

AO-1: Compound (AO-1): $HO(CH_2CH_2O)_n(CH(CH_3)CH_2O)_{17}(CH_2CH_2O)_m H$ (m + n = 5 to 7)

Upon employing a mixing stirrer shown in JP-B No. 58-58288, ¼ portion of solution B and the whole solution C were added to solution A over 4 minutes 45 seconds, employing a double-jet precipitation method while adjusting the temperature to 35° C. and the pAg to 8.09, whereby nuclei were formed. After one minute, the whole solution F was added. During the addition, the pAg was appropriately adjusted employing Solution E. After 6 minutes, ¾ portions of solution B and the whole solution D were added over 14 minutes 15 seconds, employing a double-jet addition method while adjusting the temperature to 35° C. and the pAg to 8.09.

After stirring for 5 minutes, the mixture was cooled to 30° C., and the whole solution G was added, whereby a silver halide emulsion was flocculated. Subsequently, while leaving 2000 ml of the flocculated portion, the supernatant was removed, and 10 L of water was added. After stirring, the silver halide emulsion was again flocculated. While leaving 1,500 ml of the flocculated portion, the supernatant was removed. Further, 10 L of water was added. After stirring, the silver halide emulsion was flocculated. While leaving 1,500 ml of the flocculated portion, the supernatant was removed. Subsequently, solution H was added and the resultant mixture was heated to 60° C., and then stirred for an additional 120 minutes. Finally, the pH was adjusted to 5.8 and water was added so that the weight was adjusted to 1,161 g per mol of silver, whereby a light-sensitive silver halide emulsion was prepared.

The prepared emulsion was comprised of monodisperse cubic silver iodobromide grains having an average grain size of 0.043 μm and a (100) crystal face ratio of 92%

Preparation of Amphiphilic Polymer

Into a 0.5 liter four-necked separable flask fitted with a dropping device, a thermometer, a nitrogen gas introducing tube, stirrer and reflux condenser were placed 50 g of methyl ethyl ketone (MEK), 20 g of diacetoneacrylamide, 20 g of methoxy-polyethylene glycol monomethacrylate (Blemmer PME-400, produced by Nippon Yushi Co., Ltd.), 20 g of stearoxypolyethylene glycol monomethacrylate (Blemmer PSE-400, produced by Nippon Yushi Co., Ltd.) and 0.12 g of lauryl peroxide and heated at 80° C. Further, a solution of 40 g of N-i-propylacrylamide dissolved in 43 g of MEK was added to the separable flask over 2 hrs. Thereafter, the mixture was heated and when reached the refluxing state, 0.17 g of a solution of 0.17 g of lauryl peroxide dissolved in 33 g of MEK was added to the flask over 2 hrs. and reacted at that temperature over 3 hrs. Then, a solution of 0.33 g of methylhydroquinone dissolved in 107 g of MEK was added and after being cooled, a 30% amphiphilic polymer solution used for dispersion. The molecular weight (Mw), which was measured by GPC (gel permeation chromatography) in terms of polystyrene, was approximately 55,000. Subsequently, this polymer solution was dropwise added to a sufficient amount of water and the supernatant liquid was removed to obtain a polymer solid.

Preparation of Amphiphilic Dispersion of Silver Halide Grain 10 g of the foregoing polymer solid was added to 67 g of methanol and dissolved with stirring at 45° C. for 30 min. Further thereto, 25 g of the foregoing silver halide emulsion adjusted to 45° C. was added over 2 min. and stirred for 30 min. The solution was cooled to 18° C., allowed to stand for 30 min. and separated to two layers. The supernatant of the solution was removed and 230 g of MEK was added and distilled under reduced pressure until the solution reached a water content of less than 10%. Finally, MEK was added until the total amount reached 157 g and an amphiphilic dispersion of a silver halide emulsion was obtained.

Preparation of Powdery Silver Aliphatic Carboxylate

Figure 2:
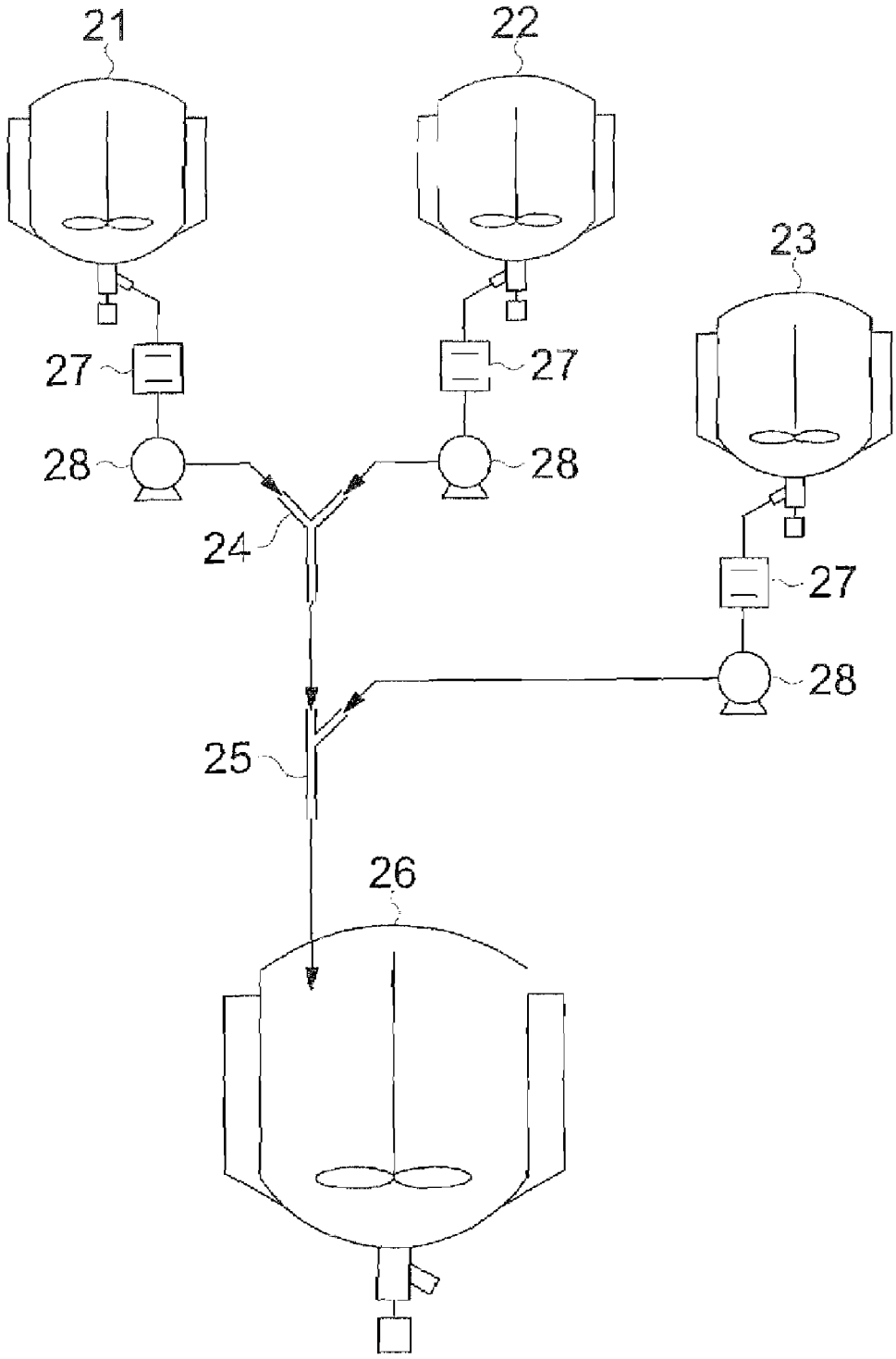
FIG. 2 illustrates an apparatus for manufacturing silver salts of aliphatic carboxylic acids relating to the invention.

Using an apparatus shown in FIG. 2, aliphatic carboxylic acid silver salt particles were prepared according to the procedure below. While stirring 1850 g of aliphatic carboxylic acids (having a molar ratio shown in Table 2) and pure water in an amount of 90% of the amount necessary to adjust the concentration shown in Table 2 at 85° C. in tank 11, 1036 ml of aqueous 5 M/L KOH solution was added thereto in 5 min. and reacted for 60 min to obtain an aqueous potassium aliphatic carboxylate solution. Finally, additional pure water was added to make up so that the concentration of an aqueous potassium aliphatic carboxylate solution was 5%.

38,300 g of an aqueous 5% silver nitrate solution was prepared in tank 22 and maintained at 10° C. The foregoing aqueous potassium aliphatic carboxylate solution and an aqueous silver nitrate solution were simultaneously added by double-jet addition at a constant flow rate over a period of 4 min. to a mixing device 24 and the obtained reaction mixture was stocked in tank 26. The tank 26 was kept at 35° C. during addition. Subsequently, solids were filtered by a suction filter and washed with pure water at a temperature of 25° C. until the conductivity of permeated water reached 30 μS/cm. The dehydrated cake was dried at 50° C. to obtain dried powdery aliphatic carboxylic acid silver salt particles. There were thus obtained particulate aliphatic carboxylic acid silver salt 1-1 through 1-8. In FIG. 2, numerals 23, 27 and 28 designate a tank, a flow meter and a pump, respectively.

Preparation of Silver Aliphatic Carboxylate Dispersion

In 1300 g of methyl ethyl ketone (hereinafter referred to as MEK) was dissolved 49 g of polyvinyl butyral (BL-SHP, Tg=62° C., produced by Sekisui Kagaku Kogyo Co., Ltd.). While stirring by dissolver DISPERMAT Type CA-40M (manufactured by VMA-Getzmann Co.), 500 g of the foregoing powdery aliphatic carboxylic acid silver salt was gradually added and sufficiently mixed, and a preliminary dispersion was prepared. After completing addition of the powdery silver aliphatic carboxylate, stirring continued for 15 mim. at 1500 rpm. The prepared preliminary dispersion was charged into a media type homogenizer DISPERMAT Type SL-C12EX (manufactured by VMA-Getzmann Co.), filled with 0.5 mm diameter zirconia beads (Toreselam, produced by Toray Co.) so as to occupy 80 percent of the interior volume so that the retention time in the mill reached 1.2 minutes and was dispersed at a peripheral rate of the mill of 9 m/second and a temperature of 25° C. to obtain a light-sensitive emulsion dispersed solution. The solid content of the obtained silver aliphatic-carboxylate dispersion was 27%.

To 1670 g of the obtained silver aliphatic-carboxylate dispersion was added 157 g of the foregoing amphiphilic dispersion of silver halide grains, followed by preparation of a light-sensitive layer coating composition, as described below.

Coating of Component Layer

On the subbing upper layer A-2 on the light-sensitive layer side of the subbed support were simultaneously coated a slip layer coating solution, a light-sensitive layer coating solution and a protective layer of the light-sensitive layer (surface protective layer) by using a slide coater at a coating speed of 50 m/min so that the dry thicknesses of the slip layer, the light-sensitive layer and the protective layer were 0.5 μm, 120 μm and 3.0 μm, respectively.

Subsequently, on the subbing layer B-2 were simultaneously coated a slip layer coating solution and a BC layer coating solution by using a slide coater at a coating speed of 50 m/min so that dry thicknesses of the slip layer and the BC layer were 0.3 μm and 2.1 μm, respectively. The thus coated samples were subjected to a heating treatment at 79° C. for 10 min. to obtain photothermographic materials (Samples 102-125), as shown in Table 2.

Preparation of Light-sensitive Layer Coating Solution

While stirring, 1670 g of the foregoing silver aliphatic carboxylate dispersion and 1670 g of MEK were mixed and the resultant mixture was maintained at 18° C., then, 1.2 g of a methanol solution of 11% bis(dimethylacetoamide)dibromobromate was added and stirred for 1 hr. Subsequently, 15.1 g of a methanol solution of 11% calcium bromide was added and stirred for 30 min. Further thereto, an infrared-sensitizing dye solution, as described below was added and stirred for 1 hr. Then, the temperature was lowered to 13° C. and stirring continued for 30 min. While being maintained at 13° C., 345 g of polyvinyl butyral powder A (Tg=75° C., acetal ratio: acetoacetal/butyl acetal=3/7, polymerization degree of 700) and 30 g of polyvinyl butyral powder B (Tg=75° C., acetal ratio: acetoacetal/butyl acetal=3/7, polymerization degree of 2,600) were added and dissolved. After completion of dissolution, 19.8 g of tetrachlorophthalic acid (13% MEK solution). While further stirring, the following additives were added at intervals of 15 min. to obtain a light-sensitive layer coating solution.

| | |
|---|---|
| Phthalazine | 12.4 g |
| Desmodur N3300 (aliphatic polyisocyanate manufactured by Mobay Chemical Co.) | 17.6 g |
| Yellow dye forming leuco dye YA-1 | 1.4 g |
| Cyan dye forming leuco dye CLA-4 | 0.6 g |
| Antifoggant solution (described below) | 180.0 g |
| Developer solution (described below) | 800.0 g |

Infrared-Sensitizing Dye Solution

In 135 g of MEK were dissolved 400 mg of infrared-sensitizing dye-1, 400 mg of infrared sensitizing dye-2, 130 mg of 5-2-mercaptobenzimidazole, 21.5 g of 2-chlorobenzoic acid and 2.5 g of a dye-solubilizing agent to obtain an infrared-sensitizing dye solution.

Surface Protective Layer Coating Solution

| | |
|---|---|
| MEK | 1056 g |
| Desmodur N3300 (polyisocyanate, Mobay Chemical Corp.) | 148 g |
| PMMA (Paraloid A21, Rohm & Haas Co.) | 6 g |
| Matting agent dispersion (silica, dispersion Degree: 10%, average particle size: 4 μm solid content: 1.7%) | 170 g |
| Ethylene bisstearic acid amide (average particle size: 3 μm) | 2.0 g |
| Lubricant (Table 2) | 2.0 g |
| $(CH_2{=}CHSO_2CH_2)_2CH(OH)$ | 3.6 g |
| Benzotriazole | 2.0 g |
| Fluorosurfactant $C_9F_{17}O(CH_2CH_2O)_{23}C_9F_{17}$ | 5.4 g |
| Fluorosurfactant (Table 2) | 0.12 g |

BC Layer Coating Solution

| | |
|---|---|
| MEK | 1350 g |
| Cellulose acetate propionate (CAP 482-20, Eastman Chemical Co.) | 121 g |
| Dye-A | 0.23 g |
| Dye-B | 0.62 g |
| Fluorinated acryl copolymer (Optoflon FM450, DAIKIN Co.) | 1.21 g |
| Monodisperse spherical three dimension-cured PMMA (average particle size 10 μm) | 2.4 g |

Infrared-sensitizing dye-1

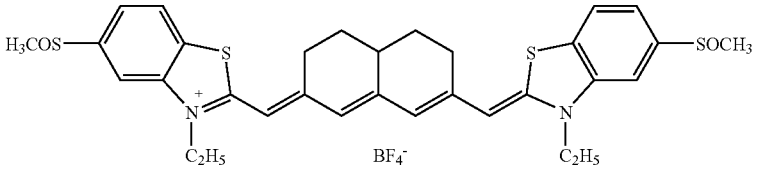

Infrared-sensitizing dye-2

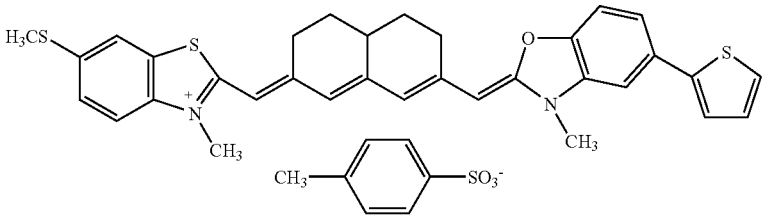

Dye-solubilizing agent

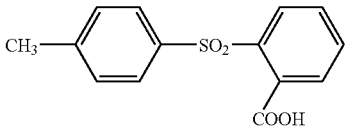

Developer Solution

A developer solution was obtained by dissolving a reducing agent (of compound and amount shown in Table 2), 0.0002 mole of silver saving agent SE 1-4, 9 g of 4-methylphthalic acid and 0.7 g of dye-A in MEK to make 800 g.

Antifoggant Solution:

An antifoggant solution was obtained by dissolving 11.6 g of tribromomethylsulfonylpyridine in MEK to make 180 g.

-continued

| | |
|---|---|
| Lubricant (Table 2) | 2,0 g |
| Ethylene bisstearic acid amide (average particle size: 10 μm) | 2.0 g |
| Fluorosurfactant $C_9F_{17}O\ (CH_2CH_2O)_{23}C_9F_{17}$ | 5.21 g |
| Fluorosurfactant (Table 2) | 0.81 g |

-continued

Dye A

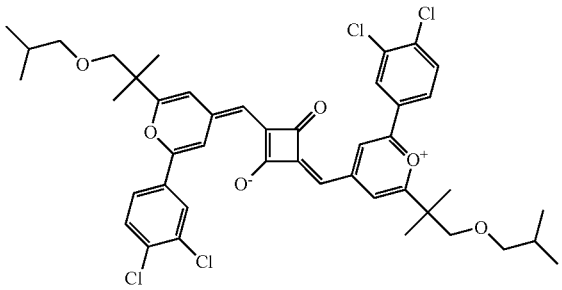

Dye B

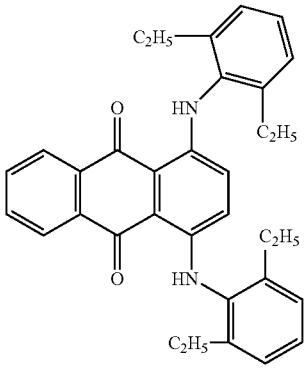

Slip Layer Coating Solution (Light-Sensitive Layer Side)

The light-sensitive layer coating solution was diluted with MEK until reached a solid content of 10.5%. PMMA (Paraloid A21) corresponding to 50% solids of total binder (not including cross-linking agents) of the coating solution was dissolved in MEK, added to the coating solution and diluted with MEK until reached a solid content of 10.5% by using a dissolver-type homogenizer to obtain a slip layer coating solution.

Slip Layer Coating Solution (BC Layer Side)

Similarly to the foregoing BC layer coating solution, a coating solution of a slip layer of the BC layer side was prepared according to the following composition:

| | |
|---|---|
| Cellulose acetate propionate (CAP 482-20) | 15 g |
| Polyester resin (Vitel PE2200B, Bostic Co.) | 0.15 g |

The thus obtained photothermographic material (Sample 101) exhibited a pH of 5.3 and a Bekk smoothness of 9,000 sec. on the light-sensitive layer side, and a pH of 5.5 and a Bekk smoothness of 10,000 sec. on the BC side. Sample 101 also exhibited surface roughness of Rz(E)/Rz(B)=0.14, Rz(E)=0.9 μm [Rz(B)=6.4 μm, Ra(E)=0.06 μm and Ra(B) =0.12 μm.

In Samples 102-125, the absorption maximum (absorption peak) of a yellow dye forming leuco dye was observed at a wavelength of 420 nm and that of a cyan dye forming leuco dye was observed at a wavelength of 620 nm.

Sample 120 was prepared similarly to Sample 118, provided that 345 g of polyvinyl butyral powder A (Tg=75° C., polymerization degree of 700) and 30 g of polyvinyl butyral powder B (Tg=75° C., polymerization degree of 2,600) was replaced by 375 g of polyvinyl butyral (ESLEX B-BL-SHP, produced by Sekisui Kagaku Kogyo Co., Ltd).

Sample 122 was prepared similarly to sample 121, provided that in preparation of the BC layer coating solution, 0.03 g of monodisperse three-dimensionally cured spherical PMMA (average particle size of 20 μm, Tg=135° C., monodisperse degree of 15%) was further added as a matting agent.

Sample 123 was prepared similarly to Sample 122, provided that 2.0 g of ethylene bisstearic acid amide (average particle size of 3 μm) was not added in preparation of the protective layer coating solution of the light-sensitive layer side and 2.0 g of ethylene bisstearic acid amide (average particle size of 10 μm) was not added in preparation of the protective layer of the BC layer side.

The thus prepared photothermographic materials, Samples 101 to 125 were each cut to a size of 34.5 cm×43.0 cm, packed with a packaging material described below in an atmosphere 25° C. and 50% R.H. and allowed to stand at ordinary temperature for 2 weeks. Thereafter, the samples were evaluated as below.

Packaging Material

There were used a paper tray and a barrier bag comprising 10 μm thick polyethylene/9 μm thick aluminum foil/15 μm thick nylon/50 μm thick polyethylene containing 3% carbon and exhibiting an oxygen permeability of 0.02 ml/atm·$m^2$·25° C.·day and a moisture permeability of 0.001 g/$m^2$·40° C.·90% RH·day. A paper tray was used.

Exposure and Processing

The thus prepared samples were simultaneously exposed and developed in a thermal processor (an image forming apparatus), as shown in FIG. 1 (installed with a 786 nm semiconductor laser exhibiting a maximum output of 50 mW, installation area of 0.35 $m^2$), as shown in FIG. 1 (in which designations 51, 52 and 53 were respectively set to a temperature of 100° C., 123° C. and 127° C. and the respective times were 2 sec., 2 sec. and 6 sec and the total time was 10 sec.). The expression, simultaneously exposed and developed means that in a sheet of photothermographic material, one part of the sheet is exposed, while another exposed part is being developed. The distance between the exposure section and the development section was 12 cm, in which the linear transport speed was 33 mm/sec. The transport speed from a photothermographic material supplying device section to an exposure section, the transport speed at the exposure section and the transport speed at the development section were each 33 mm/sec. The bottom of a photothermographic material stock tray was positioned at a height of 45 cm from the floor. The time required for thermal processing (time from pickup in the tray section to discharge) was 30 sec., in which the interval of thermal development was 4 sec when being continuously processed. Exposure was stepwise conducted with decreasing exposure energy by 0.05 (in LogE) for each step from the maximum output.

Evaluation

The thermally processed samples were evaluated with respect to images.

Image Density

The maximum density of the obtained image which was measured by a densitometer (PDM 65 Densitometer, produced by Konica Corp.) was defined as an image density (Dmax).

Gamma Value

Optical densities of the obtained image were measured to determine a gamma value. The gamma value (also denoted as γ-value) was represented by a gamma value at an optical density of 1.2 of a characteristic in curve obtained by thermal development of the respective photothermographic material samples. The characteristic curve refers to a D-logE curve representing the relationship obtained by plotting the optical density, that is, diffuse density (D) as an ordinate against the common logarithm of the exposure (logE) as abscissa. A gamma (γ) value is a slope of a tangent line at the optical density of 1.2 on the characteristic curve (which is also represented by tan θ where θ is an angle between the tangent line and the abscissa).

Abrasion Mark

Film conveyance was conducted using a thermal processor, as shown in FIG. 1 and occurrence of abrasion marks on the uppermost surface of the light-sensitive layer side was visually observed and evaluated based on the criteria in which the best level was ranked as 5 and the worst level was ranked as 1, and evaluated in five grades, provided that evaluation was made at 0.5 intervals. A level of 2.5 or less was unacceptable in practice.

Internal Staining:

After 5,000 sheets of the individual sample were thermally processed in a thermal processor shown in FIG. 1 under the environment of 25° C. and 65% RH, each sample was visually evaluated with respect to stains adhered to the transport roller of the processor, based on the criteria in which the best level of no stain on the roller surface was ranked as 5 and the worst level (staining on the overall surface of the roller) was ranked as 1, and evaluated in five grades, provided that evaluation was made at 0.5 intervals.

Compounds used in the respective samples are shown in Table 2. Evaluation results are shown in Table 3.

TABLE 2

| | | | BC Layer | | Protective Layer*3 | | Reducing Agent | | |
|---|---|---|---|---|---|---|---|---|---|
| Sample No. | *1 | *2 | Lubricant | Fluoro-surfactant | Lubricant | Fluoro-surfactant | RD1*4 (mol) | RD2*5 (mol) | Remark |
| 101 | 92/6/2 | 92 | A | SF-8 | A | SF-8 | 1-1 (0.35) | — | Inv. |
| 102 | 92/6/2 | 92 | B | SF-8 | B | SF-8 | 1-1 (0.35) | — | Inv. |
| 103 | 92/6/2 | 92 | C | SF-8 | C | SF-8 | 1-1 (0.35) | — | Inv. |
| 104 | 92/6/2 | 92 | D | SF-8 | D | SF-8 | 1-1 (0.35) | — | Inv. |
| 105 | 92/6/2 | 92 | E | SF-8 | E | SF-8 | 1-1 (0.35) | — | Inv. |
| 106 | 92/6/2 | 92 | — | SF-8 | E | SF-8 | 1-1 (0.35) | — | Inv. |
| 107 | 92/6/2 | 92 | E | SF-8 | — | SF-8 | 1-1 (0.35) | — | Inv. |
| 108 | 92/6/2 | 92 | E | SF-1 | E | SF-1 | 1-1 (0.35) | — | Inv. |
| 109 | 92/6/2 | 92 | E | SF-9 | E | SF-9 | 1-1 (0.35) | — | Inv. |
| 110 | 92/6/2 | 92 | E | SF-14 | E | SF-14 | 1-1 (0.35) | — | Inv. |
| 111 | 85/11/4 | 85 | E | SF-8 | E | SF-8 | 1-1 (0.35) | — | Inv. |
| 112 | 48/30/22 | 48 | E | SF-8 | E | SF-8 | 1-1 (0.35) | — | Inv. |
| 113 | 92/6/2 | 92 | E | SF-8 | E | SF-8 | 1-3 (0.35) | — | Inv. |
| 114 | 92/6/2 | 92 | E | SF-8 | E | SF-8 | 1-10 (0.35) | — | Inv. |
| 115 | 92/6/2 | 92 | E | SF-8 | E | SF-8 | 1-40 (0.35) | — | Inv. |
| 116 | 92/6/2 | 92 | E | SF-8 | E | SF-8 | 1-47 (0.35) | — | Inv. |
| 117 | 92/6/2 | 92 | E | SF-8 | E | SF-8 | 1-46 (0.10) | 2-6 (0.25) | Inv. |
| 118 | 92/6/2 | 92 | E | SF-8 | E | SF-8 | 1-47 (0.10) | 2-6 (0.25) | Inv. |
| 119 | 92/6/2 | 92 | E | SF-8 | E | SF-8 | 1-1 (0.10) | 2-6 (0.25) | Inv. |
| 120 | 92/6/2 | 92 | E | SF-8 | E | SF-8 | 1-47 (0.10) | 2-6 (0.25) | Inv. |
| 121 | 48/30/22 | 48 | E | SF-8 | E | SF-8 | 1-47 (0.10) | 2-6 (0.25) | Inv. |
| 122 | 48/30/22 | 48 | E | SF-8 | E | SF-8 | 1-47 (0.10) | 2-6 (0.25) | Inv. |
| 123 | 48/30/22 | 48 | E | SF-8 | E | SF-8 | 1-47 (0.10) | 2-6 (0.25) | Inv. |
| 124 | 92/6/2 | 92 | — | SF-8 | — | SF-8 | 1-1 (0.35) | — | Comp. |
| 125 | 92/6/2 | 92 | E | F | E | F | 1-1 (0.35) | — | Comp. |

In Table 2,
*1molar ratio of aliphatic carboxylic acids (behenic acid/arachidic acid/stearic acid)
*2mol % of silver behenate
*3protective layer of the light-sensitive layer
*4reducing agent of formula (RD1)
*5reducing agent of formula (RD2)
A: US-270 (produced by TOAGOSEI Co., Ltd.)
B: US-350 (produced by TOAGOSEI Co., Ltd.)
C: ACTFLOW UTMM-LS2 (Produced by Soken Chemical & Engineering Co., Ltd.)
D: ACTFLOW IBMGV-LS2 (Produced by Soken Chemical & Engineering Co., Ltd.)
E: silicon-containing acryl polymer (hydroxyl-containing copolymer having a repeating unit of methyl methacrylate. Mw: 5000)
F: $C_8F_{17}SO_3Li$

TABLE 3

| Sample No. | γ-value | Image Density (Dmax) | Abrasion Mark | Staining | Remark |
|---|---|---|---|---|---|
| 101 | 4.1 | 4.2 | 4.0 | 4.0 | Inv. |
| 102 | 4.1 | 4.2 | 4.0 | 4.0 | Inv. |
| 103 | 4.1 | 4.2 | 5.0 | 5.0 | Inv. |
| 104 | 4.1 | 4.2 | 4.5 | 4.5 | Inv. |
| 105 | 4.1 | 4.2 | 5.0 | 5.0 | Inv. |
| 106 | 4.1 | 4.1 | 4.0 | 4.0 | Inv. |
| 107 | 4.1 | 4.1 | 4.0 | 4.0 | Inv. |
| 108 | 4.1 | 4.2 | 5.0 | 5.0 | Inv. |
| 109 | 4.1 | 4.2 | 5.0 | 5.0 | Inv. |
| 110 | 4.2 | 4.2 | 5.0 | 5.0 | Inv. |

TABLE 3-continued

| Sample No. | γ-value | Image Density (Dmax) | Abrasion Mark | Staining | Remark |
|---|---|---|---|---|---|
| 111 | 4.1 | 4.2 | 5.0 | 5.0 | Inv. |
| 112 | 4.1 | 4.2 | 4.5 | 4.5 | Inv. |
| 113 | 4.1 | 4.2 | 5.0 | 5.0 | Inv. |
| 114 | 4.1 | 4.2 | 5.0 | 5.0 | Inv. |
| 115 | 6.3 | 4.3 | 5.0 | 5.0 | Inv. |
| 116 | 4.1 | 4.2 | 4.5 | 4.5 | Inv. |
| 117 | 3.9 | 4.1 | 4.5 | 4.5 | Inv. |
| 118 | 3.8 | 4.0 | 4.5 | 4.5 | Inv. |
| 119 | 4.0 | 4.1 | 5.0 | 5.0 | Inv. |
| 120 | 4.2 | 4.2 | 4.0 | 4.0 | Inv. |
| 121 | 4.1 | 4.1 | 4.0 | 4.0 | Inv. |
| 122 | 4.1 | 4.1 | 5.0 | 5.0 | Inv. |
| 123 | 4.0 | 4.1 | 3.5 | 3.5 | Inv. |
| 124 | 4.1 | 4.2 | 1.5 | 1.5 | Comp. |
| 125 | 3.9 | 4.0 | 2.0 | 2.0 | Comp. |

As shown in Table 3, it was proved that photothermographic materials of the invention prevented occurrence of abrasion marks and staining in the interior of the development apparatus.

It was also proved that in sample 101, when using a paper tray with a raised bottom structure in which silica gel was enclosed into the space of the lower portion, the density variation with change of humidity was reduced, leading to an improvement.

What is claimed is:

1. A photothermographic material comprising on one side of a support a light-sensitive layer comprising a light-sensitive silver halide, light-insensitive silver salts of aliphatic carboxylic acids, a reducing agent and a binder resin and a first light-insensitive layer and on the other side of the support a second light-insensitive layer, wherein at least one of the first light-insensitive layer and the second light-insensitive layer comprises a silicon-containing polymer lubricant and a fluorine-containing compound represented by formula (SF) and the silion-containing polymer lubricant is a silion-containing acrylic polymer:

$$[Rf\text{-}(L_1)_{m1}\text{-}]_p\text{-}(L_2)_{n1}\text{-}(A)_q \qquad \text{Formula (SF)}$$

wherein Rf is a substituent having 2 to 16 carbon atoms and 13 or less fluorine atoms; $L_1$ is a linkage group having no fluorine atom; $L_2$ is a (p+q)-valent linkage group having no fluorine atom; A is an anion or its salt; m1 and n1 are each an integer of 0 or 1; p and q are each an integer of 1 to 3, provided that when q is 1, m1 and n1 are not 0 at the same time.

2. The photothermographic material of claim 1, wherein the silicon-containing polymer lubricant has a mass average molecular weight of 1,000 to 20,000.

3. The photothermographic material of claim 1, wherein at least one of the first light-insensitive layer and the second light-insensitive layer comprises an organic solid lubricant.

4. The photothermographic material of claim 3, wherein the organic solid lubricant exhibits a melting point of 110 to 200° C.

5. The photothermographic material of claim 3, wherein the organic solid lubricant is a particulate polymer compound selected from the group consisting of polyethylene, polypropylene and polytetrafluoroethylene.

6. The photothermographic material of claim 3, wherein the organic solid lubricant is a compound represented by formula (1):

$$(R^1\text{—}X^1)_p\text{-}L\text{-}(X^2\text{—}R^2)_q \qquad \text{Formula (1)}$$

wherein p and q are each an integer of 0 to 6 and; $R^1$ and $R^2$ are each an alkyl group, an alkenyl group, an aralkyl or an aryl group; $X^1$ and $X^2$ are each nitrogen-containing divalent linkage group; L is a (p+q)-valent group.

7. The photothermographic material of claim 1, wherein the reducing agent is represented by formula (RD1):

formula (RD1)

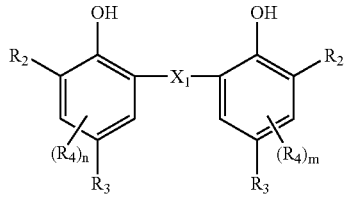

wherein $X_1$ is a chalcogen atom or $CHR_1$ in which $R_1$ is a hydrogen atom, a halogen atom, an alkyl group, an alkenyl group, an aryl group or a heterocyclic group, $R_2$ is an alkyl group, provided that at least one of two $R_2$s is a secondary or tertiary alkyl group; $R_3$ is a hydrogen atom or a group capable of being substituted on a benzene ring; $R_4$ is a group capable of being substituted on a benzene ring; m and n are meach an integer of 0 to 2.

8. The photothermographic material of claim 7, wherein in formula (RD1), at least one of two $R_3$s is an alkyl group having 1 to 20 carbon atoms and substituted by a hydroxyl group, or an alkyl group having 1 to 20 carbon atoms and substituted by a group capable of forming a hydroxyl group upon deprotection.

9. The photothermographic material of claim 7, wherein the light-sensitive layer further comprises a reducing agent represented by formula (RD2):

formula (RD2)

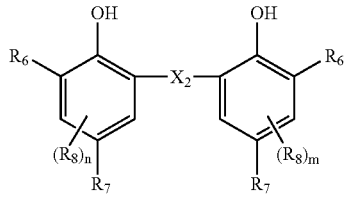

wherein $X_2$ represents a chalcogen atom or $CHR_5$ in which $R_5$ is a hydrogen atom, a halogen atom, an alkyl group, an alkenyl group, an aryl group or a heterocyclic group; two $R_6$s are alkyl groups, which may be the same or different, provided that $R_6$ is not a secondary or tertiary alkyl group; $R_7$ is a hydrogen atom or a group capable of being substituted on a benzene ring; $R_8$ is a group capable of being substituted on a benzene ring; m and n are each an integer of 0 to 2.

10. The photothermographic material claim 1, wherein silver behenate accounts for 70 to 99.99 mol % of the silver salts of aliphatic carboxylic acids.

11. The photothermographic material of claim 1, wherein the binder resin exhibits a glass transition point of 65 to95° C.

* * * * *